US011247245B2

(12) United States Patent
Brown et al.

(10) Patent No.: US 11,247,245 B2
(45) Date of Patent: Feb. 15, 2022

(54) CLEANING APPARATUS WITH ANTI-HAIR WRAP MANAGEMENT SYSTEMS

(71) Applicant: SHARKNINJA OPERATING LLC, Needham, MA (US)

(72) Inventors: Andre D. Brown, Natick, MA (US); Charles S. Brunner, Stockton, NJ (US); Tyler S. Smith, Boston, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/229,796

(22) Filed: Dec. 21, 2018

(65) Prior Publication Data

US 2019/0193120 A1 Jun. 27, 2019

Related U.S. Application Data

(60) Provisional application No. 62/610,733, filed on Dec. 27, 2017.

(51) Int. Cl.
*B08B 1/00* (2006.01)
*A47L 9/04* (2006.01)

(52) U.S. Cl.
CPC ..... *B08B 1/005* (2013.01); *A47L 9/0477* (2013.01); *B08B 1/007* (2013.01)

(58) Field of Classification Search
CPC ..... B08B 1/005; B08B 1/007; A47L 9/0477; A47L 9/0461; A47L 9/0466
See application file for complete search history.

(56) References Cited

U.S. PATENT DOCUMENTS 2,587,038 A 2/1952 Goodell
2,960,714 A 11/1960 Senne
(Continued)

FOREIGN PATENT DOCUMENTS

CN 105982615 A 10/2016
CN 205671990 U 11/2016
(Continued)

OTHER PUBLICATIONS

PCT Search Report and Written Opinion dated Aug. 24, 2018, received in corresponding PCT Application No. PCT/US18/34668, 7 pgs.
(Continued)

*Primary Examiner* — Michael D Jennings
*Assistant Examiner* — Marcel T Dion
(74) *Attorney, Agent, or Firm* — Grossman Tucker Perreault & Pfleger, PLLC

(57) ABSTRACT

A cleaning apparatus includes an end cap assembly for use with an agitator. The end cap assembly includes a stationary end cap, a rotating end cap, and a fragmentor. The stationary end cap is secured to and stationary with respect to a housing of the cleaning apparatus. The rotating end cap is coupled to the agitator and rotates with the agitator relative to the housing. The stationary and rotating end caps define a gap extending radially inward therebetween. The fragmentor is disposed within the gap and is configured to break debris which enters the gap into smaller pieces. The fragmentor may be disposed on a surface of the stationary end cap facing towards the rotating end cap and/or on a surface of the rotating end cap facing towards the stationary end cap. The fragmentor may include a cutting blade and/or an abrasive surface.

21 Claims, 38 Drawing Sheets

(56) References Cited

U.S. PATENT DOCUMENTS

| | | | | |
|---|---|---|---|---|
| 3,612,052 | A | 10/1971 | Krummenacher | |
| 3,737,937 | A | 6/1973 | Nordeen | |
| 3,828,430 | A * | 8/1974 | Yamada | B26B 19/44 30/41.5 |
| 4,177,536 | A | 12/1979 | Powers | |
| 4,955,107 | A | 9/1990 | Kawai | |
| 5,435,038 | A | 7/1995 | Sauers | |
| 5,482,562 | A | 1/1996 | Abernathy | |
| 5,495,634 | A | 3/1996 | Brundula et al. | |
| 6,170,119 | B1 | 1/2001 | Conrad et al. | |
| 6,539,575 | B1 | 4/2003 | Cohen | |
| 6,892,420 | B1 | 5/2005 | Haan et al. | |
| 7,007,336 | B2 * | 3/2006 | Roney | A46B 13/001 15/141.2 |
| 7,979,952 | B2 | 7/2011 | Beskow et al. | |
| 8,060,967 | B1 | 11/2011 | Johnson, Jr. | |
| 8,083,167 | B1 | 12/2011 | Namakian et al. | |
| 8,087,117 | B2 | 1/2012 | Kapoor et al. | |
| 8,418,303 | B2 | 4/2013 | Kapoor et al. | |
| 8,505,158 | B2 | 8/2013 | Han et al. | |
| 8,572,799 | B2 | 11/2013 | Won et al. | |
| 8,601,643 | B2 | 12/2013 | Eriksson | |
| 8,671,515 | B2 | 3/2014 | Eriksson | |
| 9,072,416 | B2 | 7/2015 | Kowalski | |
| 9,192,273 | B2 | 11/2015 | Eriksson | |
| 9,295,362 | B2 | 3/2016 | Eriksson | |
| 9,295,364 | B2 | 3/2016 | Eriksson | |
| 9,314,140 | B2 | 4/2016 | Eriksson | |
| 9,320,398 | B2 | 4/2016 | Hussey et al. | |
| 9,375,122 | B2 | 6/2016 | Eriksson | |
| 9,480,374 | B2 | 11/2016 | Li et al. | |
| 9,492,048 | B2 | 11/2016 | Won et al. | |
| 9,615,708 | B2 | 4/2017 | Kowalski | |
| 9,775,477 | B2 | 10/2017 | Eriksson | |
| 9,820,624 | B2 | 11/2017 | Eriksson | |
| 9,820,626 | B2 | 11/2017 | Eriksson et al. | |
| 9,833,115 | B2 | 12/2017 | Eriksson | |
| 9,839,335 | B2 | 12/2017 | Eriksson | |
| 10,314,449 | B2 | 6/2019 | Blouin | |
| 2003/0204923 | A1 | 11/2003 | Nakamura | |
| 2006/0042042 | A1 | 3/2006 | Mertes et al. | |
| 2006/0053584 | A1 | 3/2006 | Dever | |
| 2007/0209147 | A1 | 9/2007 | Krebs et al. | |
| 2008/0052846 | A1 * | 3/2008 | Kapoor | A47L 9/106 15/52.1 |
| 2008/0115736 | A1 | 5/2008 | Porter et al. | |
| 2010/0011529 | A1 | 1/2010 | Won et al. | |
| 2010/0313912 | A1 | 12/2010 | Han et al. | |
| 2011/0252594 | A1 * | 10/2011 | Blouin | A47L 9/0477 15/383 |
| 2013/0007982 | A1 | 1/2013 | Yun | |
| 2013/0042429 | A1 * | 2/2013 | Misumi | A46B 17/06 15/415.1 |
| 2013/0198995 | A1 | 8/2013 | Eriksson | |
| 2014/0053351 | A1 | 2/2014 | Kapoor et al. | |
| 2014/0143978 | A1 * | 5/2014 | Li | A47L 9/0444 15/383 |
| 2014/0259522 | A1 | 9/2014 | Kasper et al. | |
| 2014/0359968 | A1 | 12/2014 | Eriksson et al. | |
| 2014/0366300 | A1 | 12/2014 | Eriksson | |
| 2015/0230676 | A1 | 8/2015 | Eriksson | |
| 2015/0313431 | A1 | 11/2015 | Eriksson | |
| 2015/0342430 | A1 | 12/2015 | Kasper et al. | |
| 2016/0058257 | A1 | 3/2016 | Ventress et al. | |
| 2016/0166052 | A1 | 6/2016 | Kasper et al. | |
| 2016/0220081 | A1 * | 8/2016 | Xu | A47L 9/04 |
| 2016/0220082 | A1 | 8/2016 | Thorne et al. | |
| 2016/0220084 | A1 | 8/2016 | Xu et al. | |
| 2017/0172363 | A1 | 6/2017 | Eriksson et al. | |
| 2017/0172364 | A1 | 6/2017 | Eriksson | |
| 2017/0280957 | A1 * | 10/2017 | Jeong | A47L 5/30 |
| 2017/0311767 | A1 | 11/2017 | Fang | |
| 2018/0070785 | A1 | 3/2018 | Udy et al. | |
| 2018/0184862 | A1 * | 7/2018 | Choi | A46B 1/00 |
| 2020/0046183 | A1 * | 2/2020 | Choi | A47L 7/0066 |

FOREIGN PATENT DOCUMENTS

| | | | |
|---|---|---|---|
| CN | 107233047 | A | 10/2017 |
| DE | 102007006654 | A1 | 8/2008 |
| DE | 102019106501 | A1 | 9/2020 |
| EP | 2570067 | | 3/2013 |
| GB | 583738 | | 12/1946 |
| GB | 2310213 | A | 8/1997 |
| JP | S62155812 | A | 7/1987 |
| KR | 1020130107152 | A | 7/1987 |
| KR | 1020170111688 | A | 10/2017 |
| WO | 2009117383 | A2 | 9/2009 |
| WO | 2014095604 | A1 | 6/2014 |
| WO | 2014140872 | A2 | 9/2014 |
| WO | 2016030756 | A1 | 3/2016 |

OTHER PUBLICATIONS

PCT International Search Report and Written Opinion dated Jun. 6, 2018, received in corresponding PCT Application No. PCT/US18/21888, 12 pgs.

PCT Search Report and Written Opinion dated Dec. 20, 2017, received in corresponding PCT Application No. PCT/US17/50691, 11 pgs.

PCT Search Report and Written Opinion dated Mar. 5, 2019, received in corresponding PCT Application No. PCT/US18/67171, 8 pgs.

PCT Search Report and Written Opinion dated May 3, 2019, received in corresponding PCT Application No. PCT/US18/67163, 14 pgs.

U.S. Office Action dated May 1, 2019, received in U.S. Appl. No. 15/699,358, 26 pgs.

Chinese Office Action with translation dated Sep. 1, 2020, received in Chinese Application No. 201880023329.6, 12 pgs.

Chinese Office Action with translation dated Sep. 1, 2020, received in Chinese Application No. 201780055478.6, 10 pgs.

U.S. Office Action dated Jun. 17, 2020, received in U.S. Appl. No. 15/699,358, 16 pgs.

Canadian Office Action dated Mar. 4, 2020, received in Canadian Patent Application No. 3,036,354, 4 pgs.

U.S. Office Action dated Apr. 29, 2020, received in U.S. Appl. No. 15/917,598, 12 pgs.

Chinese Office Action with English translation dated May 22, 2020, received in Chinese Application No. 201880043227.0, 8 pgs.

Canadian Examiners Report dated Nov. 6, 2020, received in Canadian Application No. 3,036,354, 4 pgs.

EP Search Report dated Dec. 1, 2020, received in EP Application No. 18763596.6, 7 pgs.

EP Search Report dated Nov. 26, 2020, received in EP Application No. 18806571.8, 7 pgs.

EP Search Report dated Nov. 26, 2020, received in EP Application No. 18894320.3, 6 pgs.

EP Search Report dated Nov. 25, 2020, received in EP Application No. 18897246.7, 7 pgs.

U.S. Office Action dated Feb. 19, 2021, received in U.S. Appl. No. 15/699,358, 17 pages.

Chinese Office Action with translation dated May 24, 2021, received in China Application No. 201780055478.6, 8 pgs.

Chinese Office Action with English translation dated Jun. 3, 2021, received in Chinese Patent Application No. 201880090257.7, 16 pages.

UK Examination Report dated Jul. 8, 2021, received in U.K. Patent Application No. GB1903295.2, 2 pages.

Canadian Office Action dated Aug. 13, 2021, received in Canadian Patent Application No. 3,036,354, 3 pages.

Chinese Office Action with English translation dated Aug. 18, 2021, received in Chinese Patent Application No. 201880090292.9, 11 pages.

(56) References Cited

OTHER PUBLICATIONS

Chinese Decision of Rejection with English translation dated Sep. 3, 2021, received in Chinese Patent Application No. 201780055478.6, 7 pages.
UK Examination Report dated Nov. 16, 2021, received in UK Patent Application No. GB1903295.2, 2 pages.

* cited by examiner

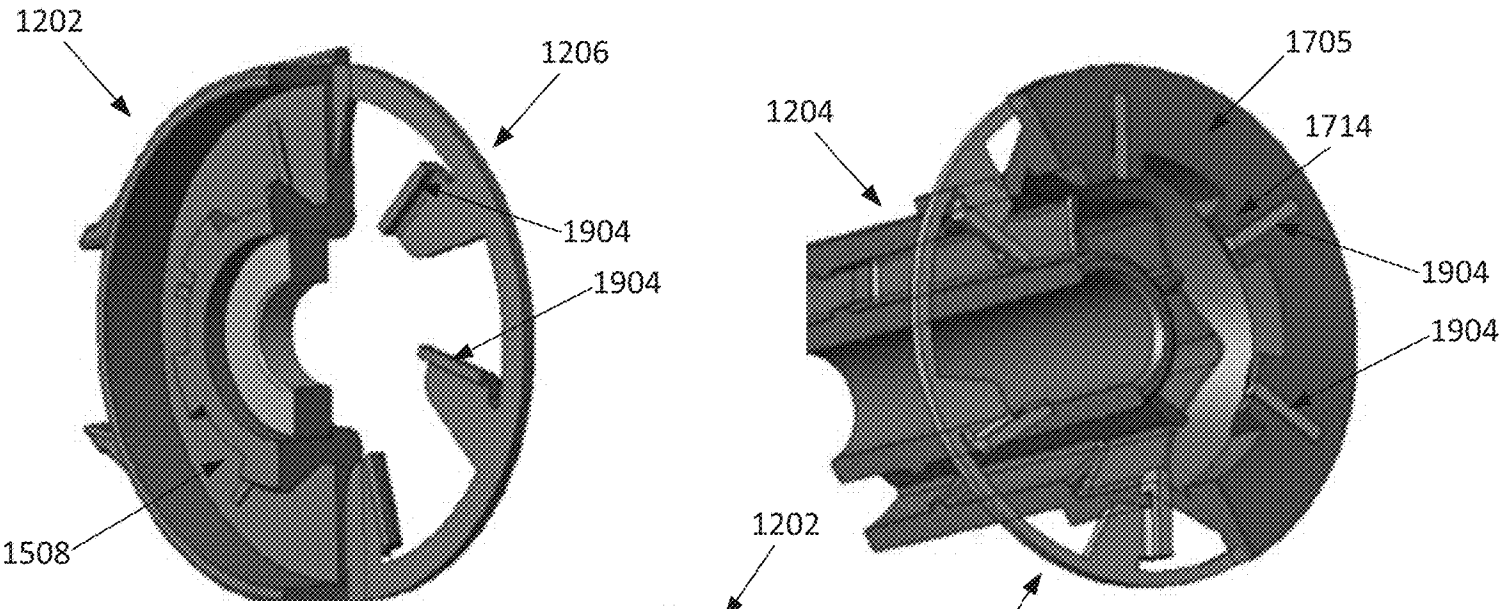
FIG. 20
FIG. 21
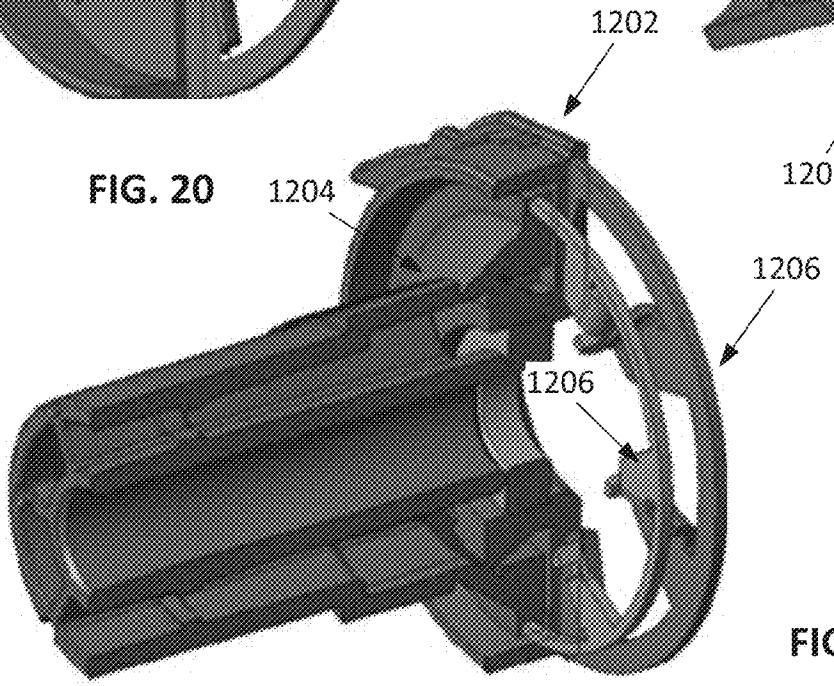
FIG. 22

CLEANING APPARATUS WITH ANTI-HAIR WRAP MANAGEMENT SYSTEMS

CROSS-REFERENCE TO RELATED APPLICATIONS

The present disclosure claims the benefit of U.S. Provisional Patent Application Ser. No. 62/610,733 filed Dec. 27, 2017, which is fully incorporated herein by reference.

TECHNICAL FIELD

The present disclosure relates to cleaners with cleaning rollers/agitators and more particularly, to a cleaning apparatus, such as a surface cleaning head for a vacuum cleaner, including anti-hair wrap systems and methods for removing debris from a cleaning roller/agitator.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

One example of an agitator is a cleaning roller such as a brush roll. A cleaning roller may be located within a suction conduit and/or may be located at a leading side of a suction conduit (e.g., a leading roller). One challenge with a rotating agitator is that debris (e.g., hair) may become entangled around the agitator. As such, there exists a need for device that can generally reduce and/or prevent debris (e.g., hair) from becoming entangled around the agitator.

BRIEF DESCRIPTION OF THE DRAWINGS

These and other features and advantages will be better understood by reading the following detailed description, taken together with the drawings wherein:

FIG. 20 is a perspective view of another embodiment of a fragmentor.

FIG. 21 is a perspective view of a further embodiment of a fragmentor.

FIG. 22 is a perspective view of yet another embodiment of a fragmentor.

DETAILED DESCRIPTION

Figure 1:
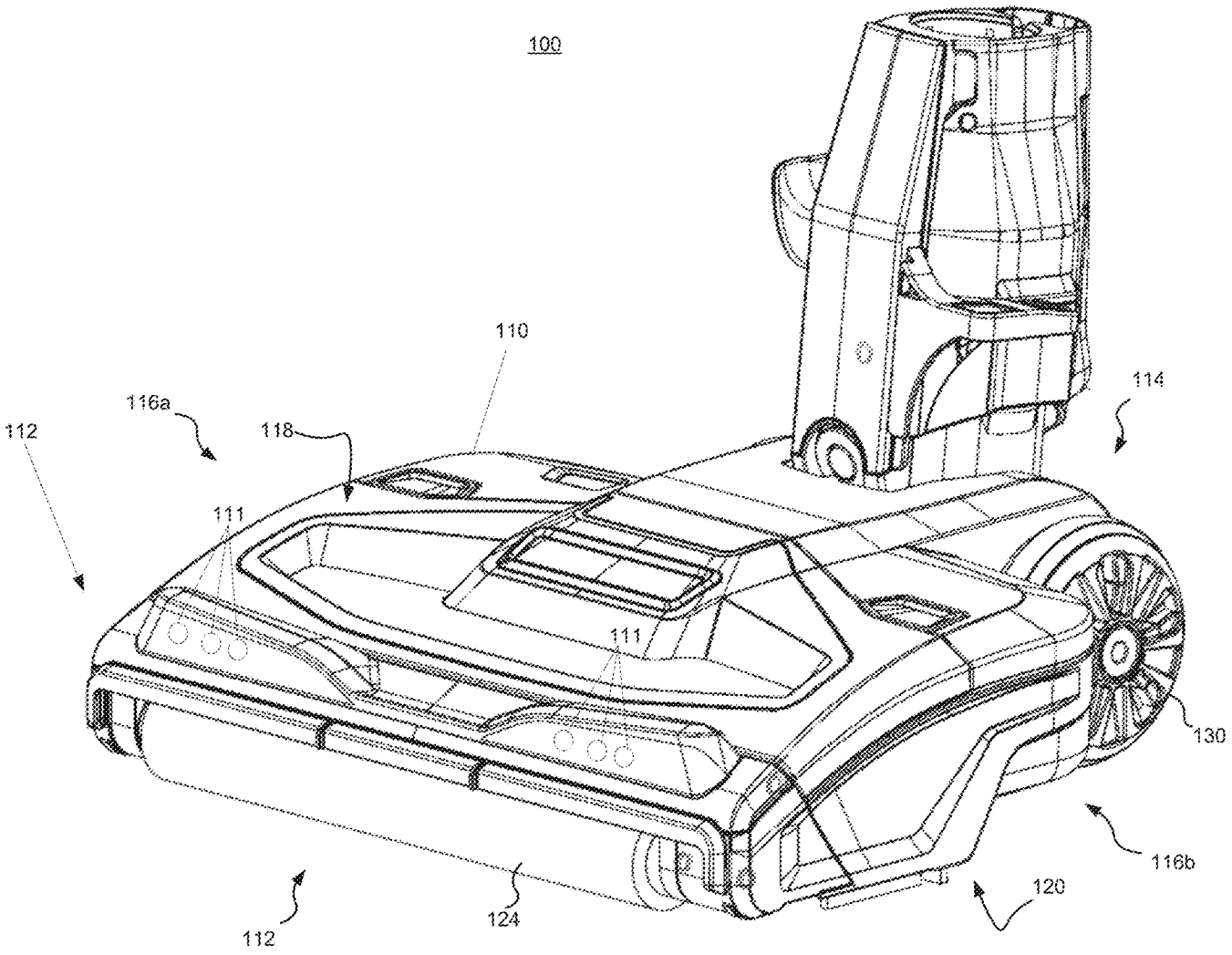
FIG. 1 is a perspective view of a surface cleaning head including dual agitators, combing protrusions, and an isolator, consistent with an embodiment of the present disclosure.

A cleaning apparatus, consistent with at least one aspect of the present disclosure, includes an end cap assembly for use with an agitator. The end cap assembly includes a stationary end cap, a rotating end cap, and at least one fragmentor. The stationary end cap is configured to be secured to a housing of the cleaning apparatus such that the stationary end cap is stationary with respect to the housing. The rotating end cap is configured to be coupled to the agitator and is configured to rotate relative to the housing such that rotation of the agitator results in rotation of the rotating end cap relative to the stationary end cap. The stationary end cap and the rotating end cap define a gap extending radially inward therebetween. The fragmentor is disposed within the gap and is configured to break debris which enters into the gap into smaller pieces. The fragmentor may be disposed on a surface of the stationary end cap facing towards the rotating end cap and/or on a surface of the rotating end cap facing towards the stationary end cap. The fragmentor may include a cutting blade and/or an abrasive surface (e.g., sandpaper or the like).

The stationary end cap and the rotating end cap may include stationary alignment castellations and rotating alignment castellations, respectively. The stationary alignment castellations and rotating alignment castellations are configured to align the rotating end cap relative to the stationary end cap as the rotating end cap rotates relative to the stationary end to define the gap. The stationary alignment castellations may comprise a plurality of alternating notches and protrusions and the rotating alignment castellations may comprise a plurality of alternating notches and protrusions. The plurality of alternating notches and protrusions of the stationary alignment castellations may extend radially outward from a central hub (which extends along a pivot axis of the agitator). The plurality of alternating notches and protrusions of the rotating alignment castellations may extend radially inward from a central disc (which extends radially outward the pivot axis of the agitator). The stationary alignment castellations may further define a track configured to allow the plurality of protrusions of the rotating alignment castellations to rotate as the rotating end cap rotates about the pivot axis. The rotating alignment castellations may also further define a track configured to allow the plurality of protrusions of the stationary alignment castellations to pass through as the rotating end cap rotates about the pivot axis.

Although specific embodiments of a surface cleaning head with two agitators are shown, other embodiments of a cleaning apparatus with only a single agitator are within the scope of the present disclosure. In addition, while specific embodiments of a surface cleaning head with a combing unit are shown, other embodiments of a cleaning apparatus without a combing unit are within the scope of the present disclosure. The cleaning apparatus may be used in different types of vacuum cleaners including, without limitation, an "all in the head" type vacuum, upright vacuum cleaners, canister vacuum cleaners, stick vacuum cleaners, robotic vacuum cleaners and central vacuum systems, and may be used in sweepers (e.g., low or no suction). The surface cleaning head may also include removable agitators (e.g., brush rolls) in openable agitator chambers, such as the type described in greater detail in U.S. Pat. No. 9,456,723 and U.S. Patent Application Pub. No. 2016/0220082, which are commonly-owned and fully incorporated herein by reference.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Figure 2:
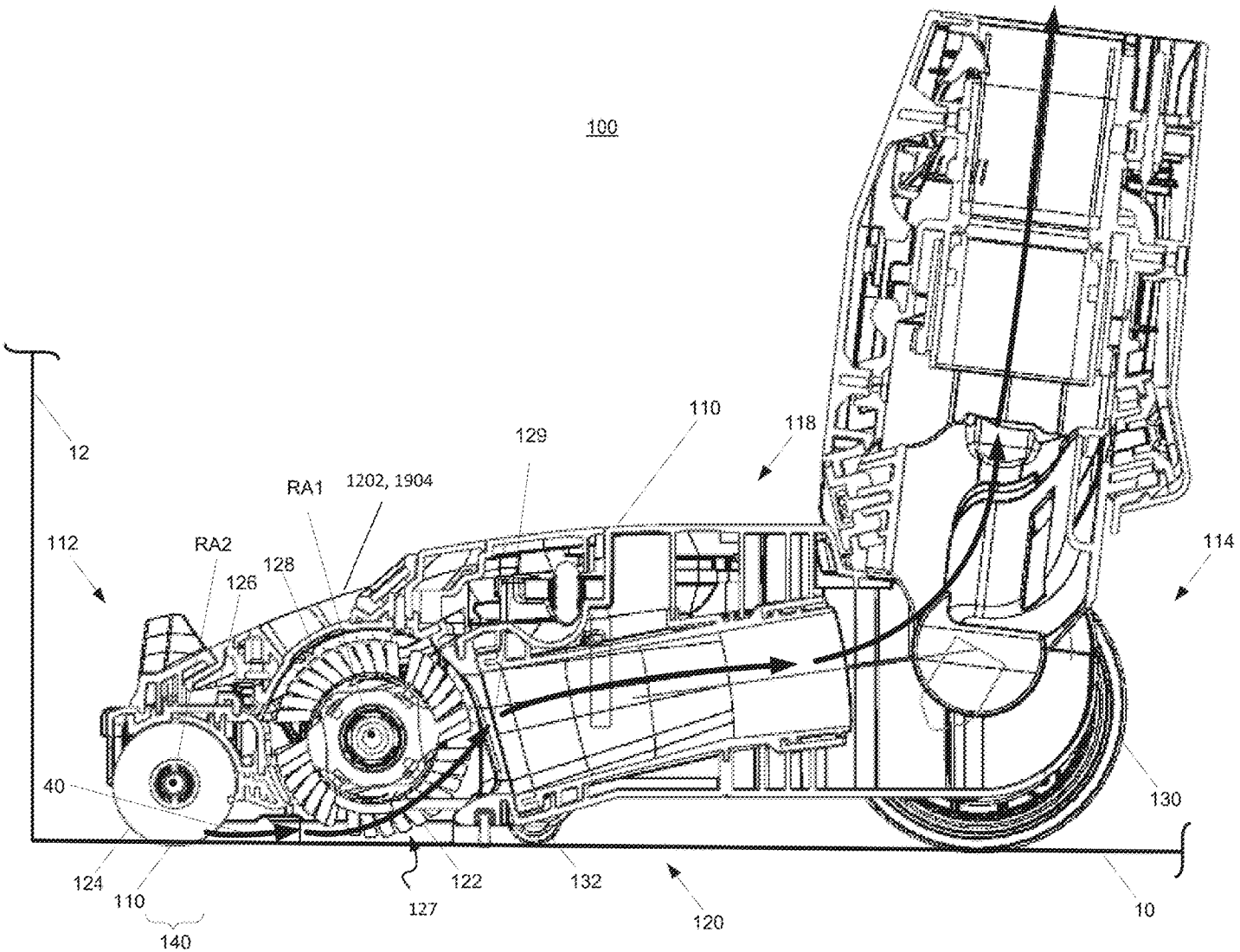
FIG. 2 is a side cross-sectional view of the surface cleaning head shown in FIG. 1 showing a flow path through a suction conduit.

Referring to FIGS. 1-2, one embodiment of a surface cleaning head 100 is generally illustrated. The surface cleaning head 100 includes a housing 110 with a front side 112, and a back side 114, left and right sides 116*a*, 116*b*, an upper side 118, and a lower or underside 120. The housing 110 defines a suction conduit 128 having an opening 127 on the underside 120 of the housing 110 (shown in FIG. 2). The suction conduit 128 is fluidly coupled to a dirty air inlet 129, which leads to a suction motor (not shown) either in the surface cleaning head 100 or another location in the vacuum. The suction conduit 128 is the interior space defined by interior walls in the housing 110, which receives and directs air drawn in by suction, and the opening 127 is where the suction conduit 128 meets the underside 120 of the housing 110.

In the illustrated embodiment, the surface cleaning head 100 includes dual rotating agitators 122, 124, for example, a brush roll 122 and a leading roller 124. The brush roll 122 and leading roller 124 may be configured to rotate about first and second rotating axes (RA1, RA2). The rotating brush roll 122 is at least partially disposed within the suction conduit 128 (shown in FIG. 2). The leading roller 124 is positioned in front of and spaced from the brush roll 122 and at least substantially outside the suction conduit 128. In some embodiments, at least an inside upper portion (e.g., upper half) of the leading roller 124 is not exposed to the primary air flow path (e.g., arrow 40) into the opening 127 of the suction conduit 128 while at least an inside of the bottom portion of the leading roller 124 is exposed to the primary flow path into the opening 127 of the suction conduit 128.

Other variations are possible where different portions of the leading roller 124 may be exposed or not exposed to the flow path into the suction conduit 128. In other embodiments, for example, a flow path may allow air to flow over the upper portion of the leading roller 124. The leading roller 124 may rotate about the second rotation axis RA2 located within a leading roller chamber 126. The leading roller chamber 126 may have a size and shape slightly larger than the cylindrical projection of the leading roller 124 when the leading roller 124 is rotating therein, for example, to form the flow path over the upper portion. While FIGS. 1-2 illustrate a surface cleaning head 100 having dual rotating agitators 122, 124, it should be appreciated that a surface cleaning head 100 consistent with the present disclosure may include only a single rotating agitator or more than two agitators.

The surface cleaning head 100 may include one or more wheels 130 for supporting the housing 110 on the surface 10 to be cleaned. The brush roll 122 may be disposed in front of one or more wheels 130, 132 (see FIG. 1) for supporting the housing 110 on the surface 10 to be cleaned. For example, one or more larger wheels 130 may be disposed along the back side 114 and/or one or more smaller middle and/or front wheels 132 may be provided at a middle section and/or front section on the underside 120 of the housing 110 and/or along the left and right sides 116*a*, 116*b*. Other wheel configurations may also be used. The wheels 130, 132 facilitate moving the surface cleaning head 100 along the surface 10 to be cleaned, and may also allow the user to easily tilt or pivot the surface cleaning head 100 (e.g., brush roll 122 and/or the leading roller 124) off of the surface 10 to be cleaned. The rear wheel(s) 130 and the middle/front wheel(s) 132 may provide the primary contact with the surface being cleaned and thus primarily support the surface cleaning head 100. When the surface cleaning head 100 is positioned on the surface 10 being cleaned, the leading roller 124 may also rest on the surface 10 being cleaned. In other embodiments, the leading roller 124 may be positioned such that the leading roller 124 sits just above the surface being cleaned.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may have an outside diameter Dlr that is smaller than the outside diameter Dbr of the brush roll 122. For example, the diameter Dlr may be greater than zero and less than or equal to 0.8 Dbr, greater than zero and less than or equal to 0.7 Dbr, or greater than zero and less than or equal to 0.6 Dbr. According to example embodiments, the diameter Dlr may be in the range of 0.3 Dbr to 0.8 Dbr, in the range of 0.4 Dbr to 0.8 Dbr, in the range of 0.3 Dbr to 0.7 Dbr, or in the range of 0.4 Dbr to 0.7 Dbr. As an illustrative example, the brush roll 122 may have an outside diameter of 48 mm and the leading roller 124 may have an outside diameter of 30 mm. While the leading roller 124 may have an outside diameter Dlr that is smaller than the outside diameter Dbr of the brush roll 122, the brush roll 122 may have bristles that are longer than the bristle and/or pile of the leading roller 122.

Positioning a leading roller 124 (having a diameter Dlr that is smaller than the diameter Dbr of the brush roll 122) in front of the brush roll 122 provides numerous benefits. For example, this arrangement decreases the height of the front side 112 of the surface cleaning head 100 (e.g., the housing 110) from the surface 10 to be cleaned. The decreased height of the front of the surface cleaning head 100 provides a lower profile that allows the surface cleaning head 100 to fit under objects (e.g., furniture and/or cabinets). Moreover, the lower height allows for the addition of one or more light sources 111 (e.g., but not limited to, LEDs), while still allowing the surface cleaning head 100 to fit under objects.

Additionally, the smaller diameter Dlr of the leading roller 124 allows the rotating axis of the leading roller 124 to be placed closer to the front side 112 of the surface cleaning head 100. When rotating, the leading roller 124 forms a generally cylindrical projection having a radius that is based on the overall diameter of the leading roller 124. As the diameter of the leading roller 124 decreases, the bottom contact surface 140 (FIG. 2) of the leading roller 124 moves forward towards the front side 112 of the surface cleaning head 100. In addition, when the surface cleaning head 100 contacts a vertical surface 12 (e.g., but not limited to, a wall, trim, and/or cabinet), the bottom contact surface 140 of the leading roller 124 is also closer to the vertical surface 12, thereby enhancing the front edge cleaning of the surface cleaning head 100 compared to a larger diameter leading roller. Moreover, the smaller diameter Dlr of the leading roller 124 also reduces the load/drag on the motor driving the leading roller 124, thereby enhancing the lifespan of the motor and/or allowing a smaller motor to be used to rotate both the brush roll 122 and leading roller 124.

The rotating brush roll 122 may be coupled to an electrical motor (either AC or DC) to cause the rotating brush roll 122 to rotate about the first rotating axis. The rotating brush roll 122 may be coupled to the electrical motor by way of a gears and/or drive belts. The leading roller 124 may be driven from the same drive mechanism used to drive the rotating brush roll 122 or a separate drive mechanism. An example of the drive mechanism is described in U.S. patent application Ser. No. 15/331,045, filed Oct. 21, 2016, which is incorporated herein by reference. Other drive mechanisms are possible and within the scope of the present disclosure.

In at least one embodiment, the brush roll 122 and the leading roller 124 rotate in the same direction directing debris toward the suction conduit 128, for example, counter clockwise as shown in FIG. 2. This arrangement may reduce the number of parts (e.g., no clutch or additional gear train may be necessary), thereby making the surface cleaning head 100 lighter, reducing drivetrain loss (thereby allowing for smaller/less expensive motors), and less expensive to manufacture. Optionally, the brush roll 122 and the leading roller 124 may rotate at same speed, thereby reducing the number of parts (e.g., no additional gear train necessary) and reducing drivetrain loss (thus, smaller/less expensive motor) and making the surface cleaning head 100 lighter and less expensive to manufacture.

As shown in FIG. 2, the leading roller 124 may be positioned within the housing 110 such that the bottom contact surface 140 is disposed closer to the surface 10 to be cleaned compared to the bottom contact surface of the brush roll 122. This arrangement allows the leading roller 124 to contact a surface 10 (e.g., a hard surface) without the brush roll 122 contacting the hard surface 10. As may be appreciated, the leading roller 124 is intended to pick up debris from a hard surface 10 while the brush roll 122 is intended to primarily contact a carpet surface. This arrangement is therefore beneficial since it allows the leading roller 124 to form a seal between the front 112 of the surface cleaning head 100 with the hard surface 10, thereby enhancing airflow and suction with the hard surface 10. Additionally, this arrangement reduces the drag/torque on the drive motor (s) since the brush roll 122 (in some embodiments) does not have to contact the hard surface 10. The reduced drag/torque may allow for a smaller, less expensive motor and/or may increase the lifespan of the motor.

One or both of the leading roller 124 and the brush roll 122 may be removable. The leading roller 124 may be removably coupled to the housing 110 of the surface cleaning head 100. For example, a portion of the housing 110 (such as, but not limited to, a portion of the left and/or right side 116*a*, 116*b*) may be removably/hingedly coupled thereto. To remove the leading roller 124, the removable portion may be unsecured/uncoupled from the rest of the housing 110, thereby allowing the leading roller 124 to disengage from a drive wheel and allowing the leading roller 124 to be removed from the leading roller chamber 126. Other ways of removably coupling the leading roller 124 within the housing 110 are also possible and within the scope of the present disclosure.

Figure 3:
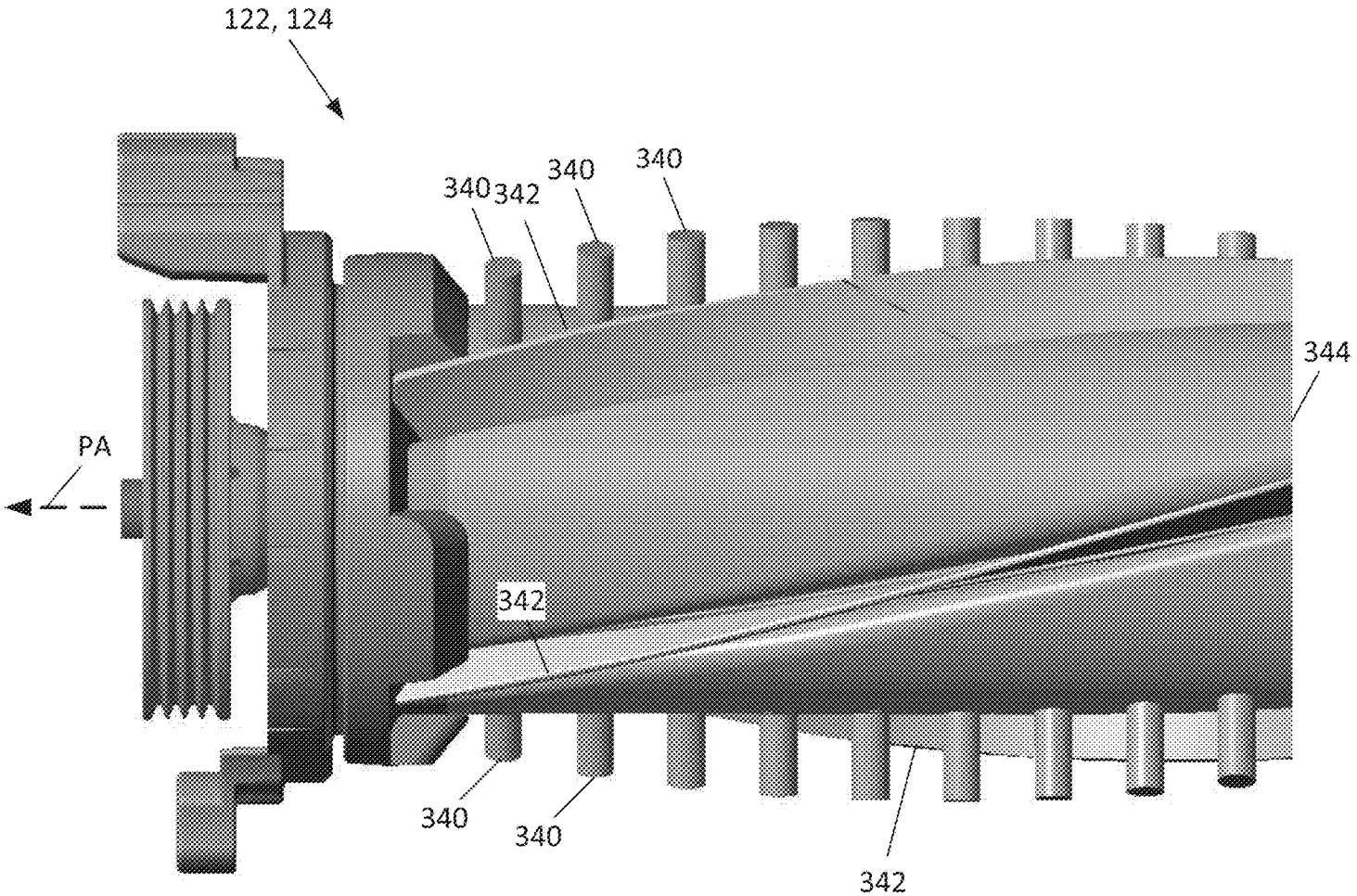
FIG. 3 is a side view of one example of an agitator.

With reference to FIG. 3, the one or more of the agitators 122, 124 may include an elongated agitator body 344 that is configured to extend along and rotate about a longitudinal/pivot axis PA. The agitator 122, 124 (e.g., but not limited to, one or more of the ends of the agitator 122, 124) is permanently or removably coupled to the body 110 and may be rotated about the pivot axis PA by a rotation system. The agitator 122, 124 may come into contact with elongated debris such as, but not limited to, hair, string, fibers, and the like (hereinafter collectively referred to as hair for ease of explanation). The hair may have a length that is much longer than the circumference of the agitator 122, 124. By way of a non-limiting example, the hair may have a length that is 2-10 times longer than the circumference of the agitator 122, 124. Because of the rotation of the agitator 122, 124 as well as the length and flexibility of the hair, the hair will tend to wrap around the circumference of the agitator 122, 124.

As may be appreciated, an excessive amount of hair building up on the agitator 122, 124 may reduce the efficiency of the agitator 122, 124 and/or causing damage to the cleaning apparatus 100 (e.g., the rotation systems or the like). To address the problem of hair wrapping around the agitator 122, 124, the agitator 122, 124 may optionally include a plurality of bristles 340 aligned in one or more rows or strips as well as one or more sidewalls and/or continuous sidewalls 342 adjacent to at least one row of bristles 340. The rows of bristles 340 and continuous sidewall 342 are configured to reduce hair from becoming entangled in the bristles 340 of the agitator 122, 124. Optionally, the combination of the bristles 340 and sidewall 342 may be configured to generate an Archimedes screw force that urges/causes the hair to migrate towards one or more collection areas and/or ends of the agitator 122, 124. The bristles 340 may include a plurality of tufts of bristles 340 arranged in rows and/or one or more rows of continuous bristles 340.

The plurality of bristles 340 extend outward (e.g., generally radial outward) from the elongated agitator body 344 (e.g., a base portion) to define one or more continuous rows. One or more of the continuous rows of bristles 340 may be coupled (either permanently or removably coupled) to the elongated agitator body 344 (e.g., to a base region of the body 344) using one or more form locking connections (such as, but not limited to, a tongue and groove connection, a T-groove connection, or the like), interference connections (e.g., interference fit, press fit, friction fit, Morse taper, or the like), adhesives, fasteners overmoldings, or the like.

The rows of bristles 340 at least partially revolve around and extend along at least a portion of the longitudinal axis/pivot axis PA of the elongated agitator body 344 of the agitator 122, 124. As defined herein, a continuous row of bristles 340 is defined as a plurality of bristles 340 in which the spacing between adjacent bristles 340 along the axis of rotation PA is less than or equal to 3 times the largest cross-sectional dimension (e.g., diameter) of the bristles 340.

As mentioned above, the plurality of bristles 340 may be aligned in and/or define at least one row that at least partially revolves around and extends along at least a portion of the longitudinal axis/pivot axis PA of the elongated agitator body 344 of the agitator 122, 124. For example, at least one of the rows of bristles 340 may be arranged in a generally helical, arcuate, and/or chevron configuration/pattern/shape. Optionally, one or more of the rows of bristles 340 (e.g., the entire row or a portion thereof) may have a constant pitch (e.g., constant helical pitch). Alternatively (or in addition), one or more of the rows of bristles 340 (e.g., the entire row or a portion thereof) may have a variable pitch (e.g., variable helical pitch). For example, at least a portion of the row of bristles 340 may have a variable pitch that is configured to accelerate the migration of hair and/or generally direct debris towards the debris collection chamber.

At least one row of bristles 340 is proximate to (e.g., immediately adjacent to) at least one sidewall 342. The sidewall 342 may be disposed as close as possible to the nearest row of bristles 340, while still allowing the bristles 340 to bend freely left-to-right. For example, one or more of the sidewalls 342 (which also may be referred to as strips or flaps) may extend substantially continuously along the row of bristles 340. In one embodiment, at least one sidewall 342 extends substantially parallel to at least one of the rows of bristles 340. As used herein, the term "substantially parallel" is intended to mean that the separation distance between the sidewall 342 and the row of bristles 340 remains within 15% of the greatest separation distance along the entire longitudinal length of the row of bristles 340. Also, as used herein, the term "immediately adjacent to" is intended to mean that no other structure feature or element having a height greater than the height of the sidewall 342 is disposed between the sidewall 342 and a closest row of bristles 340, and that the separation distance D between the sidewall 342 and the closest row of bristles 340 is less than, or equal to, 5 mm (for example, less than or equal to 3 mm, less than or equal to 2.5 mm, less than or equal to 1.5 mm, and/or any range between 1.5 mm to 3 mm).

One or more of the sidewalls 342 may therefore at least partially revolve around and extend along at least a portion of the longitudinal axis/pivot axis PA of the elongated agitator body 344 of the agitator 122, 124. For example, at least one of the sidewalls 342 may be arranged in a generally helical, arcuate, and/or chevron configuration/pattern/shape. Optionally, one or more of the sidewalls 342 (e.g., the entire row or a portion thereof) may have a constant pitch (e.g., constant helical pitch). Alternatively (or in addition), one or more of the sidewalls 342 (e.g., the entire row or a portion thereof) may have a variable pitch (e.g., variable helical pitch).

While the agitator 122, 124 is shown having a row of bristles 340 with a sidewall 342 arranged behind the row of bristles 340 as the agitator 122, 124 rotates about the pivot axis PA, the agitator 122, 124 may include one or more sidewalls 342 both in front of and behind the row of bristles 340. As noted above, one or more of the sidewalls 342 may extend outward from a portion of the elongated agitator body 344 as generally illustrated. For example, one or more of the sidewalls 342 may extend outward from the base of the elongated agitator body 344 from which the row of bristles 340 is coupled and/or may extend outward from a portion of an outer periphery of the elongated agitator body 344. Alternatively (or in addition), one or more of the sidewalls 342 may extend inward from a portion of the elongated agitator body 344. For example, the radially distal-most portion of the sidewall 342 may be disposed at a radial distance from the pivot axis PA of the elongated agitator body 344 that is within 20 percent of the radial distance of the adjacent, surrounding periphery of the elongated agitator body 344, and the proximal-most portion of the sidewall 342 (i.e., the portion of the sidewall 342 which begins to extend away from the base) may be disposed at a radial distance that is less than the radial distance of the adjacent, surrounding periphery of the elongated agitator body 344. As used herein, the term "adjacent, surrounding periphery" is intended to refer to a portion of the periphery of the elongated agitator body 344 that is within a range of 30 degrees about the pivot axis PA.

The agitator 122, 124 may therefore include at least one row of bristles 340 substantially parallel to at least one sidewall 342. According to one embodiment, at least a portion (e.g., all) of the bristles 340 in a row may have an overall height Hb (e.g., a height measured from the pivot axis PA) that is longer than the overall height Hs (e.g., a height measured from the pivot axis PA) of at least one of the adjacent sidewalls 342. Alternatively (or in addition), at least a portion (e.g., all) of the bristles 340 in a row may have a height Hb that is 2-3 mm (e.g., but not limited to, 2.5 mm) longer than the height Hs of at least one of the adjacent sidewalls 342. Alternatively (or in addition), the height Hs of at least one of the adjacent sidewalls 342 may be 60 to 100% of the height Hb of at least a portion (e.g., all) of the bristles 340 in the row. For example, the bristles 340 may have a height Hb in the range of 12 to 32 mm (e.g., but no limited to, within the range of 122, 124 to 20.5 mm) and the adjacent sidewall 342 may have a height Hs in the range of 10 to 29 mm (e.g., but no limited to, within the range of 15 to 122, 124 mm).

The bristles 340 may have a height Hb that extends at least 2 mm. beyond the distal-most end of the sidewall 342. The sidewall 342 may have a height Hs of at least 2 mm from the base 52, and may up a height Hs that is 50% or less of the height Hb of the bristles 340. At least one sidewall 342 should be disposed close enough to the at least one row 46 of bristles 340 to increase the stiffness of the bristles 340 in at least one front-to-back direction as the agitator 122, 124 is rotated during normal use. The sidewall 342 may therefore allow the bristles 340 to flex much more freely in at least one side-to-side direction compared to a front-to-back direction. For example, the bristles 340 may be 25%-40% (including all values and ranges therein) stiffer in the front-to-back direction compared to side-to-side direction. According to one embodiment, the sidewall 342 may be located adjacent to (e.g., immediately adjacent to) the row 46 of bristles 340. For example, the distal most end of the sidewall 342 (i.e., the end of the sidewall 342 furthest from the center of rotation PA) may be 0-10 mm from the row 46 of bristles 340, such as 1-9 mm from the row 46 of bristles 340, 2-7 mm from the row 46 of bristles 340, and/or 1-5 mm from the row 46 of bristles 340, including all ranges and values therein.

According to one embodiment, the sidewall 342 includes flexible and/or elastomeric. Examples of a flexible and/or elastomeric material include, but are not limited to, rubber, silicone, and/or the like. The sidewall 342 may include a combination of a flexible material and fabric. The combination of a flexible material and fabric may reduce wear of the sidewall 342, thereby increasing the lifespan of the sidewall 342. The rubber may include natural and/or synthetic, and may be either a thermoplastic and/or thermosetting plastic. The rubber and/or silicone may be combined with polyester fabric. In one embodiment, sidewall 342 may include cast rubber and fabric (e.g., polyester fabric). The cast rubber may include natural rubber cast with a polyester fabric. Alternatively (or in addition), the cast rubber may include a polyurethane (such as, but not limited to, PU 45 Shore A) and cast with a polyester fabric.

The agitator 122, 124 (e.g., the bristles 340) should be aligned within the agitator chamber 20 such that the bristles 340 are able to contact the surface to be cleaned. The bristles 340 should be stiff enough in the direction of rotation to engage the surface to be cleaned (e.g., but not limited to, carpet fibers) without undesirable bending (e.g., stiff enough to agitate debris from the carpet), yet flexible enough to allow side-to-side bending. Both the size (e.g., height Hs) and location of the sidewalls 342 relative to the row of bristles 340 may be configured to generally prevent and/or reduce hair from becoming entangled around the base or bottom of the bristles 340. The bristles 340 may be sized so that when used on a hard floor, it is clear of the floor in use. However, when the surface cleaning apparatus 10 is on carpet, the wheels 16 will sink in and the bristles 340 will penetrate the carpet. The length of bristles 340 may be chosen so that it is always in contact with the floor, regardless of floor surface. Additional details of the agitator 122, 124 (such as, but not limited to, the bristles 340 and sidewall 342) are described in U.S. Patent Application Ser. No. 62/385,572 filed Sep. 9, 2016, which is fully incorporated herein by reference.

Figure 4:
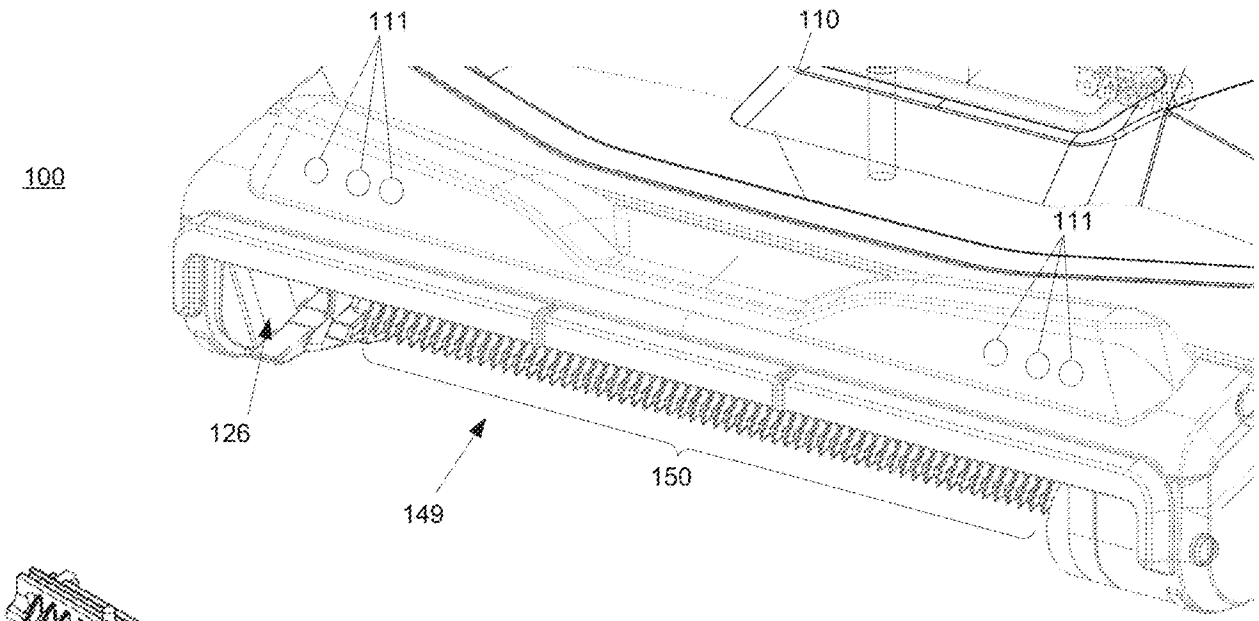
FIG. 4 is a side perspective view of the front region of the surface cleaning head of FIG. 1 without the leading roller and illustrating the combing unit.
Figure 5:
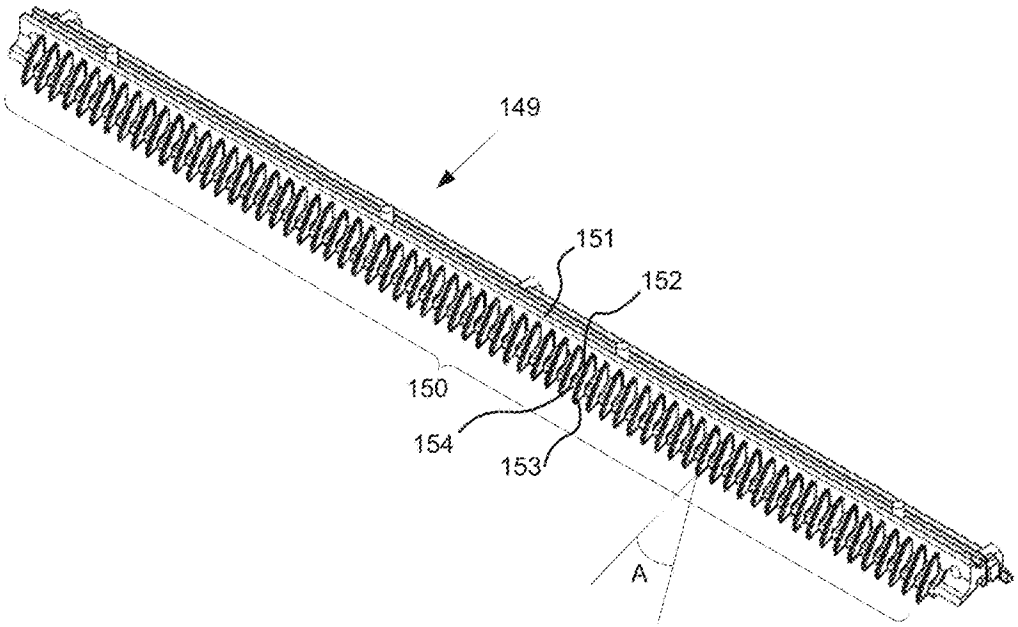
FIG. 5 is an enlarged perspective view of one embodiment of a combing unit.

The surface cleaning head 100 may also optionally include one or more combing units/debriders each having a series of combing protrusions (also referred to as debriding protrusions) configured to contact one or more of the agitators (e.g., brush roll 122 and/or the leading roller 124). One example of the combing unit/debrider 149 as shown in greater detail in FIGS. 4-5. The combing protrusions 150 may be configured to remove debris (such as, but not limited to, hair, string, and the like) that may be wrapped around and/or entrapped/entrained in/on the brush roll 122 and/or the leading roller 124 as the surface cleaning head 100 is being used (e.g., without the user having to manually remove the debris from the brush roll 122 and/or the leading roller 124). According to one embodiment, the combing protrusions 150 may contact only the brush roll 122 or only the leading roller 124.

The combing protrusions 150 may include a plurality of spaced teeth/ribs 152 with angled edges 153 extending into contact with a surface of the brush roll 122 and/or the leading roller 124. The spaced ribs 152 extend from a back support 151 with base portions 154 located therebetween to reinforce the spaced ribs 152. Although the illustrated embodiment shows the combing unit 149 with teeth 152 extending from a single back support 151, the combing unit 149 may also include multiple back supports 151, each with one or more include teeth 152. The angled edges 153 of the spaced ribs 152 may be arranged at an angle A that is in the range of 15-20 degrees, for example, 20-25 degrees, such as 23.5 degrees. This example structure of the combing protrusions 150 may allow for increased strength and reduced frictional loses since less points may contact the brush roll 122 and/or the leading roller 124. Other shapes and configurations for the combing protrusions 150 are also within the scope of the present disclosure.

The combing teeth 152 may have angled leading edges 153 that are not aligned with a rotation center of the agitator(s) 122, 124. The angled leading edges 153 are the edges that an incoming portion of the rotating agitator(s) 122, 124 hits first and are directed toward or into a direction of rotation of the agitator(s) 122, 124. More specifically, the leading edge 153 of a combing tooth 152 forms an acute angle $\alpha$ relative to a line extending from an intersection point where the leading edge 153 intersects with an outer surface of the agitator(s) 122, 124 to the rotation center. In some embodiments, the angle is in a range of 5° to 50° and more specifically in a range of 20° to 30° and even more specifically about 24° to 25°.

In some embodiments, the combing teeth 152 are positioned as close as possible to the bottom contact point of the agitator(s) 122, 124 but high enough to prevent being caught on a surface being cleaned (e.g., a carpet). The combing teeth 152, for example, may be positioned just above the lowest structure on the housing 110 of the cleaning apparatus 100. Positioning the combing teeth 152 closer to the bottom contact point of the agitator(s) 122, 124 allows debris to be intercepted and removed as soon as possible, thereby improving debris removal.

Again, it should be appreciated that the combing unit 149 may have other orientations and positions relative to the agitator(s) 122, 124 (e.g., above the rotation center). In a robotic vacuum cleaner, for example, the combing unit 149 may be positioned higher to prevent the combing teeth 152 from interfering with the debris being deposited into a dust bin.

The combing teeth 152 may extend into the agitator(s) 122, 124 to a depth in a range of 0% to 50% of the cleaning roller radius for a soft roller and 0% to 30% of the cleaning roller radius for a tufted brush roll. In one embodiment, the cleaning roller 124 is a soft roller (e.g., nylon bristles with a diameter less than or equal to 0.15 mm and a length greater than 3 mm) and the combing teeth 152 extend into the soft cleaning roller 124 in a range of 15% to 35%. For example, one or more of the combing teeth 152 may be configured to contact the bristles 340 (FIG. 3) or flexible strips 342.

Figure 6A:
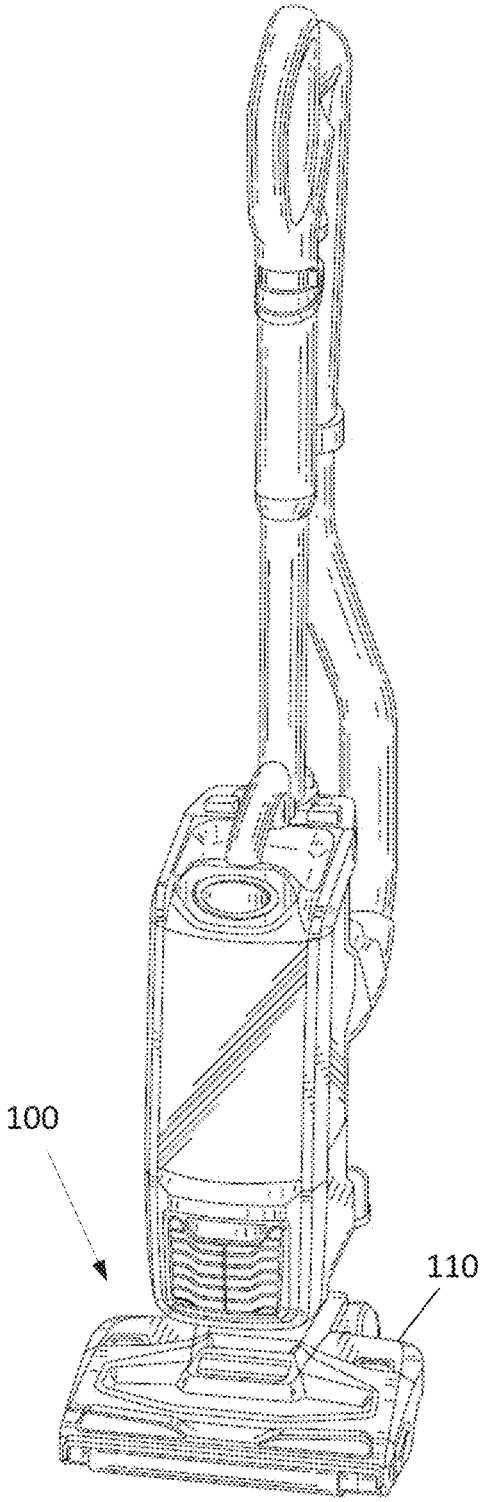
FIG. 6A is a perspective front view of an upright vacuum cleaner including the combing unit and isolator.
Figure 6B:
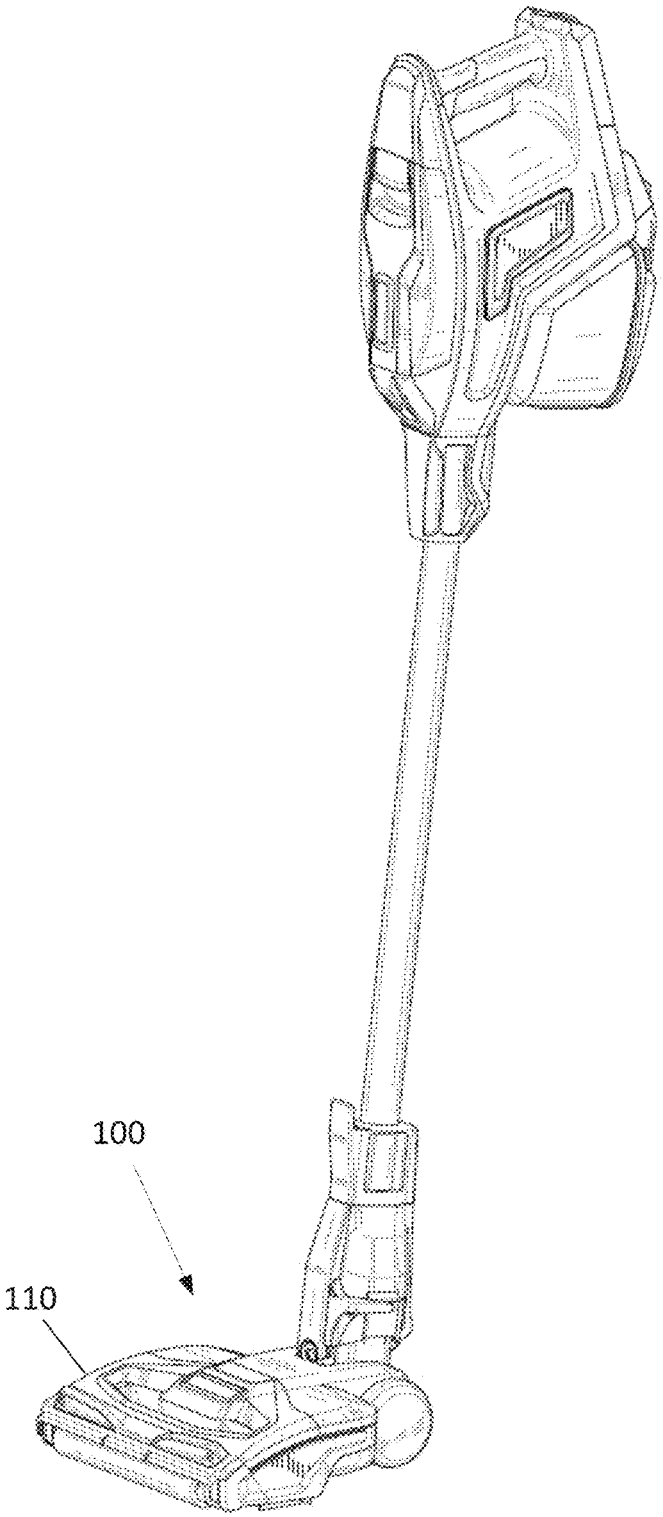
FIG. 6B is a perspective front view of a stick type vacuum cleaner including the combing unit and isolator.
Figure 7:
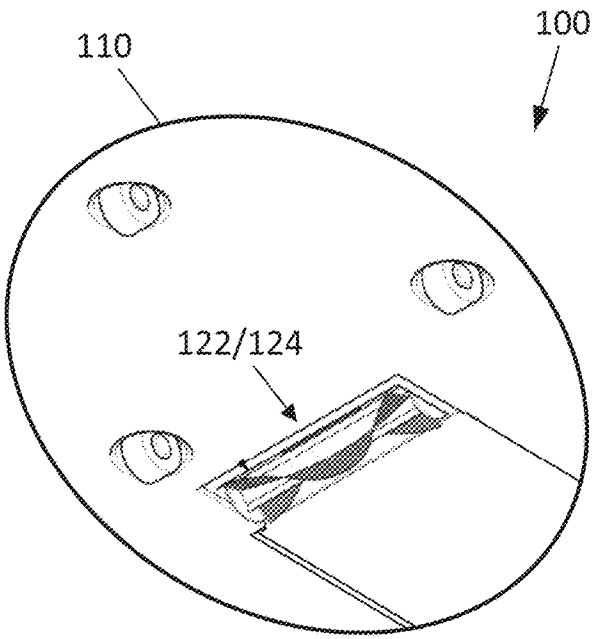
FIG. 7 is a perspective bottom view of a robot vacuum cleaner including the combing unit and isolator.

As noted herein, the phrase "surface cleaning head" refers to a device configured to contact a surface for cleaning the surface by use of suction air flow, agitation, or a combination thereof. A surface cleaning head 100 consistent with one or more aspects of the present disclosure may be used in different types of vacuum cleaners and/or cleaning apparatus including, without limitation, an "all in the head" type vacuum, upright vacuum cleaners, canister vacuum cleaners, stick vacuum cleaners, robotic vacuum cleaners and central vacuum systems, and may be used in sweepers (e.g., low or no suction), for example, as generally illustrated in FIGS. 6-7. An example of the combing unit used in a robotic vacuum cleaner is disclosed in greater detail in U.S. Provisional Application No. 62/469,853, filed Mar. 10, 2017, which is fully incorporated herein by reference.

One or more aspects of the present disclosure also feature systems and methods for managing debris (hereinafter referred to as hair for convenience) at the ends of an agitator (e.g., but not limited to, brush roll 122 and/or leading roller 124). The systems and methods for managing hair at the ends of an agitator may be used in combination with any of the agitators described herein (e.g., but not limited to, one or more agitators including bristles 340 and/or sidewall 342) and/or in combination with one or more combing units 149.

Figure 8:
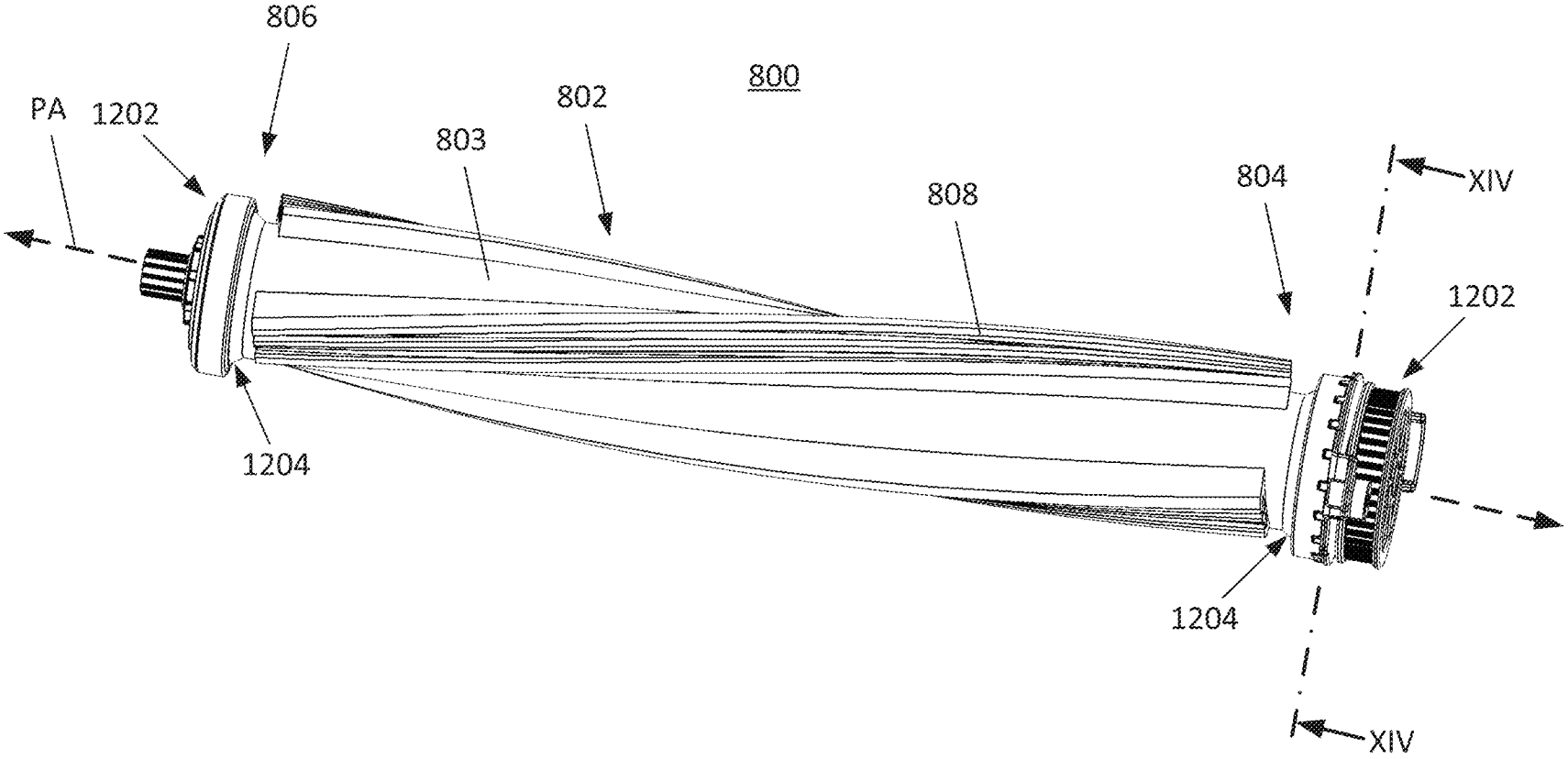
FIG. 8 is a side perspective view of one example of an agitator assembly, consistent with the present disclosure.

Turning now to FIG. 8, a non-limiting example of an agitator assembly 800 is generally illustrated. Again, it should be appreciated that the systems and methods for managing hair at the ends of an agitator as described herein may be used with any agitator. The agitator assembly 800 generally includes an agitator 802 as well as a first and a second end cap assembly 804, 806. The agitator 802 may include an elongated agitator body 803 having a generally cylindrical shape that extends along and is configured to rotate about a pivot axis PA as described herein. The agitator 802 may include one or more cleaning features 808 such as, but not limited to, bristles, piles, and/or sidewalls as generally described herein (e.g., but not limited to, one or more rows of bristles, piles, and/or flexible sidewalls as described herein).

Figure 9:
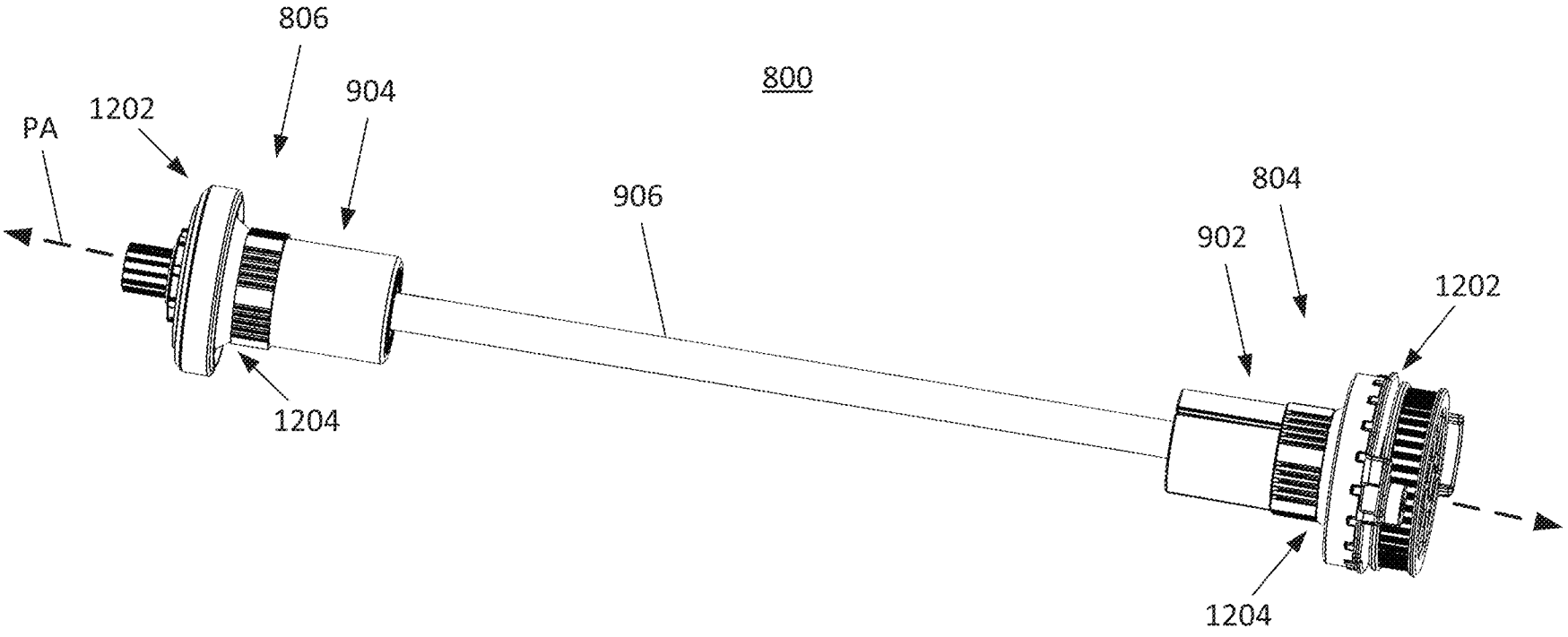
FIG. 9 shows the agitator assembly FIG. 8 without the agitator body.

The first and second end cap assemblies 804, 806 are disposed at opposite ends of the agitator body 803. One or more of the end cap assemblies 804, 806 may be a driven end configured to be driven by one or more motors (not shown). With reference to FIG. 9, one example of the agitator assembly 800 without the agitator body 803 is shown. At least a portion of the end cap assemblies 804, 806 may be coupled (either permanently coupled, fixedly coupled, and/or rotatably coupled) to the agitator 802. For example, elongated portions 902, 904 of the end cap assemblies 804, 806 may be configured to be received in and coupled to a cavity formed in the agitator body 803. A shaft 906 may also be coupled (either permanently coupled, fixedly coupled, and/or rotatably coupled) to one or more of the end cap assemblies 804, 806. It should be appreciated, however, that the end cap assemblies 804, 806 may be coupled to the agitator body 803 and/or shaft 906 in any manner known to those skilled in the art.

Figure 10:
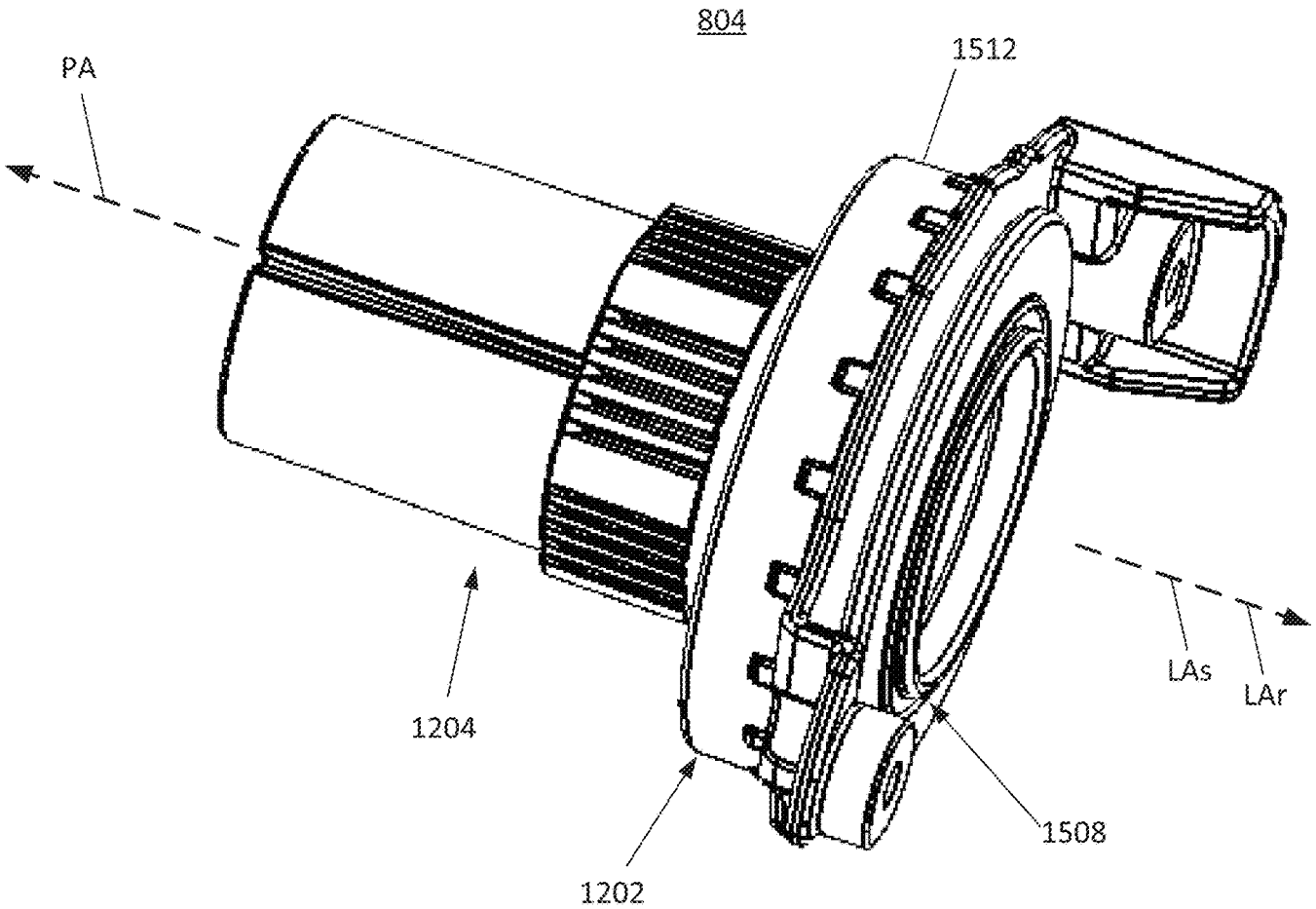
FIG. 10 shows a first perspective view of one example of an assembled end cap assembly including a system for managing hair, consistent with the present disclosure.
Figure 11:
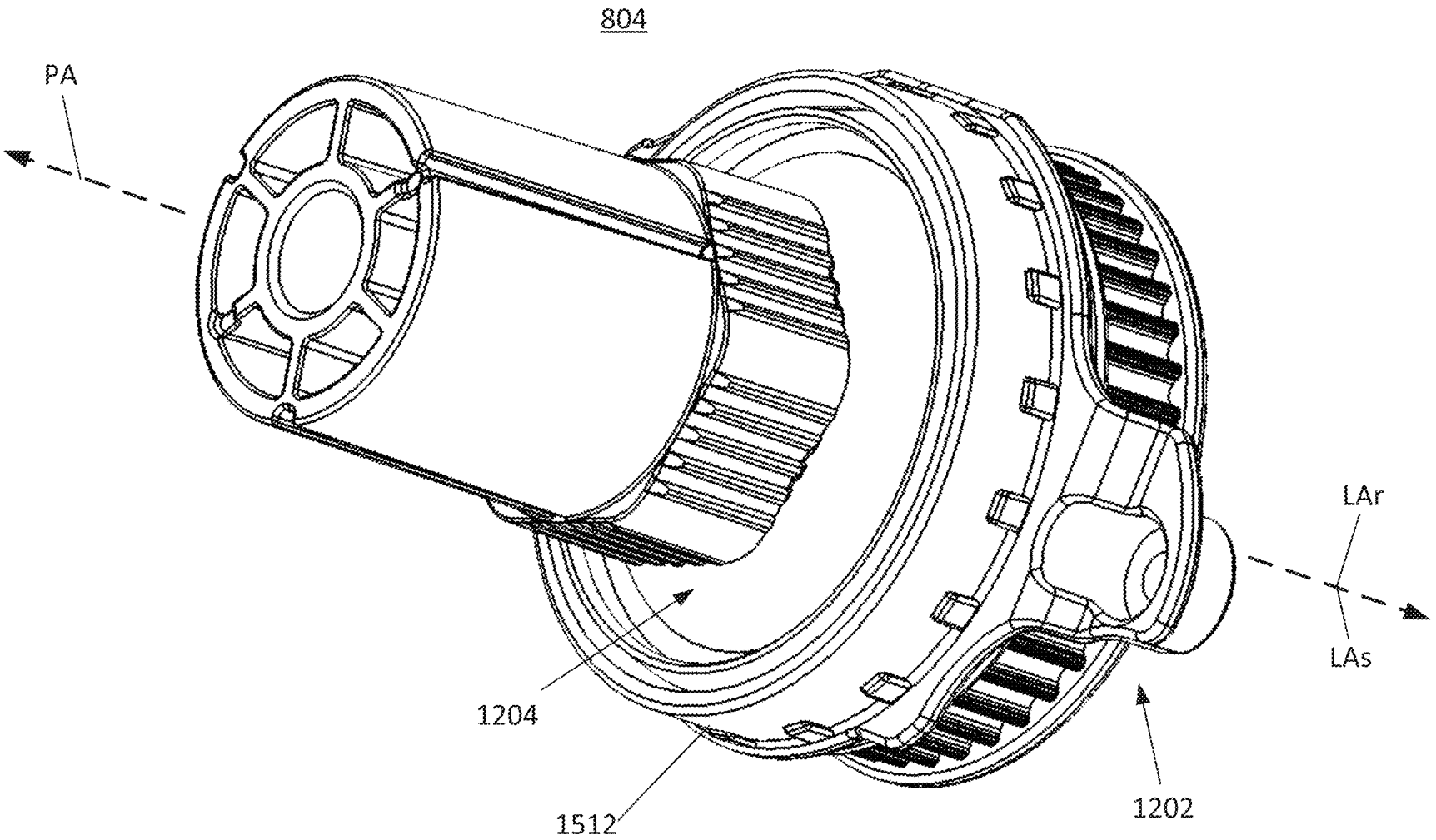
FIG. 11 shows a second perspective view of the assembled end cap assembly of FIG. 10.

As described herein, at least one of the end cap assemblies 804, 806 may include a system for managing hair. One example of an assembled end cap assembly including a system for managing hair is shown is generally illustrated in FIGS. 10 and 11. It should be appreciated that the system for managing hair may be included in a driven and/or a non-driven end cap assembly 804, 806. Thus, while the following description may refer to driven end cap assembly 804, it should be appreciated that the following description also applies to a non-driven end cap assembly 806 unless specifically stated otherwise. In addition, one component may be described as being closer to the housing 110 than another component. In this regard, the portion of the housing 110 to which these references are made is to the portion of the housing 110 to which the stationary end cap assembly 804 is coupled.

Figure 12:
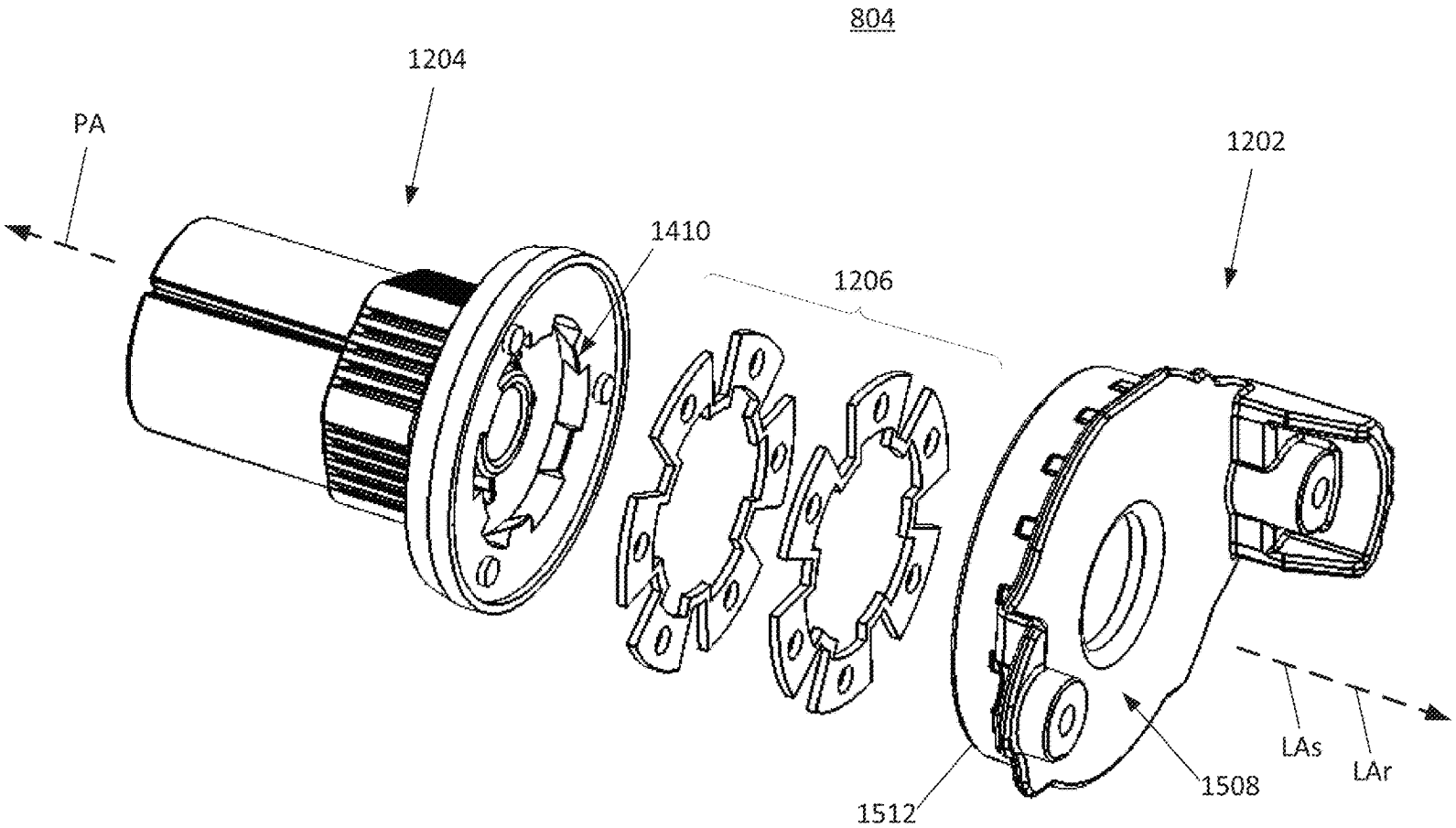
FIG. 12 shows a first exploded view of the assembled end cap assembly of FIG. 10.
Figure 13:
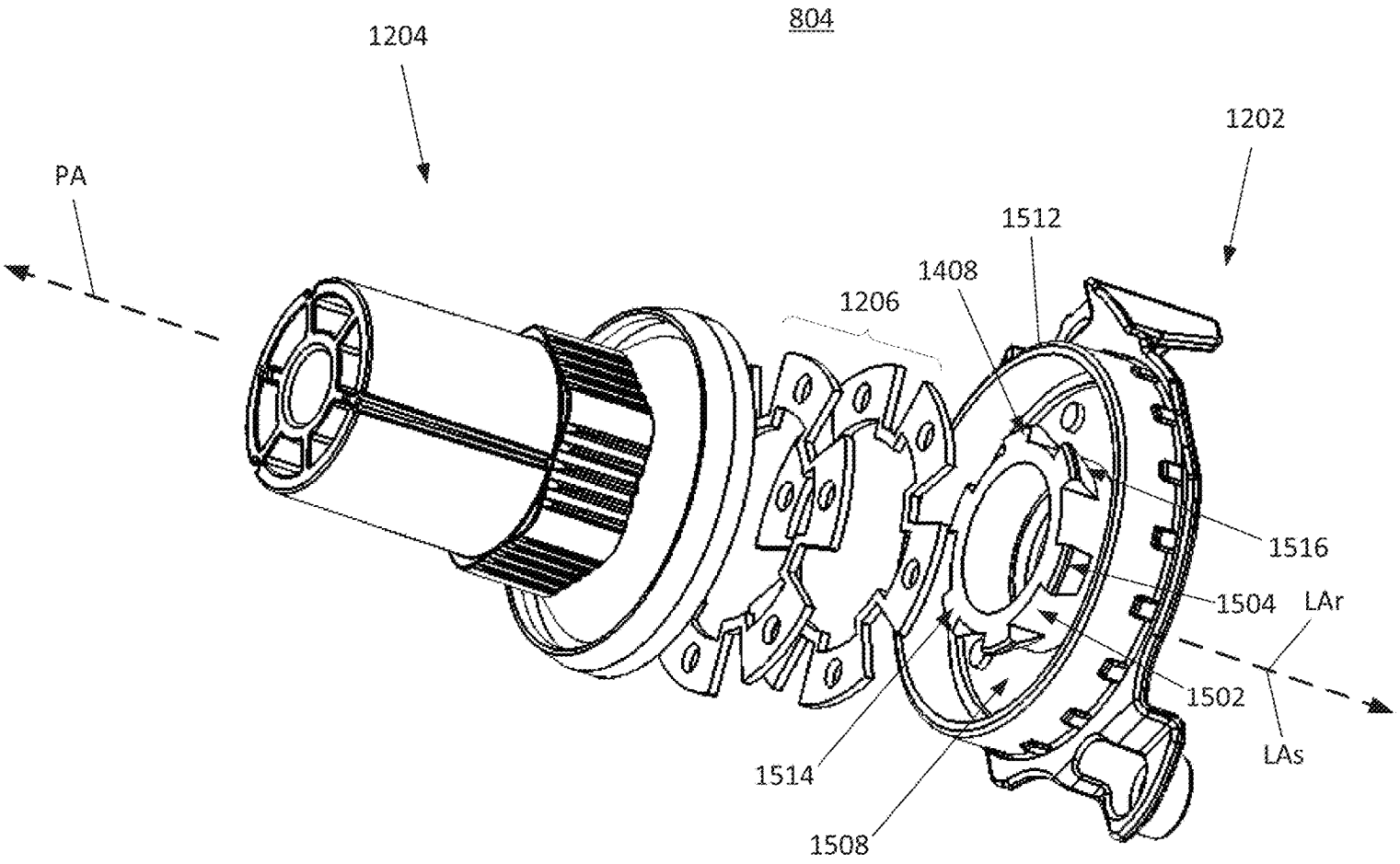
FIG. 13 shows a first exploded view of the assembled end cap assembly of FIG. 10.

Turning now to FIGS. 12 and 13, exploded views of the end cap assembly 804 of FIGS. 10 and 11 are generally illustrated. The end cap assembly 804 may include a stationary end cap 1202 and a rotating end cap 1204. The stationary end cap 1202 may be fixedly secured to the housing 110 (not shown) such that the stationary end cap 1202 does not move relative to the housing 110. The rotating end cap 1204 may be coupled to the agitator 802 such that rotation of the agitator 802 also results in rotation of the rotating end cap 1204 (e.g., but not limited to, the rotating end cap 1204 and the agitator 802 rotating in unison).

The end cap assembly 804 may also include one or more debris fragmentors 1206. One or more of the debris fragmentors 1206 may be coupled to and/or disposed between stationary end cap 1202 and a rotating end cap 1204. As explained herein, the debris fragmentors 1206 may include one or more blades, abrasion surfaces, or the like configured to break up hair into smaller fragments, e.g., by cutting and/or grinding.

Figure 14:
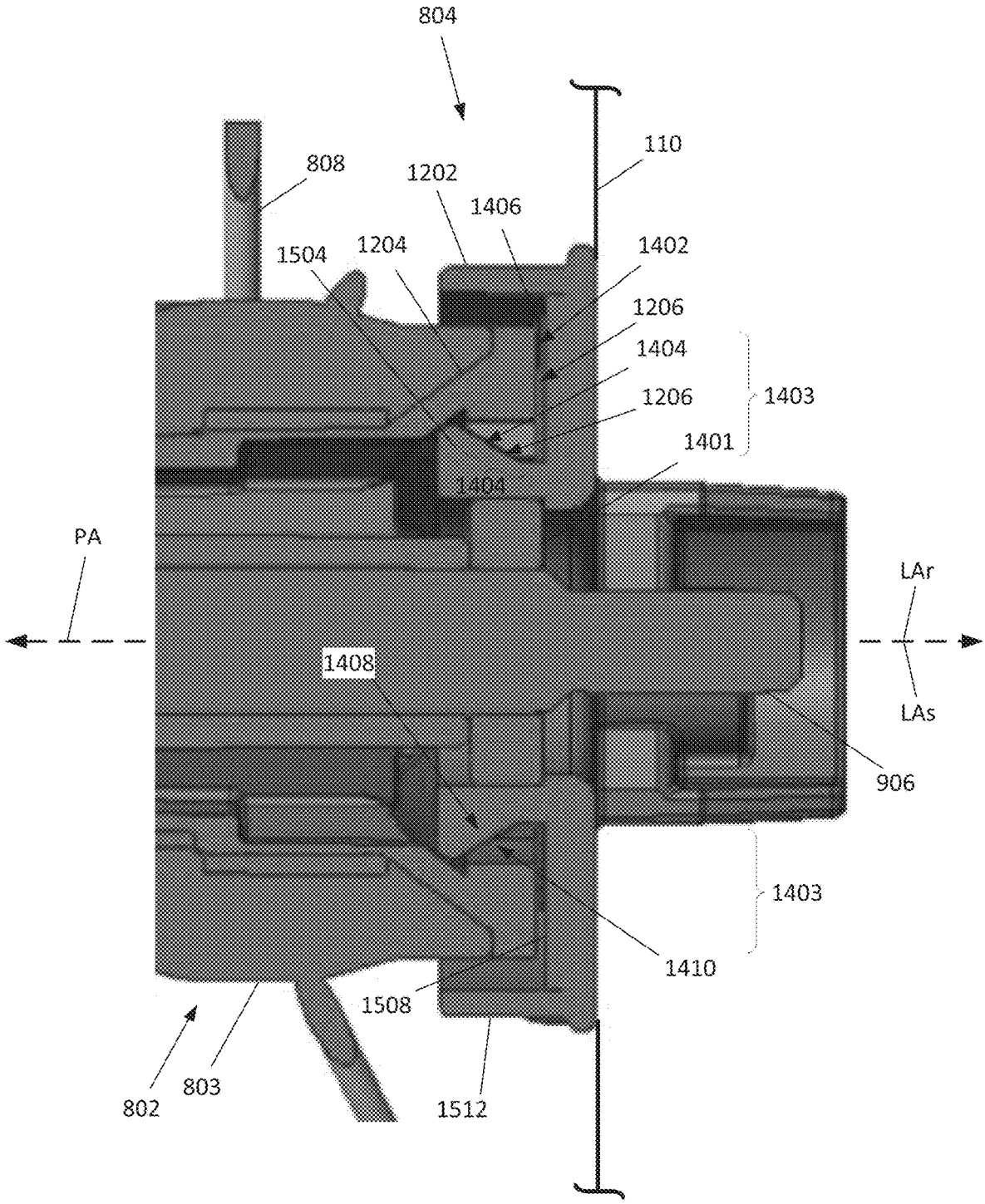
FIG. 14 shows a cross-sectional view of the assembled end cap assembly taken along lines XIV-XIV of FIG. 8.

With reference to FIG. 14, a cross-sectional view of the assembled end cap assembly 804 taken along lines XIV-XIV of FIG. 8 is generally illustrated. The stationary end cap 1202 may be fixedly secured to the housing 110 such that the stationary end cap 1202 does not move relative to the housing 110, and the rotating end cap 1204 may be coupled to the agitator 802 such that rotation of the agitator 802 also results in rotation of the rotating end cap 1204. In the illustrated embodiment, the rotating end cap 1204 rotates in unison with the agitator 802, though the present disclosure is not limited in this regard unless specifically claimed as such. The shaft 906 may be coupled to the agitator 802 and/or rotating end cap 1204 such that rotation of the agitator 802 also results in rotation of the shaft 906. One or more bearings 1401 may be disposed between the shaft 906 and the stationary end cap 1202.

The stationary end cap 1202 and the rotating end cap 1204 may be aligned with respect to each other to form one or more gaps therebetween 1402. The gap 1402 may extend radially between the stationary end cap 1202 and the rotating end cap 1204. As explained herein, the gap 1402 may include one or more portions, e.g., a first portion 1403 and optionally a second portion 1404. The first portion 1403 of the gap 1402 may include an entrance 1406 (e.g., a circumferential opening) which is exposed to the environment. The first portion 1403 may be coupled to the second portion 1404 of the gap 1402. It is generally understood that hair will tend to migrate to the lowest diameter region on the agitator assembly 800. As such, some hair will tend to migrate from the agitator body 803 and into the first portion 1403 of the gap 1402 since the first portion 1403 extends radially inward from the agitator body 803 as well as the stationary end cap 1202 and the rotating end cap 1204. As explained herein, hair which enters into the gap 1402 may be broken into smaller pieces by one or more of the debris fragmentors 1206.

According to one example, the end cap assembly 804 may be configured to precisely align the stationary end cap 1202 and the rotating end cap 1204, for example, in order to precisely define the first portion 1403 and/or second portion 1404 of the gap 1402. In the illustrated example, the stationary end cap 1202 and the rotating end cap 1204 include stationary alignment castellations 1408 and rotating alignment castellations 1410, respectively. The stationary and rotating alignment castellations 1408, 1410 are configured to engage each other and align the stationary end cap 1202 and the rotating end cap 1204 as the rotating end cap 1204 rotates relative to the stationary end cap 1202 as explained herein.

Figure 15:
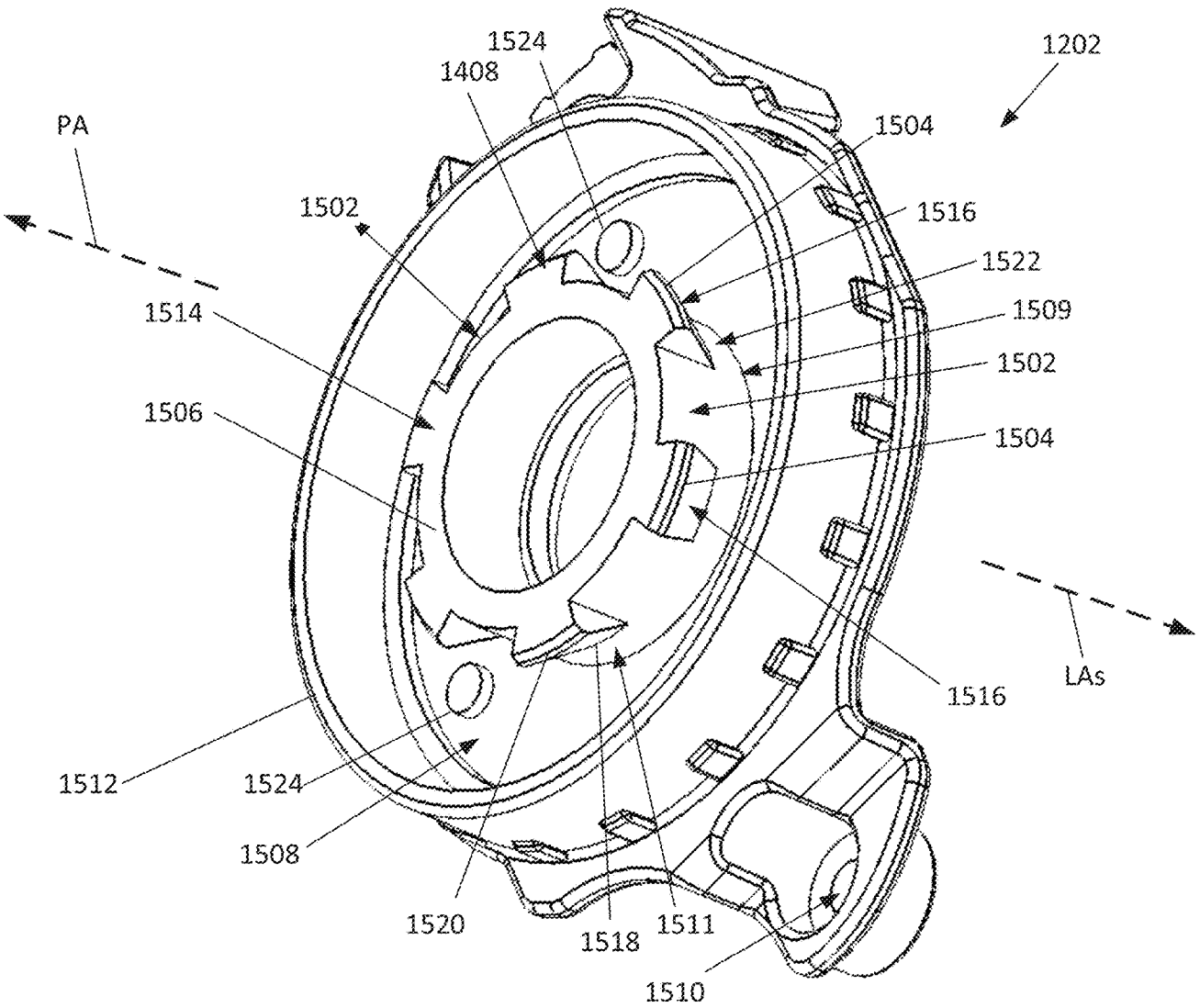
FIG. 15 shows a first perspective view of one example of a stationary end cap, consistent with the present disclosure.
Figure 16:
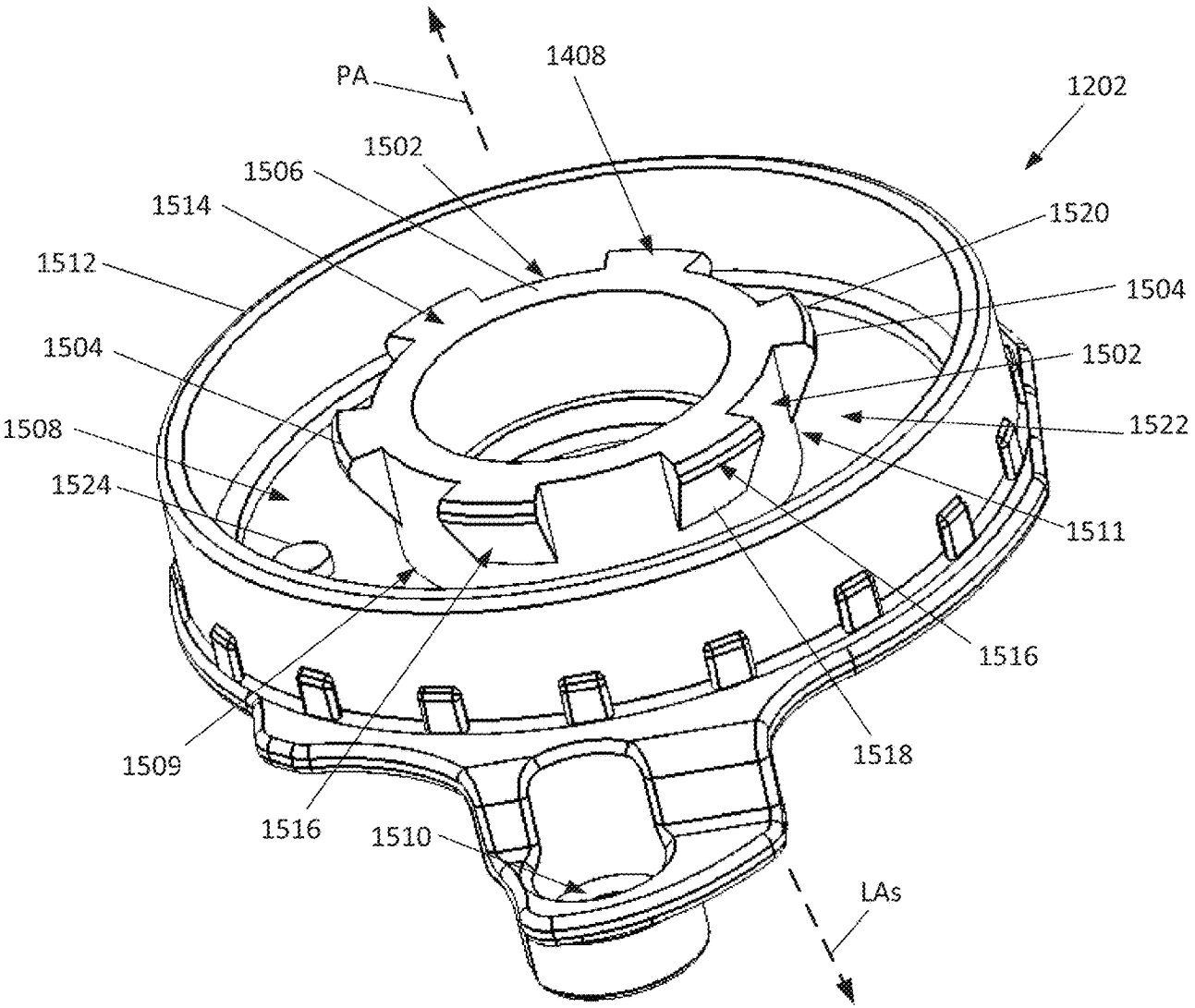
FIG. 16 shows a second perspective view of the stationary end cap assembly of FIG. 15.

Turning now to FIGS. 15-16, one example of the stationary alignment castellations 1408 is generally illustrated. The stationary alignment castellations 1408 may include one or more radially disposed notches 1502 and protrusions 1504. While aspects of the stationary alignment castellations 1408 may be described in the context of a plurality of radially disposed alternating notches 1502 and protrusions 1504, it should be appreciated that the stationary alignment castellations 1408 may include a single notch 1502 and/or a single protrusion 1504.

The plurality of notches 1502 are configured to receive a plurality of protrusions associated with the rotating alignment castellations 1410, and the plurality of protrusions 1504 are configured to be advanced through a plurality of notches associated with the rotating alignment castellations 1410. The notches 1502 and protrusions 1504 may be formed on a central hub 1506. The central hub 1506 may extend along the longitudinal axis LAs of the stationary end cap 1202 (and may also extend parallel and/or colinear with the pivot axis PA of the agitator 802). In the illustrated example, the central hub 1506 may be configured to receive a portion of the agitator shaft 906 and/or bearing 1401 as generally illustrated in FIG. 14, though the present disclosure is not limited in this respect. The central hub 1506 may have a cross-section (e.g., diameter) that is smaller than the cross-section (e.g., diameter) of the agitator 802.

Optionally, the central hub 1506 may extend along the longitudinal axis LAs of the stationary end cap 1202 from a generally upright section 1508. For example, the central hub 1506 may extend from a base 1509 disposed proximate to the generally upright section 1508. The upright section 1508 may extend radially in a plane that is transverse to the longitudinal axis LAs of the stationary end cap 1202 and to the pivot axis PA such that the upright section 1508 generally extends in a vertical plane when in use. The upright section 1508 may include mounting features 1510 (e.g., one or more apertures, slots, or the like) for securing the stationary end cap 1204 to the housing 110 (e.g., using a bolt, screw, or the like, not shown). The upright section 1508 may also optionally include a lip 1512 which extends radially towards the rotating end cap 1204 as generally illustrated in FIG. 14. For example, the lip 1512 may extend over at least a portion of the rotating end cap 1204 when assembled. The upright section 1508 may have a cross-section (e.g., in the radial and/or vertical plane) that is larger than the cross-section (e.g., diameter) of the central hub 1506.

As noted above, the plurality of notches 1502 and protrusions 1504 may be formed on the central hub 1506. With reference to FIGS. 14-16, the plurality of notches 1502 are formed between the plurality of plurality of protrusions 1504 and are configured to receive a plurality of protrusions associated with the rotating alignment castellations 1410. Each protrusion 1504 may extend radially outward from the central hub 1506 and is adjacent to two notches 1502. One or more of the protrusions 1504 may include an agitator facing surface or face 1514 which and a housing facing surface or face 1516. The agitator facing surface 1514 generally faces towards the agitator 802 (e.g., towards the opposite end of the agitator 802), and may optionally be substantially flush with the outer surface of the hub 1506. The housing facing surface 1516 may generally face away from the agitator 802 (e.g., towards the end of the housing 110 proximate to the agitator 802 to which the stationary end cap 1202 is coupled).

The housing facing surface 1516 may include a beveled or sloped surface as generally illustrated. For example, the housing facing surface 1516 may taper radially from a base 1518 to a tip 1520. The base 1518 may be disposed proximate to the central hub 1506 while the tip 1520 is disposed proximate to the agitator facing surface 1514. The base 1518 of the housing facing surface 1516 may therefore extend radially outward from the longitudinal axis LAs (and from the pivot axis PA) a smaller distance than the tip 1520. Optionally, the base 1518 of the housing facing surface 1516 is spaced apart a distance 1511 from the base 1509 of the central hub 1506. In the illustrated example, the base 1518 is disposed closer to the housing 110 than the tip 1520 such that an extension of the housing facing surfaces 1516 of the plurality of protrusions 1504 would intersect at a point away from the agitator 802; however, it should be appreciated that the tip 1520 may be disposed closer to the housing 110 than the base 1518 such that an extension of the housing facing surfaces 1516 would intersect at a point towards the agitator 802. While the housing facing surface 1516 is shown having a generally linear or constant taper, the housing facing surface 1516 may have a non-linear taper.

The central hub 1506 may include a track 1522 configured to allow the protrusions associated with the rotating alignment castellations 1410 to rotate about the central hub 1506 as the agitator 802 and the rotating end cap 1204 rotate about the pivot axis PA. The track 1522 may extend radially around the central hub 1506 and may be formed between the housing facing surface 1516 and the housing 110 (e.g., between the housing facing surface 1516 and the upright section 1508 of the stationary end cap 1202). Optionally, the track 1522 may also extend in the space 1511 between the base 1518 of the housing facing surface 1516 and the base 1509 of the hub 1506. The housing facing surface 1516 may have a curvature in the radial direction, for example, in the form of a sector corresponding to a fractional part of a circle formed by the rotation of the protrusions associated with the rotating alignment castellations 1410 within the track 1522.

Figure 17:
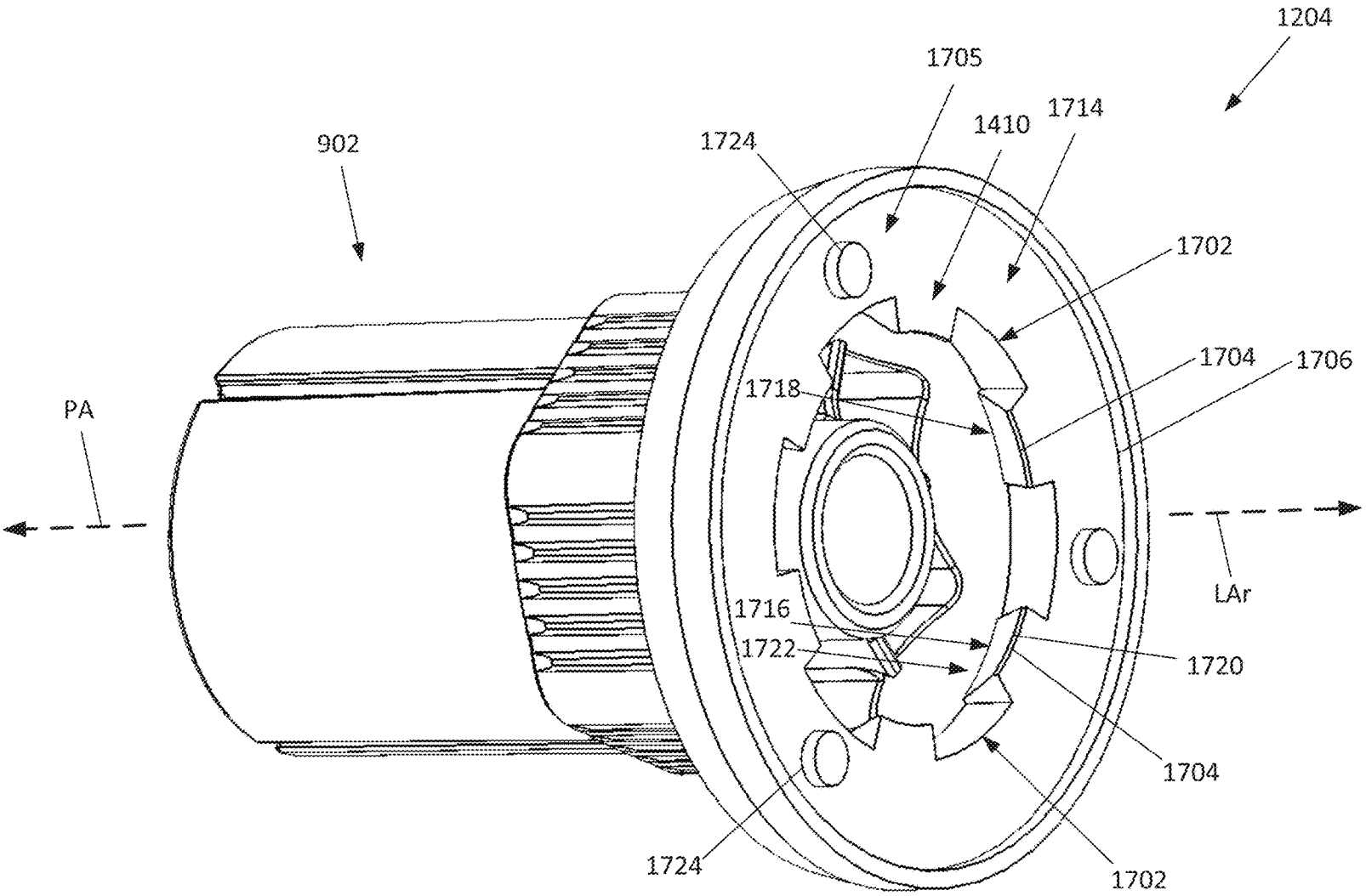
FIG. 17 shows a first perspective view of one example of a rotating end cap, consistent with the present disclosure.
Figure 18:
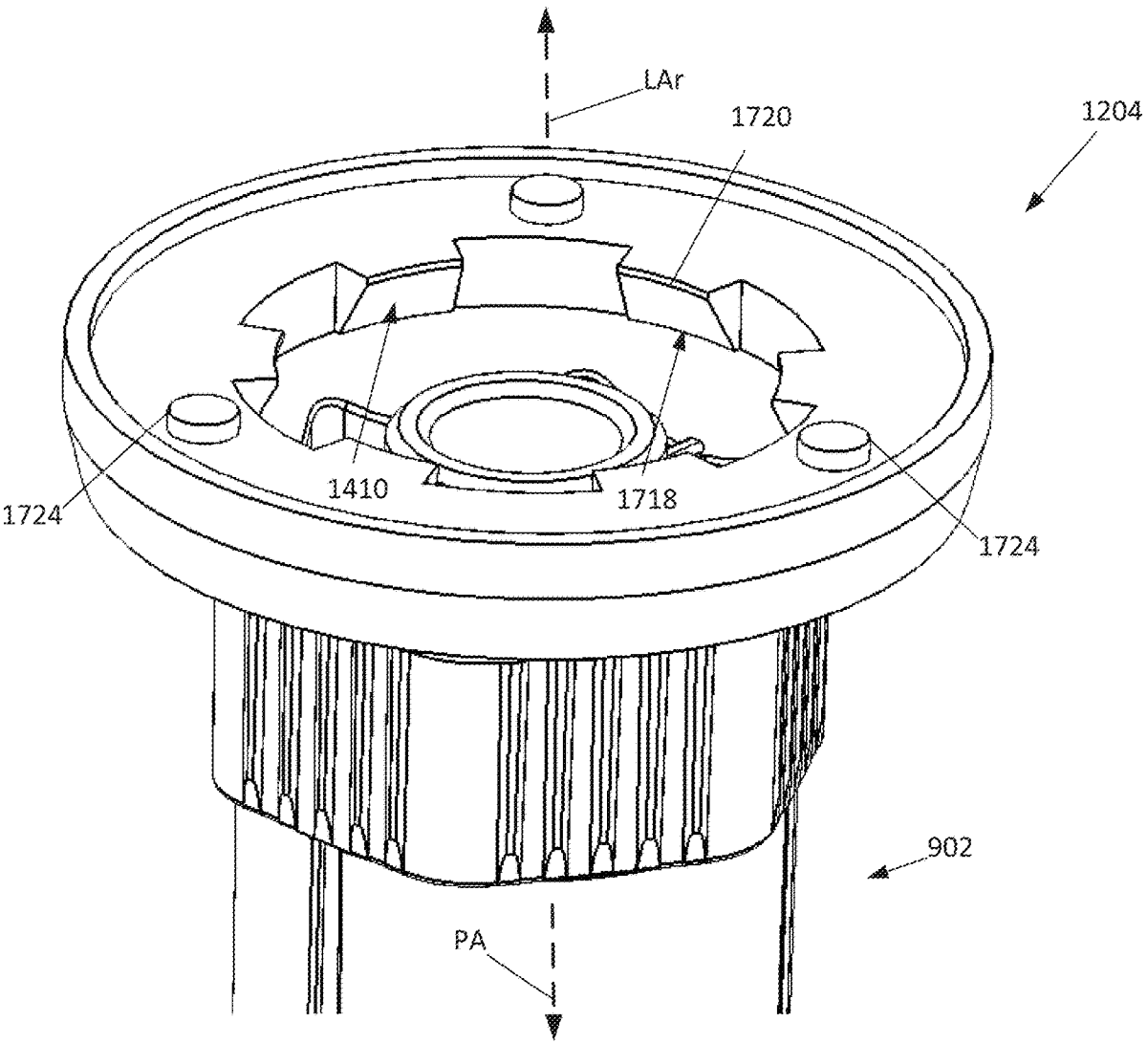
FIG. 18 shows a second perspective view of the rotating end cap assembly of FIG. 17.

Turning now to FIGS. 17-18, one example of the rotating alignment castellations 1410 is generally illustrated. The rotating alignment castellations 1410 may include one or more radially disposed notches 1702 and protrusions 1704. While aspects of the rotating alignment castellations 1410 may be described in the context of a plurality of radially disposed alternating notches 1702 and protrusions 1704, it should be appreciated that the rotating alignment castellations 1410 may include a single notch 1702 and/or a single protrusion 1704.

The plurality of notches 1702 are configured to receive the plurality of protrusions 1504 of the stationary alignment castellations 1408 and the plurality of protrusions 1704 are configured to be advanced through the plurality of notches 1502 of the stationary alignment castellations 1408. The plurality of notches 1702 may have a size and shape substantially corresponding to the inverse of the size and shape of the plurality of protrusions 1504 of the stationary alignment castellations 1408. Similarly, the plurality of protrusions 1704 may have a size and shape substantially corresponding to the inverse of the size and shape of the plurality of notches 1502 of the stationary alignment castellations 1408.

The notches 1702 and protrusions 1704 may be formed on a central disc 1706. The central disc 1706 may extend radially inward relative to and generally transverse to the longitudinal axis LAr of the rotating end cap 1204 (and may also extend radially inward relative to and generally transverse to the pivot axis PA of the agitator 802). In the illustrated example, the central disc 1706 may be configured to receive a portion of the agitator shaft 906 as generally illustrated in FIG. 14, though the present disclosure is not limited in this respect. The central disc 1706 may have a cross-section (e.g., diameter) that is larger than the cross-section (e.g., diameter) of the central hub 1506 (including the protrusions 1504).

As noted above, the plurality of notches 1702 and protrusions 1704 may be formed on the central disc 1706. With reference to FIGS. 14 and 17-18, the plurality of notches 1702 are formed between the plurality of plurality of protrusions 1704 and are configured to receive the plurality of protrusions 1504 of the stationary alignment castellations 1408. Each protrusion 1704 may extend radially inward from the central disc 1706 and is adjacent to two notches 1702. One or more of the protrusions 1704 may include a housing facing surface or face 1714 and an agitator facing surface or face 1716. The housing facing surface 1714 generally faces towards the housing 110 and/or generally towards the stationary end cap 1202 (e.g., generally away from the agitator 802). At least a portion of the housing facing surface 1714 is substantially parallel with the outer surface 1705 of the central disc 1706 that faces the stationary end cap 1202.

The agitator facing surface 1716 may generally face towards the agitator 802 (e.g., towards a central region of the agitator 802 and generally away from the housing 110). The agitator facing surface 1716 may include a beveled or sloped surface as generally illustrated. For example, the agitator facing surface 1716 may taper radially from a base 1718 to a tip 1720. The base 1718 may be disposed proximate to the central disc 1706 while the tip 1720 is disposed proximate to the housing facing surface 1714. The base 1718 of the agitator facing surface 1716 may therefore extend radially outward from the longitudinal axis LAr (and from the pivot axis PA) a smaller distance than the tip 1720. In the illustrated example, the base 1718 is disposed further from the housing 110 than the tip 1520 such that an extension of the agitator facing surfaces 1716 of the plurality of protrusions 1704 would intersect at a point away from the agitator 802; however, it should be appreciated that the tip 1720 may be disposed further from the housing 110 than the base 1718 such that an extension of the agitator facing surfaces 1716 would intersect at a point towards the agitator 802. While the agitator facing surface 1716 is shown having a generally linear or constant taper, the agitator facing surface 1716 may have a non-linear taper. According to one aspect, the contour/shape of the agitator facing surface 1716 may be the inverse of the contour/shape of the housing facing surface 1516.

The central disc 1706 may include a track 1722 configured to allow the protrusions 1504 associated with the stationary alignment castellations 1408 to pass as the rotating alignment castellations 1410 rotate relative to the central hub 1506 as the agitator 802 and the rotating end cap 1204 rotate about the pivot axis PA. The track 1722 may extend radially around the central disc 1706 and may be formed between the agitator facing surface 1716 and an inner surface of the rotating end cap 1204. The agitator facing surface 1716 may have a curvature in the radial direction, for example, in the form of a sector corresponding to a fractional part of a circle formed by the rotation of the protrusions 1504 of the stationary alignment castellations 1408 within the track 1722.

The position and alignment of the rotating end cap 1204 relative to the stationary end cap 1202 may be set by aligning the rotating alignment castellations 1410 of the rotating end cap 1204 with respect to the stationary alignment castellations 1408 of the stationary end cap 1202. In particular, the notches 1702 of the rotating alignment castellations 1410 may be aligned to receive the protrusions 1504 of the stationary alignment castellations 1408 and the notches 1502 of the stationary alignment castellations 1408 may be aligned to receive the protrusions 1704 of the rotating alignment castellations 1410. Once aligned, the protrusions 1504 of the stationary alignment castellations 1408 and the protrusions 1704 of the rotating alignment castellations 1410 may be advanced through the plurality of notches 1502, 1702. The protrusions 1704 of the rotating alignment castellations 1410 may thereafter rotate within the track 1522 of the stationary end cap 1202 and the protrusions 1504 of the stationary alignment castellations 1408 may pass through the track 1722 of the rotating end cap 1204 as the rotating end cap 1204 rotates along with the agitator 802 relative to the stationary end cap 1202.

The housing facing surface 1516 of the protrusions 1504 associated with the stationary alignment castellations 1408 and the agitator facing surface 1716 associated with the rotating alignment castellations 1410 may have corresponding inverse shapes/profiles such that the protrusions 1704 associated with the rotating alignment castellations 1410 may pass by the protrusions 1504 associated with the stationary alignment castellations 1408 as the rotating end cap 1204 rotates relative to the stationary end cap 1202. The protrusions 1704 associated with the rotating alignment castellations 1410 are therefore constrained to move generally only within the track 1522 of the stationary end cap 1202 as the rotating end cap 1204 rotates about the pivot axis PA, therefore ensuring precise alignment of the rotating end cap 1204 relative to the stationary end cap 1202.

The precise alignment of the rotating end cap 1204 relative to the stationary end cap 1202 also ensures that the gap 1402 between the stationary end cap 1202 and the rotating end cap 1204 is precisely defined such that hair which enters therein may be broken into smaller pieces by the debris fragmentors 1206. The debris fragmentors 1206 may be located on any surface and/or anywhere in the gap 1402. For example, one or more debris fragmentors 1206 may be located in the first portion 1403 and/or in the second portion 1404 of the gap 1402. The first portion 1403 of the gap 1402 may be defined by the surface of the generally upright section 1508 and the outer surface 1705 of the central disc 1706, while the second portion 1404 of the gap 1402 may be defined by the housing facing surface 1516 and the agitator facing surface 1716. One or more debris fragmentors 1206 may therefore be located on any surface of the stationary end cap 1202 within the first portion 1403 and/or in the second portion 1404 of the gap 1402 (e.g., but not limited to, a surface of the generally upright section 1508, the housing facing surface 1516, the surface of the track 1522, and/or the surface of the central hub 1506 corresponding to the distance 1511 in FIGS. 15-16). Alternatively (or in addition), one or more debris fragmentors 1206 may be located on any surface of the rotating end cap 1204 within the first portion 1403 and/or in the second portion 1404 of the gap 1402 (e.g., but not limited to, the outer surface 1705 of the central disc 1706 and/or the agitator facing surface 1716).

As noted herein, hair will tend to migrate to the lowest diameter region on the agitator assembly 800. In the illustrated embodiment (best seen in FIG. 14), the sloped surfaces of the housing facing surface 1516 and the agitator facing surface 1716 in the second portion 1404 of the gap 1402 extend radially outwardly from the first portion 1403 of the gap 1402. Because the diameter of the sloped surfaces of the housing facing surface 1516 and the agitator facing surface 1716 increases the further you move away from the first portion 1403, these sloped surfaces may generally prevent any hair which migrates to the bottom of the first portion 1403 of the gap 1402 from leaving the gap 1402 and damaging the bearings 1401. As a result, hair will tend to collect at the bottom of the first portion 1403 of the gap 1402 (i.e., away from the entrance 1406) since the first portion 1403 has the smallest diameter on the agitator assembly 800.

Figure 19:
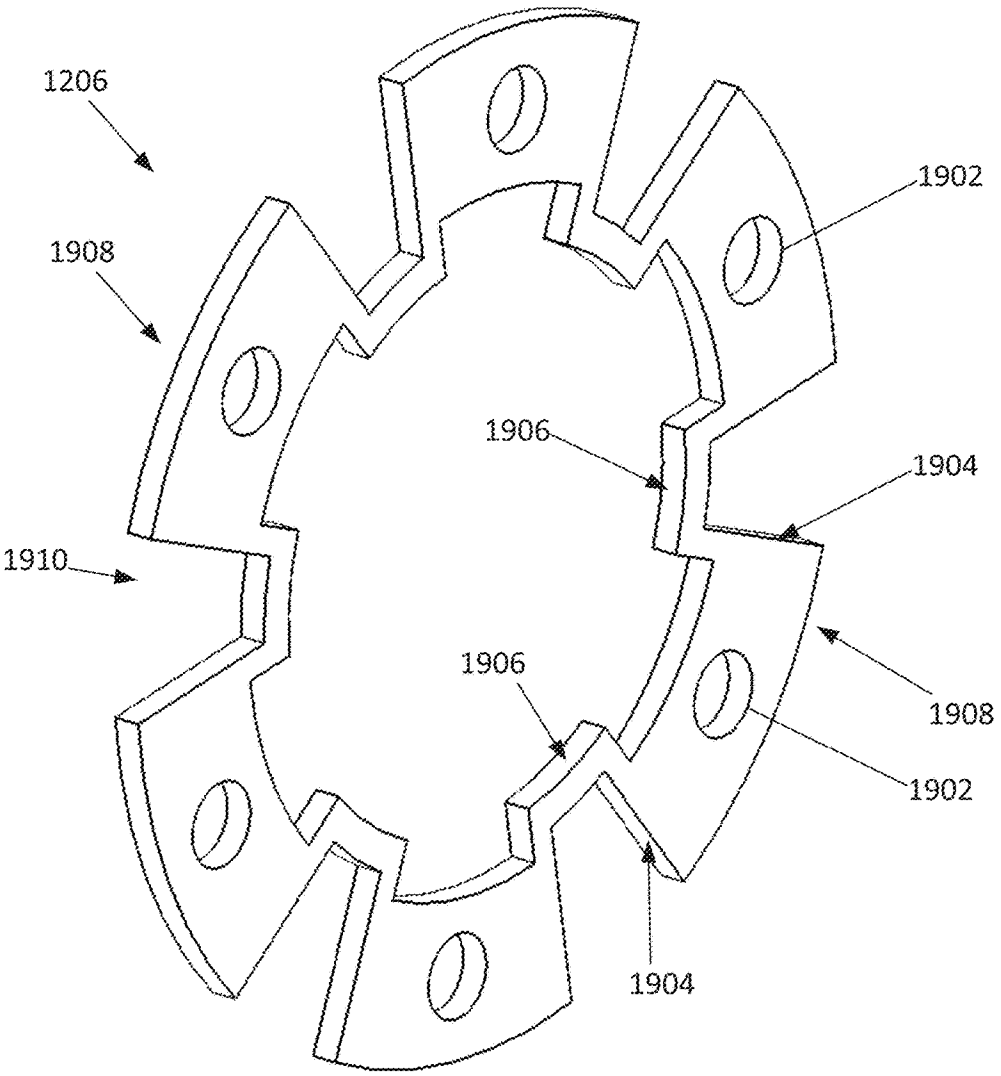
FIG. 19 is a perspective view of one embodiment of a fragmentor.

Turning now to FIG. 19, one example of a debris fragmentor 1206. The debris fragmentor 1206 may include one or more blades disposed within the first portion 1403 of the gap 1402. For example, a debris fragmentor 1206 may be secured to the surface of the generally upright section 1508 and/or the outer surface 1705 of the central disc 1706. Rotation of the rotating end cap 1202 may cause hair within the gap 1402 to be cut into smaller pieces.

The debris fragmentor 1206 may include one or more apertures 1902 configured to align and/or secure the debris fragmentor 1206 to the surface of the generally upright section 1508 and/or the outer surface 1705 of the central disc 1706. For example, the apertures 1902 may be sized and shaped to receive protrusions 1524, 1724 on the surface of the generally upright section 1508 and/or the outer surface 1705 of the central disc 1706. Of course, the arrangement of the apertures 1902 and the protrusions 1524, 1724 may be reversed relative to the debris fragmentor 1206 and upright section 1508 and/or the outer surface 1705 of the central disc 1706. In addition, the debris fragmentor 1206 may be secured to the upright section 1508 and/or the outer surface 1705 of the central disc 1706 using any other method known to those skilled in the art such as, but not limited, adhesives, screws, bolts, welding, overmolding, or the like.

The debris fragmentor 1206 may include a plurality of radial cutting surfaces 1904 and/or a plurality of arcuate interior cutting surfaces 1906. The radial cutting surfaces 1904 may be configured to cut hair along the upright section 1508 and/or the outer surface 1705 of the central disc 1706. The radial cutting surfaces 1904 may be disposed along a plurality of protrusions 1908. The protrusions 1908 may substantially correspond to the size/shape of the housing facing surface 1516 and/or the agitator facing surface 1716 and may be separated by a plurality of notches 1910. For example, the protrusions 1908 may substantially correspond to the size/shape of the protrusions 1504, 1704. The notches 1910 may correspond to the to the size/shape of the notches 1502, 1702 of the alignment castellations 1408, 1410. The interior cutting surfaces 1906 may be configured to cut hair along the surface 1511 of the central hub 1506. To this end, the interior cutting surfaces 1906 may be in the form of a sector substantially corresponding to the curvature of the surface 1511 of the central hub 1506.

Of course, the debris fragmentor 1206 of FIG. 19 is only one example of a debris fragmentor 1206, and the present disclosure is not limited to this example unless specifically claimed as such. With reference to FIGS. 20-22, other examples of debris fragmentors 1206 are generally illustrated. For example, debris fragmentors 1206 may be disposed on only the generally upright section 1508 of the stationary end cap 1202 as generally illustrated in FIG. 20. One or more of the debris fragmentors 1206 may be configured to contact the housing facing surface 1714 and/or the outer surface 1705 of the central disc 1706. Alternatively (or in addition), one or more of the debris fragmentors 1206 may be configured to be spaced apart from the housing facing surface 1714 and/or the outer surface 1705 of the central disc 1706 a distance which is equal to or less than the diameter of hair (e.g., human hair, cat hair, and/or dog hair).

FIG. 21 generally illustrates an example of debris fragmentors 1206 disposed on only the housing facing surface 1714 and/or the outer surface 1705 of the central disc 1706. One or more of the debris fragmentors 1206 may be configured to contact the generally upright section 1508 of the stationary end cap 1202. Alternatively (or in addition), one or more of the debris fragmentors 1206 may be configured to be spaced apart from the generally upright section 1508 of the stationary end cap 1202 a distance which is equal to or less than the diameter of hair (e.g., human hair, cat hair, and/or dog hair).

FIG. 22 generally illustrates an example of debris fragmentors 1206 disposed on both the generally upright section 1508 of the stationary end cap 1202 as well as the housing facing surface 1714 and/or the outer surface 1705 of the central disc 1706. One or more of the debris fragmentors 1206 on the generally upright section 1508 may be configured to contact one or more of the debris fragmentors 1206 on the housing facing surface 1714 and/or the outer surface 1705 of the central disc 1706 as the rotating end cap 1204 rotates. Alternatively (or in addition), one or more of the debris fragmentors 1206 on the generally upright section 1508 may be configured to be spaced apart from one or more debris fragmentors 1206 on the housing facing surface 1714 and/or the outer surface 1705 of the central disc 1706 a distance which is equal to or less than the diameter of hair (e.g., human hair, cat hair, and/or dog hair).

Figure 23:
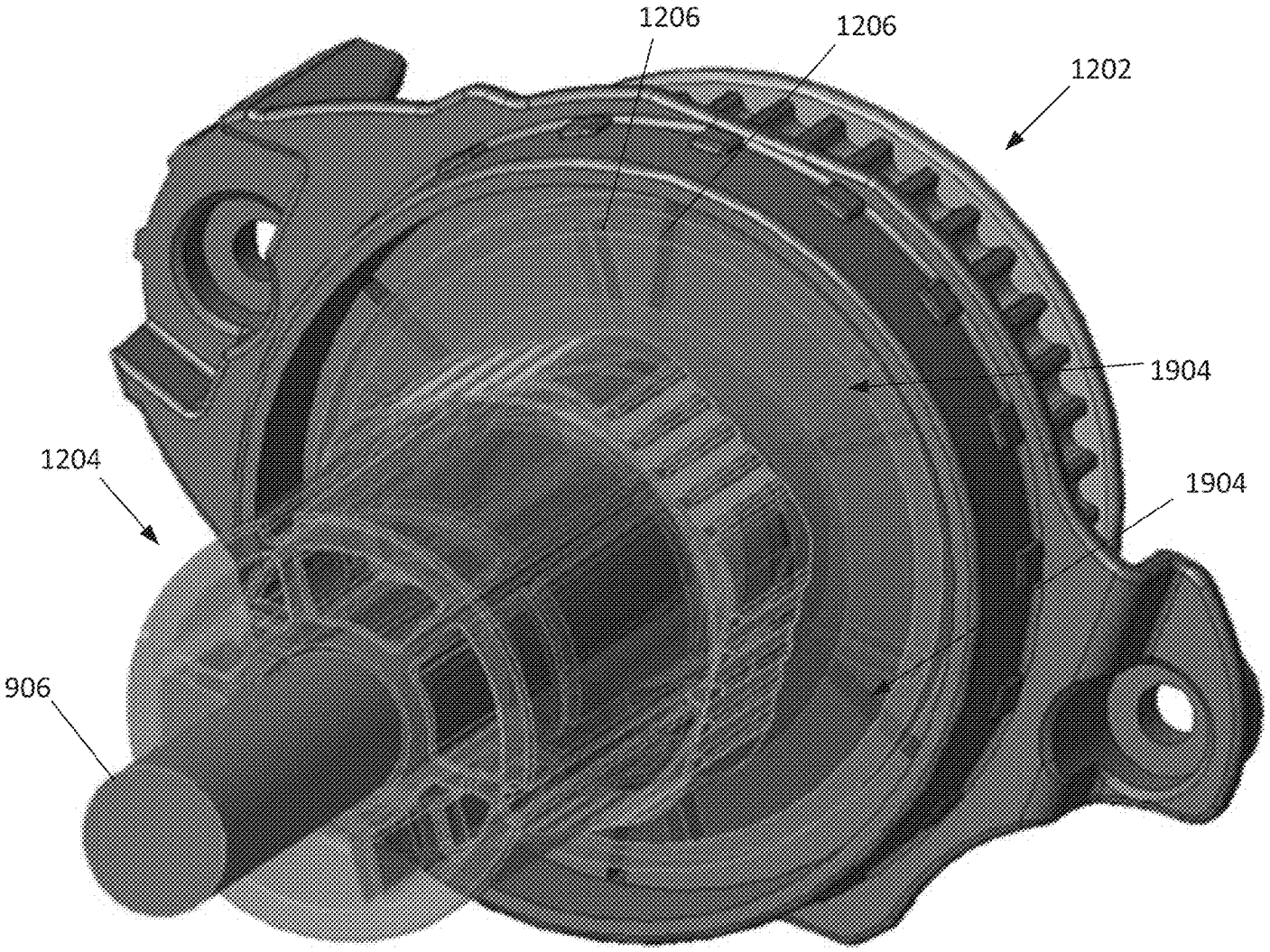
FIG. 23 is a partially transparent view of a set of fragmentors aligned in a first position relative to each other.
Figure 24:
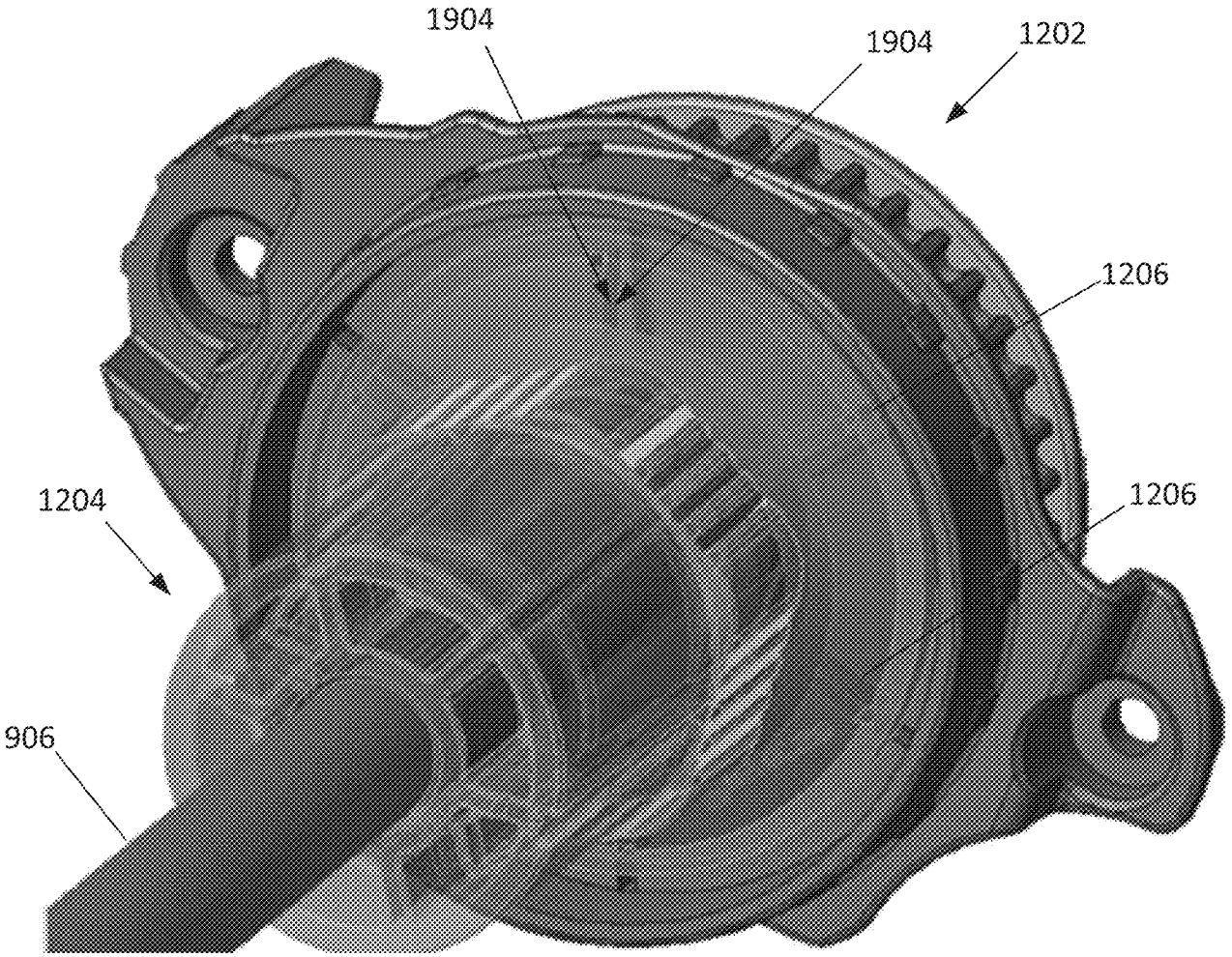
FIG. 24 is a partially transparent view of a set of fragmentors aligned in a second position relative to each other.

Turning now to FIGS. 23-24, the radial cutting surfaces 1904 of debris fragmentors 1206 disposed on both the generally upright section 1508 of the stationary end cap 1202 as well as the housing facing surface 1714 and/or the outer surface 1705 of the central disc 1706 may be angled with respect to each. For example, the radial cutting surfaces 1904 of the debris fragmentors 1206 on the stationary end cap 1202 and the rotating end cap 1204 may be angled to urge hair out of the gap 1402 as generally illustrated in FIG. 23. For example, the radial cutting surfaces 1904 may be aligned such that overlap between the radial cutting surfaces 1904 moves radially outward as the radial cutting surfaces 1904 of the rotating end cap 1204 rotates past the radial cutting surfaces 1904 of the stationary end cap 1202. Alternatively (or in addition), the radial cutting surfaces 1904 of debris fragmentors 1206 disposed on the stationary end cap 1202 and the rotating end cap 1204 may be angled to urge hair towards the center of the gap 1402 as generally illustrated in FIG. 24. For example, the radial cutting surfaces 1904 may be aligned such that overlap between the radial cutting surfaces 1904 moves radially inward as the radial cutting surfaces 1904 of the rotating end cap 1204 rotates past the radial cutting surfaces 1904 of the stationary end cap 1202.

Figure 25:
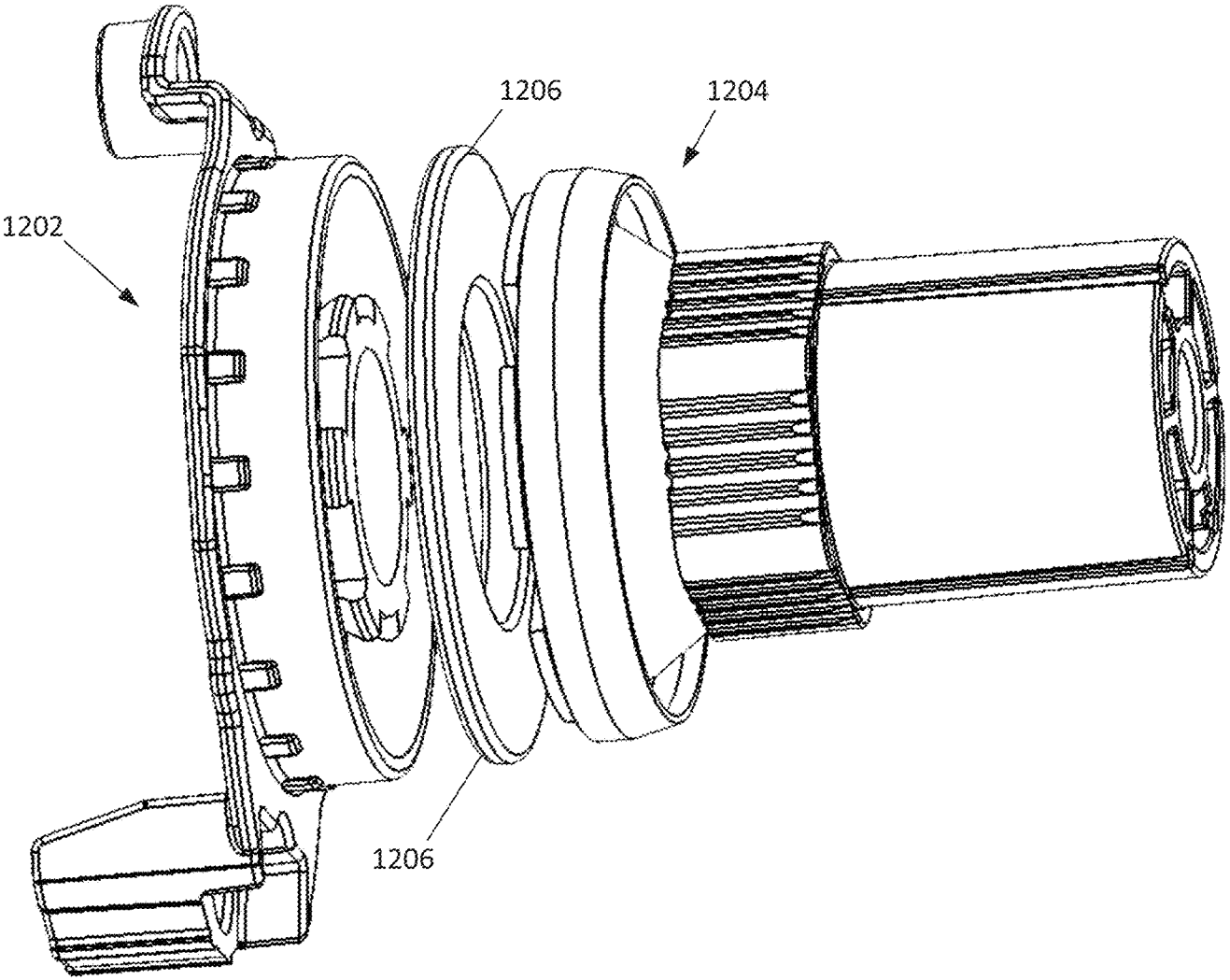
FIG. 25 is a perspective view of a further embodiment of a fragmentor.
Figure 26:
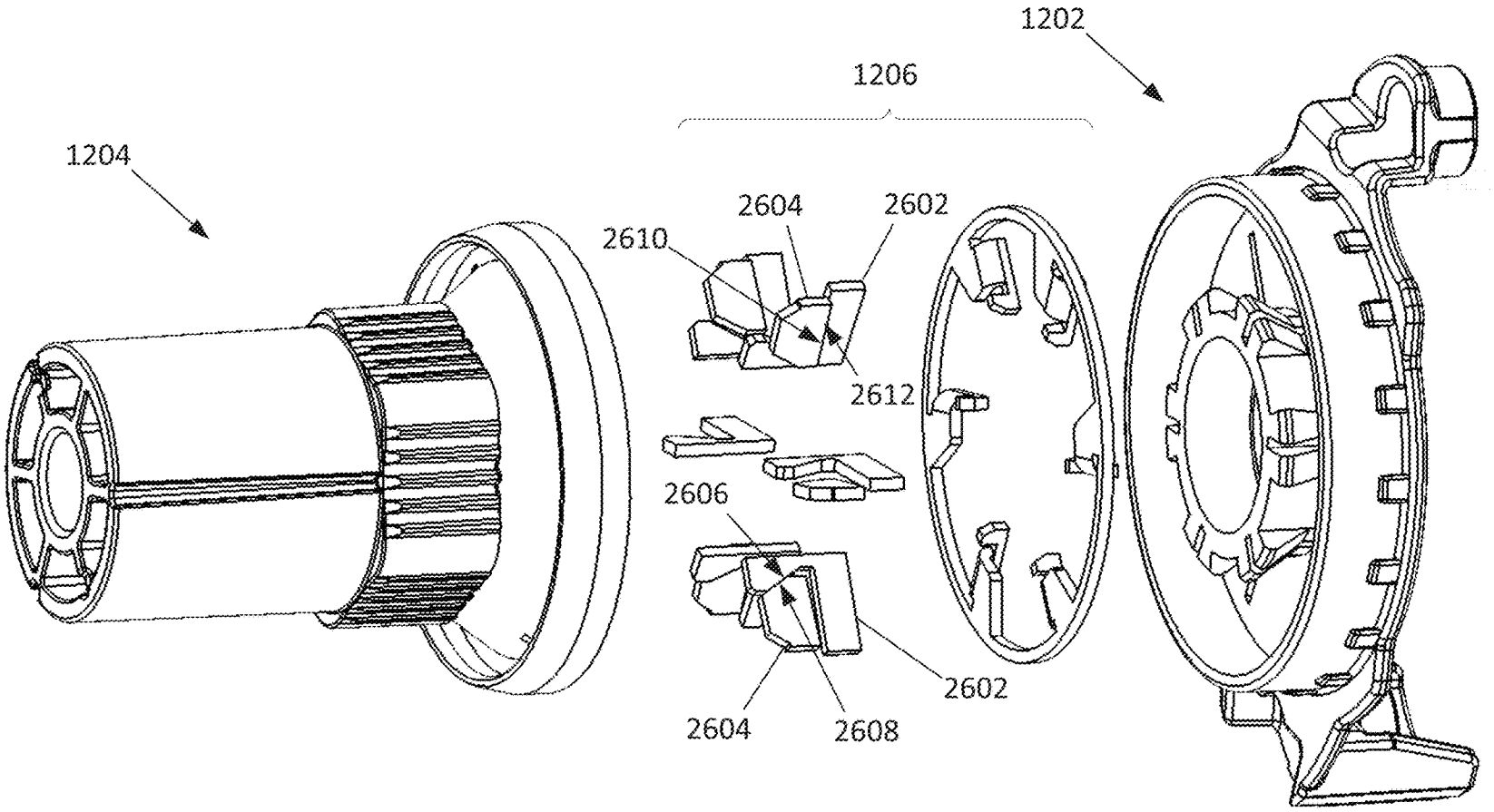
FIG. 26 is an exploded view of a conical embodiment of a fragmentor.
Figure 27:
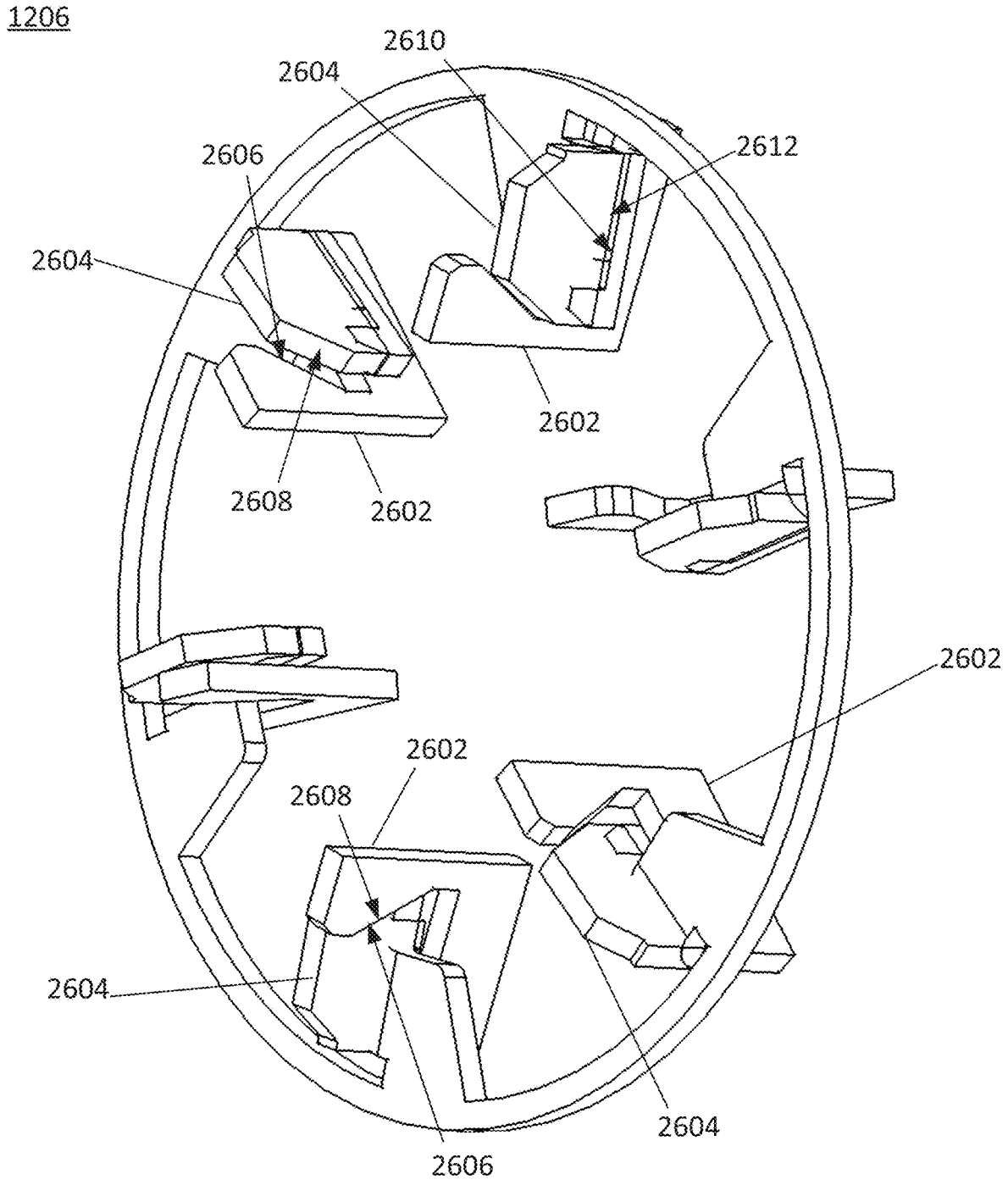
FIG. 27 is an assembled view of the conical fragmentor of FIG. 26.

With reference to FIG. 25, a further example of a debris fragmentor 1206 is generally illustrated. The debris fragmentor 1206 may include an abrasive surface such as, but not limited to, sandpaper or the like. The abrasive surface may include grit sizes ranging from very coarse (~2 mm) to ultrafine (submicrometer), for examples, as defined in the international standard for coated abrasives (ISO 6344). The abrasive debris fragmentor 1206 may be disposed on the generally upright section 1508 of the stationary end cap 1202 and/or the housing facing surface 1714 and/or the outer surface 1705 of the central disc 1706. While the abrasive debris fragmentor 1206 of FIG. 25 is shown disposed in the first portion 1403 of the gap 1402, it should be appreciated that the abrasive debris fragmentor 1206 may be disposed on one or more of the surfaces in the second portion 1404 of the gap 1402.

Turning now to FIGS. 26-30, a further example of debris fragmentors 1206 consistent with the present disclosure is generally illustrated. In particular, FIG. 26 generally illustrates an exploded view of the debris fragmentors 1206 as well as the stationary end cap 1202 and the rotating end cap 1204, FIG. 27 generally illustrates debris fragmentors 1206 in an assembled state, FIG. 28 generally illustrates one example of the stationary end cap 1202, FIG. 29 generally illustrates one example of the rotating end cap 1204, and FIG. 30 generally illustrates a semi-transparent view of one example of the assembled stationary end cap 1202, rotating end cap 1204, and the debris fragmentors 1206.

Figure 28:
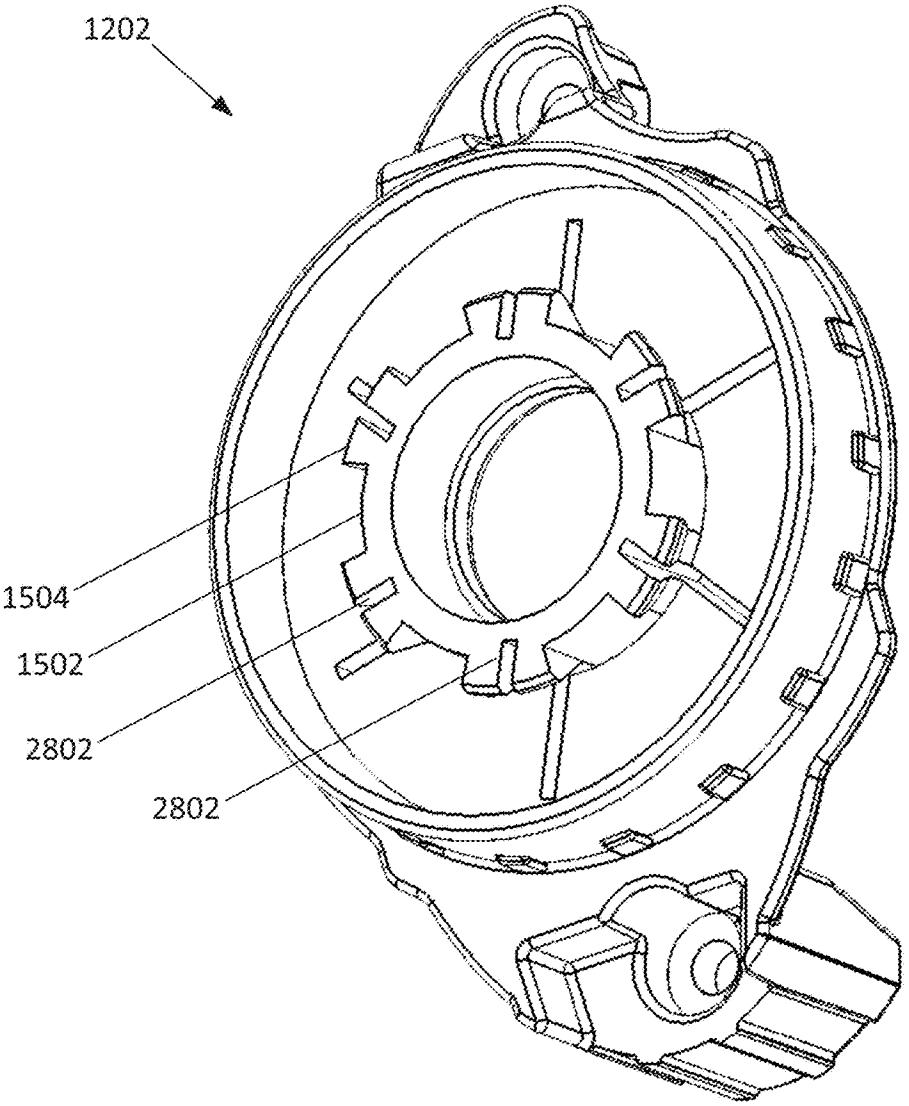
FIG. 28 is a perspective view of one embodiment of a stationary end cap for use with the conical fragmentor of FIG. 26.
Figure 29:
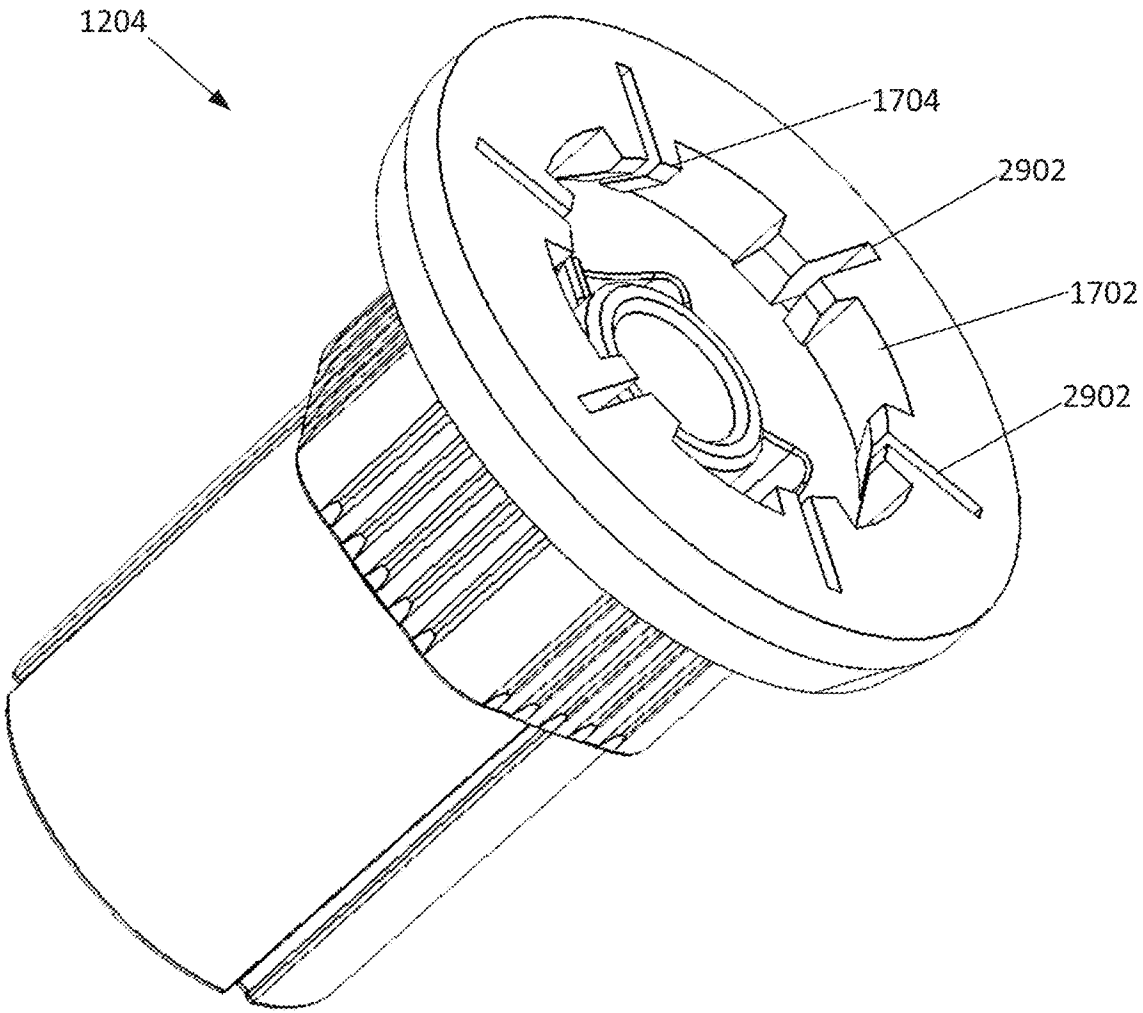
FIG. 29 is a perspective view of one embodiment of a rotating end cap for use with the conical fragmentor of FIG. 26.
Figure 30:
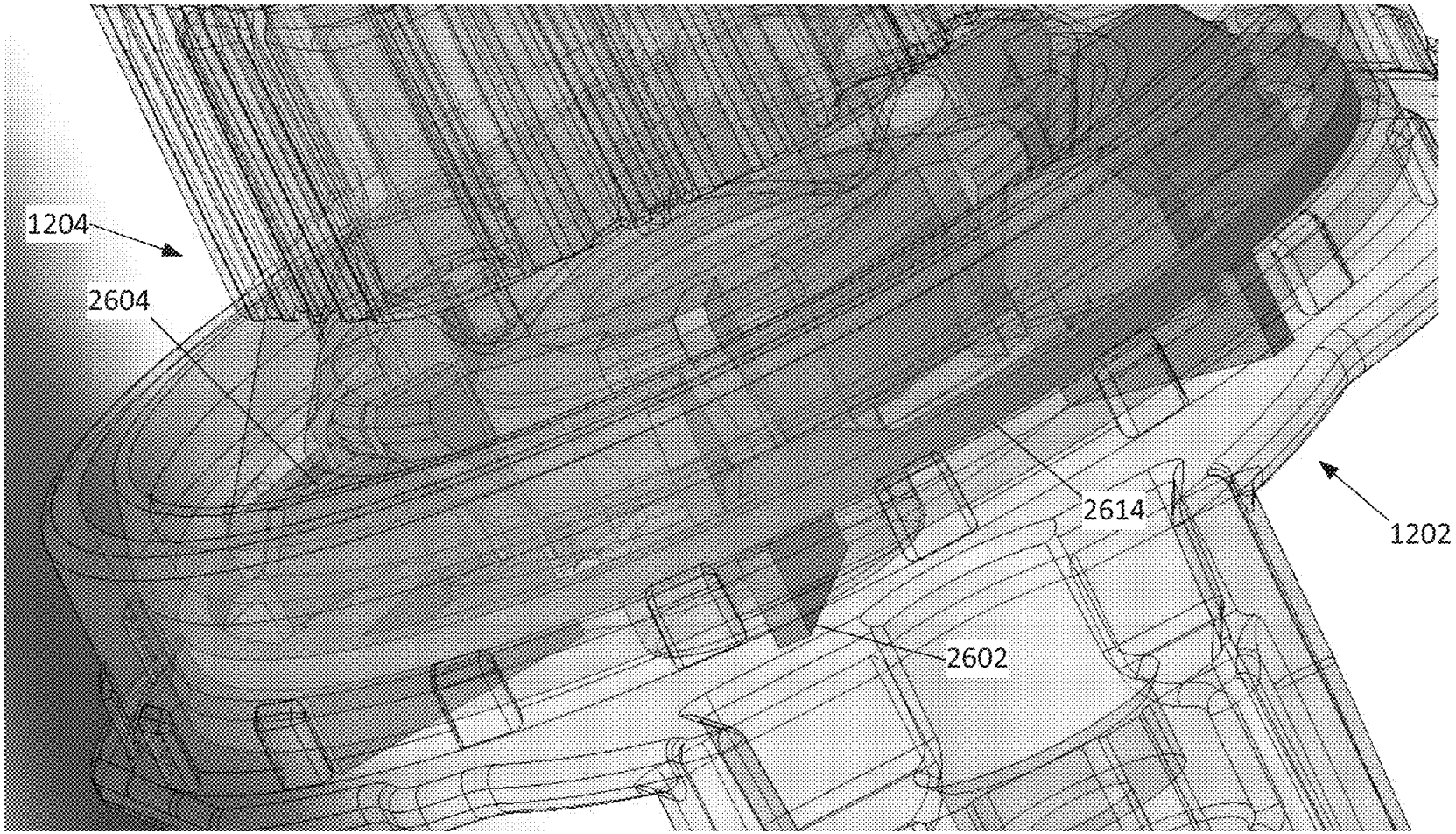
FIG. 30 is a partially transparent view of an assembled end cap assembly including the conical fragmentor of FIG. 26.

The debris fragmentors 1206 of FIGS. 26-30 are configured to cut hair in both the first portion 1403 and second portion 1404 of the gap 1402. The debris fragmentors 1206 may include stationary protrusion cutting blades 2602 configured to be secured to the protrusions 1504 of the stationary end cap 1202 as well as rotating protrusion cutting blades 2604 configured to be secured to the protrusions 1704 of the rotating end cap 1204. For example, the stationary protrusion cutting blades 2602 may be configured to be received in slots, grooves, or the like 2802 formed in the protrusions 1504 of the stationary end cap 1202 as best shown in FIG. 28. Similarly, the rotating protrusion cutting blades 2604 may be configured to be received in slots, grooves, or the like 2902 formed in the protrusions 1704 of the rotating end cap 1204 as best shown in FIG. 29.

The stationary protrusion cutting blades 2602 and/or rotating protrusion cutting blades 2604 may each include a first cutting surface 2606, 2608, respectively, configured to cut debris in the second portion 1204 of the gap 1402 as the rotating end cap 1204 rotates about the pivot axis PA relative to the stationary end cap 1202. The first cutting surfaces 2606, 2608 may therefore have an angle (e.g., contour) that corresponds to the angle (contour) of the housing facing surface 1516 and the agitator facing surface 1716, respectively, within the second portion 1404 of the gap 1402. The stationary protrusion cutting blades 2602 and/or rotating protrusion cutting blades 2604 may each include a second cutting surface 2610, 2612, respectively, configured to cut debris in the first portion 1403 of the gap 1402 as the rotating end cap 1204 rotates about the pivot axis PA relative to the stationary end cap 1202. The second cutting surfaces 2610, 2612 may therefore have an angle (e.g., contour) that corresponds to the angle (contour) of the agitator facing surface 1514 and the housing facing surface 1714, respectively, within the first portion 1403 of the gap 1402.

The debris fragmentor 1206 may optionally include a cutting ring 2614. The cutting ring 2614 may be configured to cut hair in the first and/or second portions 1403, 1404 of the gap 1402. The cutting ring 2614 may engage the stationary protrusion cutting blades 2602 and/or rotating protrusion cutting blades 2604. The cutting ring 2614 may be configured to rotate with the rotating end cap 1204 or may be stationary with respect to the stationary end cap 1202. The cutting ring 2614 may also be configured to retain the stationary protrusion cutting blades 2602 and/or rotating protrusion cutting blades 2604 within the slots 2802, 2902.

Figure 31:
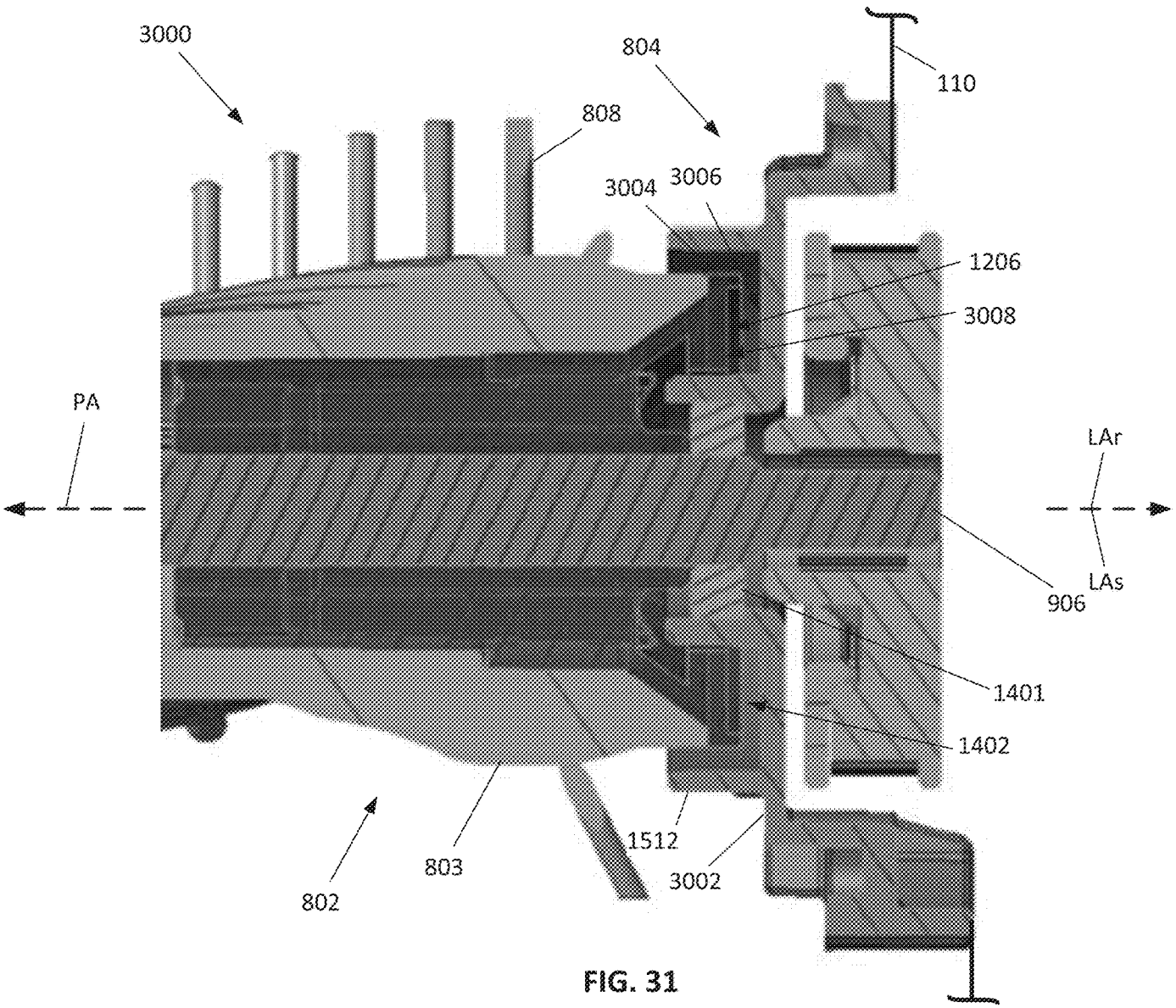
FIG. 31 is a cross-sectional view of another example of an assembled end cap assembly.
Figure 32:
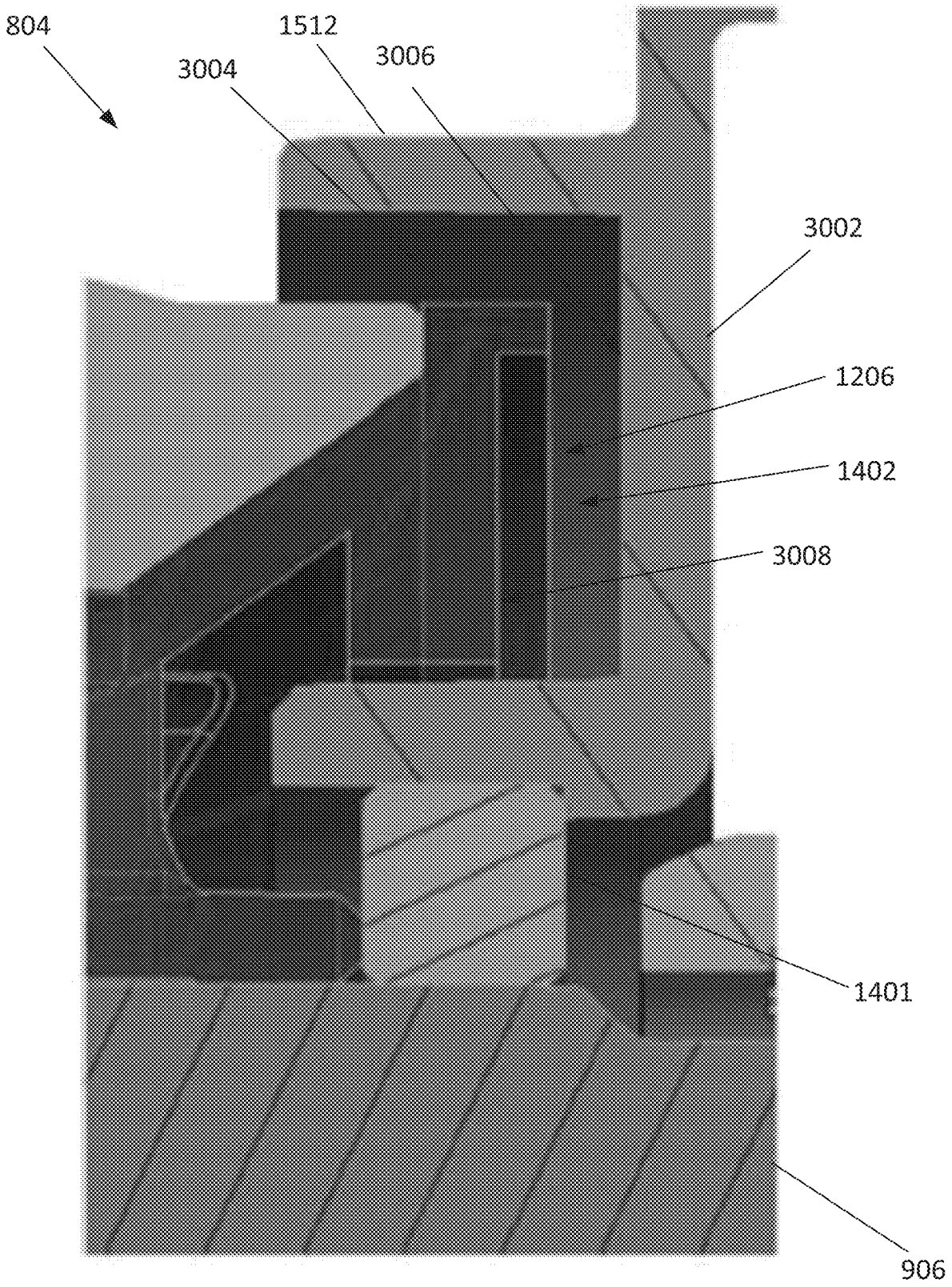
FIG. 32 is a close-up cross-sectional view of the assembled end cap assembly of FIG. 31.
Figure 34:
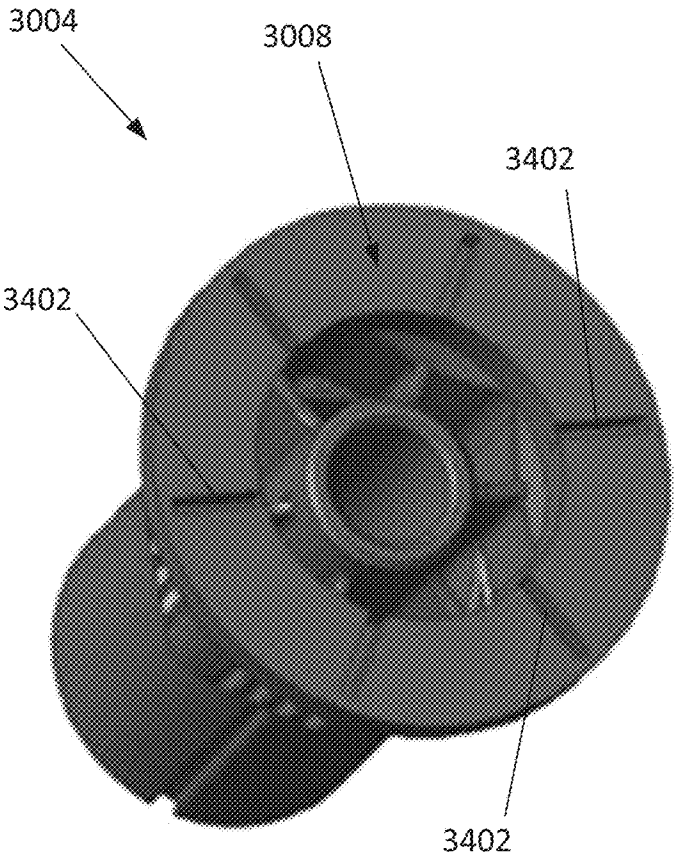
FIG. 34 is a perspective view of one embodiment of a rotating end cap for use with the end cap assembly of FIG. 31.
Figure 33:
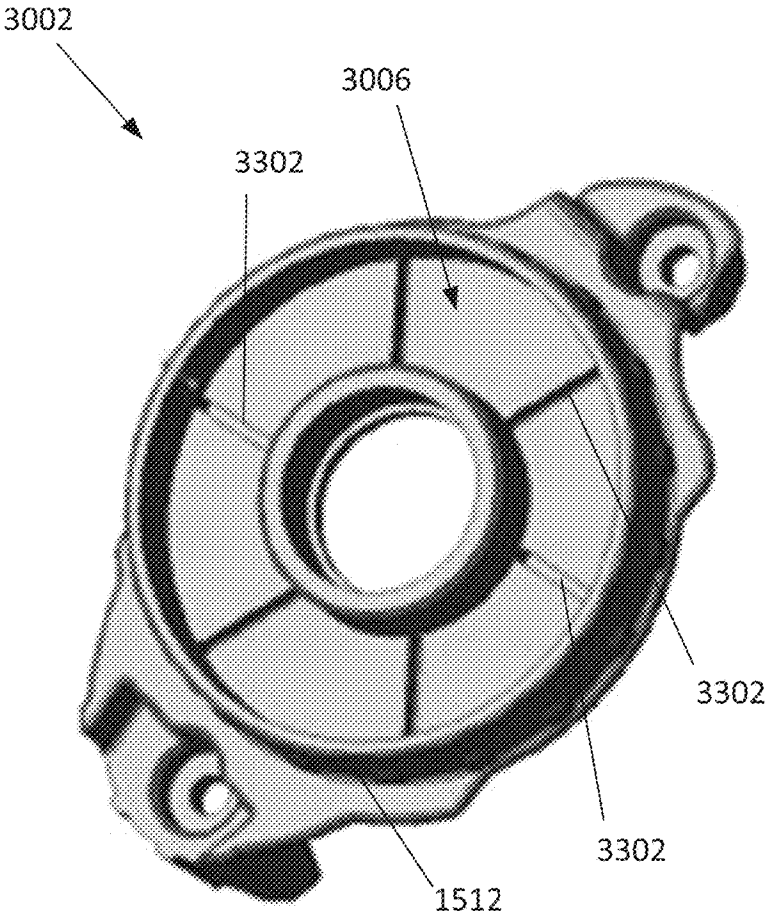
FIG. 33 is a perspective view of one embodiment of a stationary end cap for use with the end cap assembly of FIG. 31.

With reference to FIGS. 31-34, another example of an agitator assembly 3000 is generally illustrated. Again, it should be appreciated that the systems and methods for managing hair at the ends of an agitator as described herein may be used with any agitator. The agitator assembly 3000 generally includes an agitator 802 and with first and second end cap assemblies 804, 806 as generally described herein. While the end cap assembly of FIG. 31 is shown as a driven end cap assembly 804, it should be appreciated that the system for managing hair may be included in a driven and/or a non-driven end cap assembly 804, 806. Thus, while the following description may refer to end cap assembly 804, it should be appreciated that the following description also applies to a non-driven end cap assembly unless specifically stated otherwise.

The end cap assembly 804 may include a stationary end cap 3002 and a rotating end cap 3004. The stationary end cap 3002 and the rotating end cap 3004 may be aligned with respect to each other to form on or more gaps therebetween 1402. To this end, the stationary end cap 3002 and the rotating end cap 3004 may be similar to the stationary end cap 1202 and the rotating end cap 1204; however, the stationary end cap 3002 and the rotating end cap 3004 may eliminate the stationary alignment castellations 1408 and rotating alignment castellations 1410. The stationary end cap 3002 and the rotating end cap 3004 may include a rotating cap facing surface 3006 and a stationary cap facing surface 3008, respectively. The rotating cap facing surface 3006 and a stationary cap facing surface 3008 may generally face each other and may be disposed within and/or define at least a portion of the gap 1402 between stationary end cap 3002 and the rotating end cap 3004. In the illustrated example, the rotating cap facing surface 3006 and stationary cap facing surface 3008 comprise generally planar surfaces extending in a radial plane relative to the pivot axis PA, though it should be appreciated that the present disclosure is not limited to this configuration unless specifically claimed as such.

Hair which migrates from the agitator body 803 and into gap 1402 between the stationary end cap 3002 and the rotating end cap 3004 may be broken into smaller pieces by one or more of the debris fragmentors 1206. The debris fragmentors 1206 may be secured to the stationary end cap 3002 and/or the rotating end cap 3004 (e.g., the rotating cap facing surface 3006 and/or stationary cap facing surface 3008). The debris fragmentors 1206 may include any device for breaking the hair into smaller pieces such as blades, abrasives, or the like. For example, the stationary end cap 3002 and/or the rotating end cap 3004 (e.g., the rotating cap facing surface 3006 and/or stationary cap facing surface 3008) may include one or more slots, grooves, cavities, or the like 3302, 3402 (FIGS. 33 and 34) configured to retain one or more debris fragmentors 1206 (e.g., but not limited to, one or more cutting blades).

Figure 35:
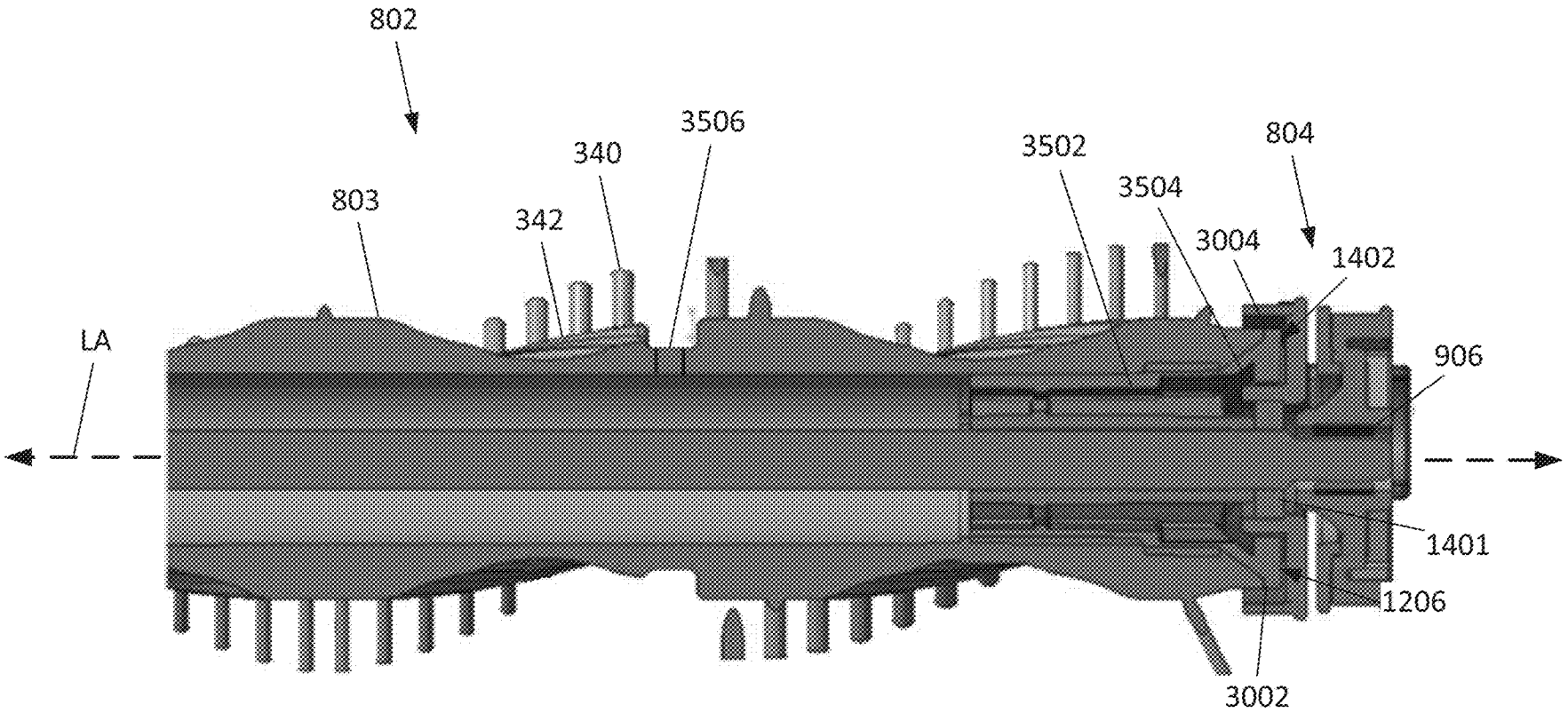
FIG. 35 is a cross-sectional view of one example of an agitator including a suction conduit.

Turning now to FIG. 35, another example of an agitator 802 consistent with the present disclosure is generally illustrated. The agitator 802 may be used in any agitator assemblies 800 described herein. For example, the agitator 802 may be used in combination with any system for managing hair such as, but not limited to, in combination with any of the end cap assemblies 804, 806 described herein. The agitator body 803 may include a plurality of bristles 340 aligned in one or more rows or strips and/or one or more sidewalls and/or continuous sidewalls 342 as generally described herein. Hair which migrates from the agitator body 803 and into gap 1402 between the stationary end cap and the rotating end cap (e.g., but not limited to, stationary end cap 3002 and the rotating end cap 3004) may be broken into smaller pieces by one or more of the debris fragmentors 1206 as generally described herein. The agitator 802 may also include one or more suction conduits 3502. The suction conduits 3502 may extend along at least a portion of the length of the agitator 802 (e.g., generally along the longitudinal axis LA of the agitator 802 and/or along the pivot axis PA) and may include one or more inlets 3504 that are fluidly coupled to the gap 1402 and one or more outlets 3506 that exits the agitator 802 in the brush roll chamber. As such, hair that is broken into pieces by the debris fragmentors 1206 between the stationary end cap and the rotating end cap may be removed from the gap 1402 through the inlet 3504, travel through the suction conduits 3502 formed in the agitator body 803, and exit the agitator 802 through the outlet 3506. The pieces of hair may then be entrained in the dirty airflow within the brush roll chamber. The suction conduits 3502 may therefore be coupled to and/or extend through the rotating end cap 3004.

Figure 36:
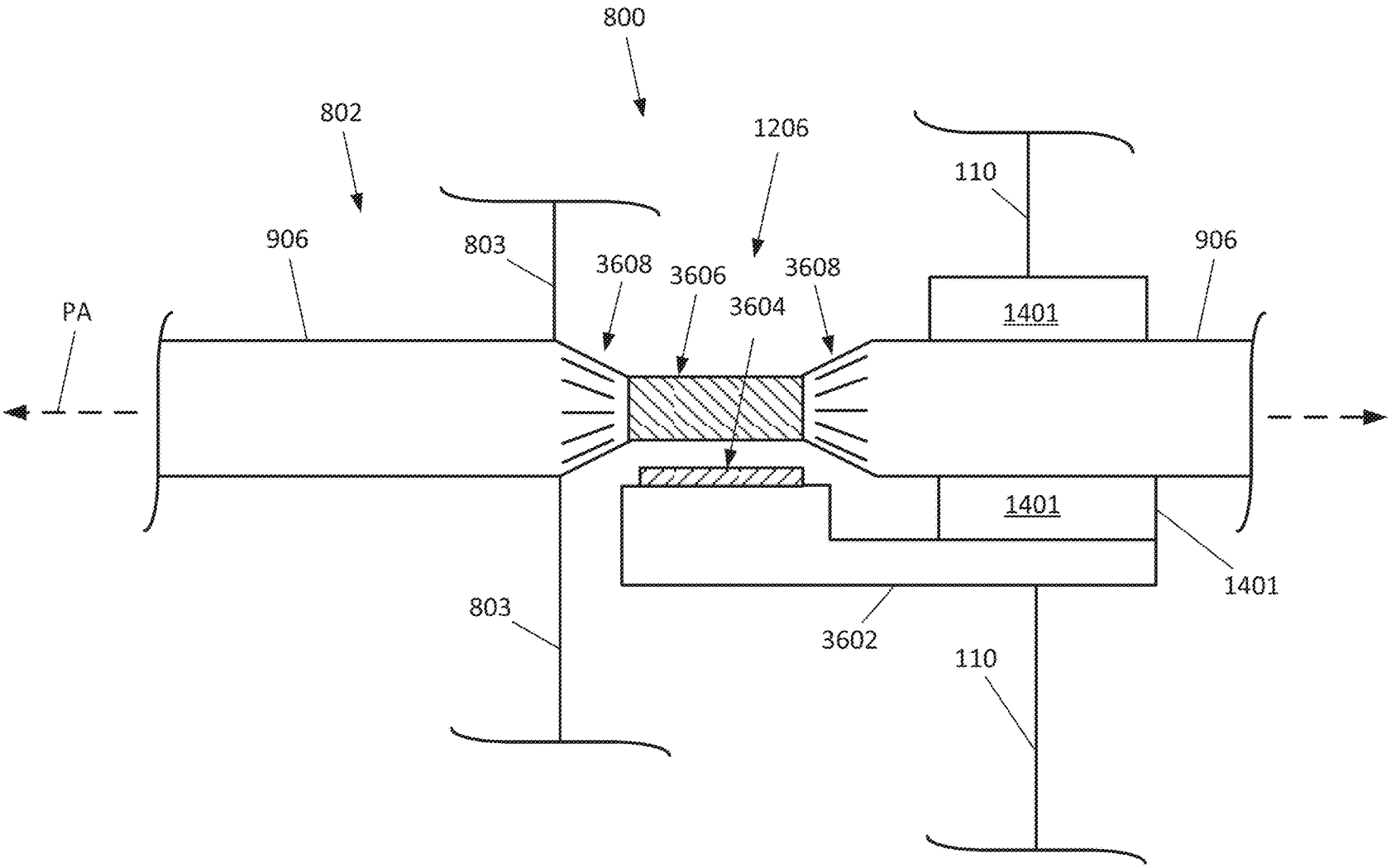
FIG. 36 generally illustrates another example of a fragmentor, consistent with the present disclosure.

With reference to FIG. 36, another example of a hair management system consistent with at least one aspect of the present disclosure is generally illustrated. The agitator assembly 800 may include an agitator 802 comprising an agitator body 803 as generally described herein. The agitator 802 may be coupled to a shaft 906. The agitator 802 and the shaft 906 may rotate about the pivot axis PA. The shaft 906 may be pivotally coupled to the housing 110, for example, by way of one or more bearings 1401.

A debris fragmentor 1206 may be configured to break hair into smaller pieces that wraps around the shaft 906. For example, the debris fragmentor 1206 may include one or more support arms 3602 having a grinding or cutting surface 3604 configured to engage against one or more grinding or cutting surfaces 3606 on the shaft 906. The support arm 3602 may be fixedly coupled to the housing 110 (and/or to a stationary end cap, not shown) such that the support arm 3602 remains stationary with respect to the housing 110 as the agitator 802 rotates about the pivot axis. The grinding or cutting surface 3604 of the support arm 3602 may contact the grinding or cutting surface 3606 of the shaft 906. Alternatively (or in addition), the grinding or cutting surface 3604 of the support arm 3602 may be spaced apart from the grinding or cutting surface 3606 of the shaft 906. In particular, the spacing between the grinding or cutting surfaces 3604, 3606 may be selected to allow a predetermined amount of hair to wrap around the shaft 906. Once the amount of hair begins to exceed this threshold, the hair may be caught between the grinding or cutting surfaces 3604, 3606 and broken into pieces. The grinding or cutting surfaces 3604, 3606 may include cutting surfaces (e.g., cutting blades/edges or the like) and/or abrasive surfaces. For example, the grinding or cutting surface 3606 may include abrasive surface designed to keep the hair rotating with the shaft 906 such that the hair is rotated past the grinding or cutting surface 3604 (which may be either an abrasive surface or a cutting surface) and broken into smaller pieces. Alternatively, the grinding or cutting surface 3604 may include abrasive surface designed to keep the hair rotating with the shaft 906 such that the hair is rotated past the grinding or cutting surface 3606 (which may be either an abrasive surface or a cutting surface) and broken into smaller pieces.

Optionally, the shaft 906 may include one or more radially tapered (e.g. beveled) regions 3608 adjacent to the grinding or cutting surface 3606. The grinding or cutting surface 3606 may be located on a smaller diameter region of the shaft 906 such that the tapered region 3608 generally directs the hair towards the grinding or cutting surface 3606 (since hair will tend to migrate to the lowest diameter region on the agitator assembly 800). Of course, it should be understood that the shaft 906 may be stationary with respect to the housing 110 and the support arm 3602 may rotate with the agitator 802.

Figure 37:
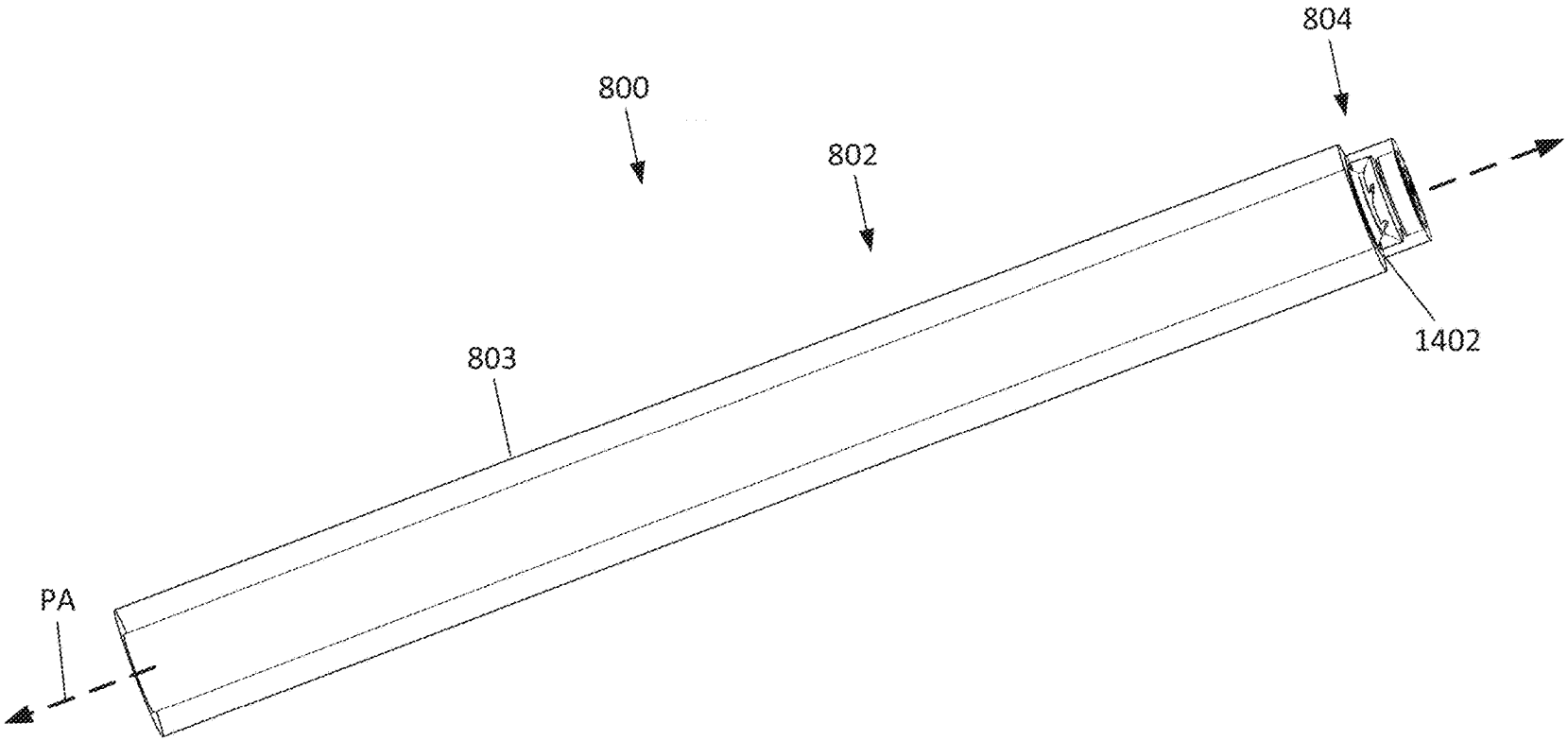
FIG. 37 is a side perspective view of a further example of an agitator assembly, consistent with the present disclosure.

Turning now to FIG. 37, another non-limiting example of an agitator assembly 800 is generally illustrated. Again, it should be appreciated that the systems and methods for managing hair at the ends of an agitator as described herein may be used with any agitator. The agitator assembly 800 generally includes an agitator 802 and first and second end cap assemblies (though only one end cap assembly 804 is illustrated). The agitator 802 may include an elongated agitator body 803 having a generally cylindrical shape that extends along and is configured to rotate about a pivot axis PA as described herein. The agitator 802 may include one or more cleaning features (not shown for clarity) as described herein.

One or more of the end cap assemblies (e.g., end cap assembly 804) may include a gap 1402 that extends radially inward from the agitator body 803. As described herein, some hair will tend to migrate from the agitator body 803 and into the gap 1402 since the gap 1402 has a smaller diameter. Hair that enters into the gap 1402 may be broken into smaller pieces by one or more of the debris fragmentors 1206.

Figure 38:
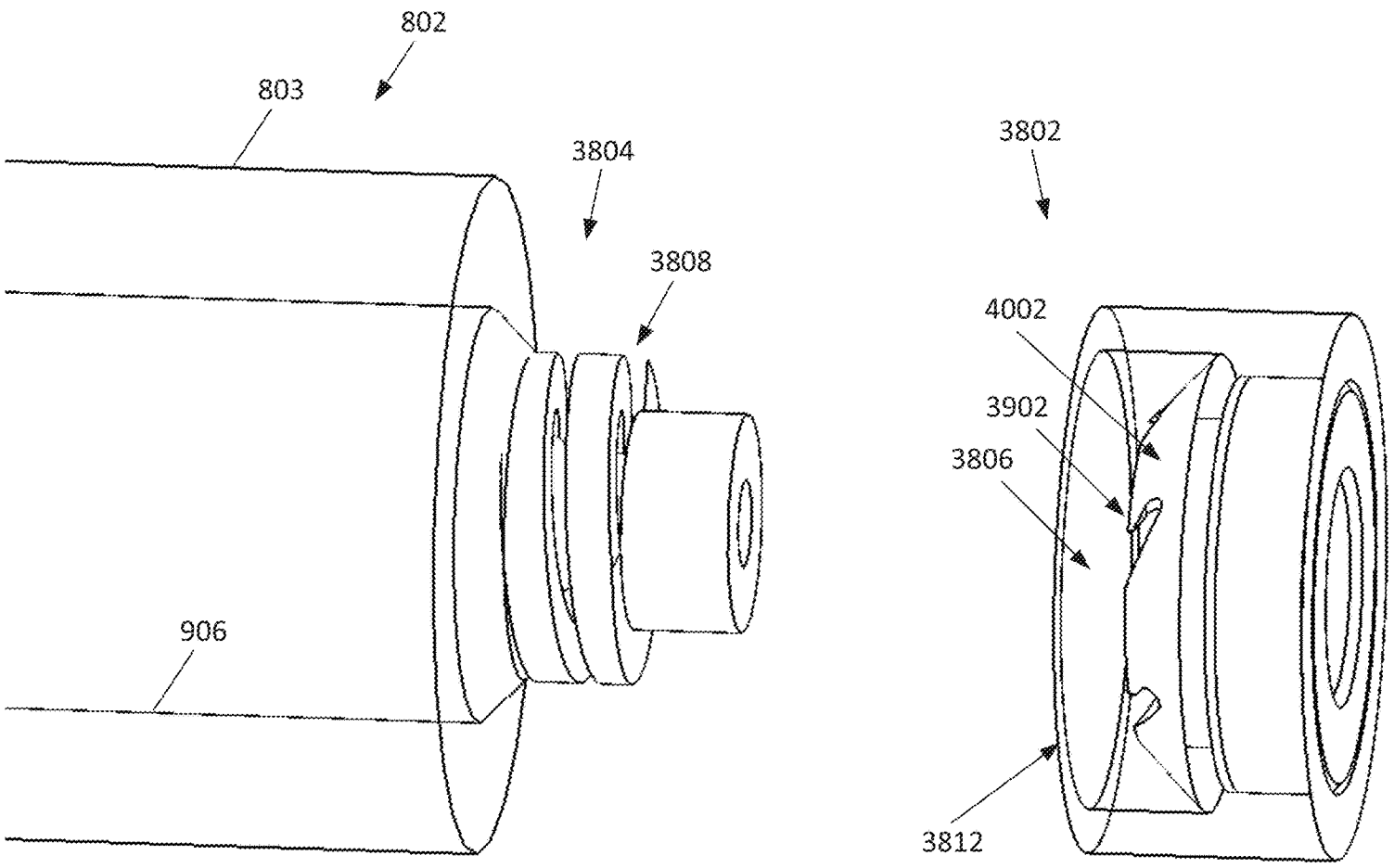
FIG. 38 shows a first perspective view of one example of an exploded end cap assembly including a system for managing hair, consistent with FIG. 37.

The end cap assembly 804 may include a stationary end cap 3802 and a rotating end cap 3804 as generally illustrated in FIG. 38. The stationary end cap 3802 may be fixedly secured to the housing 110 (not shown) such that the stationary end cap 3802 does not move relative to the housing 110. The rotating end cap 3804 may be coupled to the agitator 802 such that rotation of the agitator 802 also results in rotation of the rotating end cap 3804 (e.g., but not limited to, the rotating end cap 3804 and the agitator 802 rotating in unison). According to one example, the rotating end cap 3804 may be coupled to the shaft 906 and/or to the agitator body 803. Alternatively, the rotating end cap 3804 may be unitary with the shaft 906 and/or to the agitator body 803.

Figure 39:
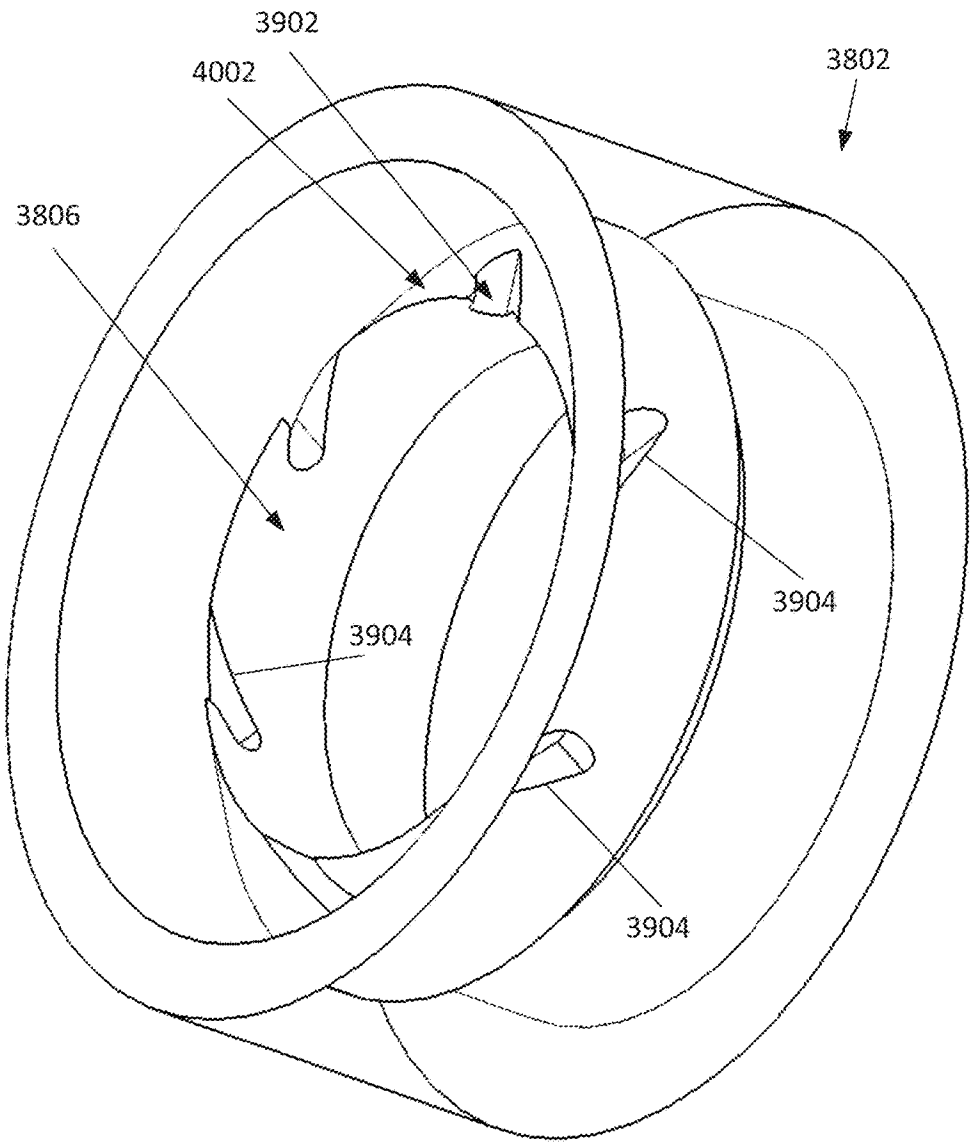
FIG. 39 shows a first perspective view of one example of a stationary end cap, consistent with FIG. 38.
Figure 40:
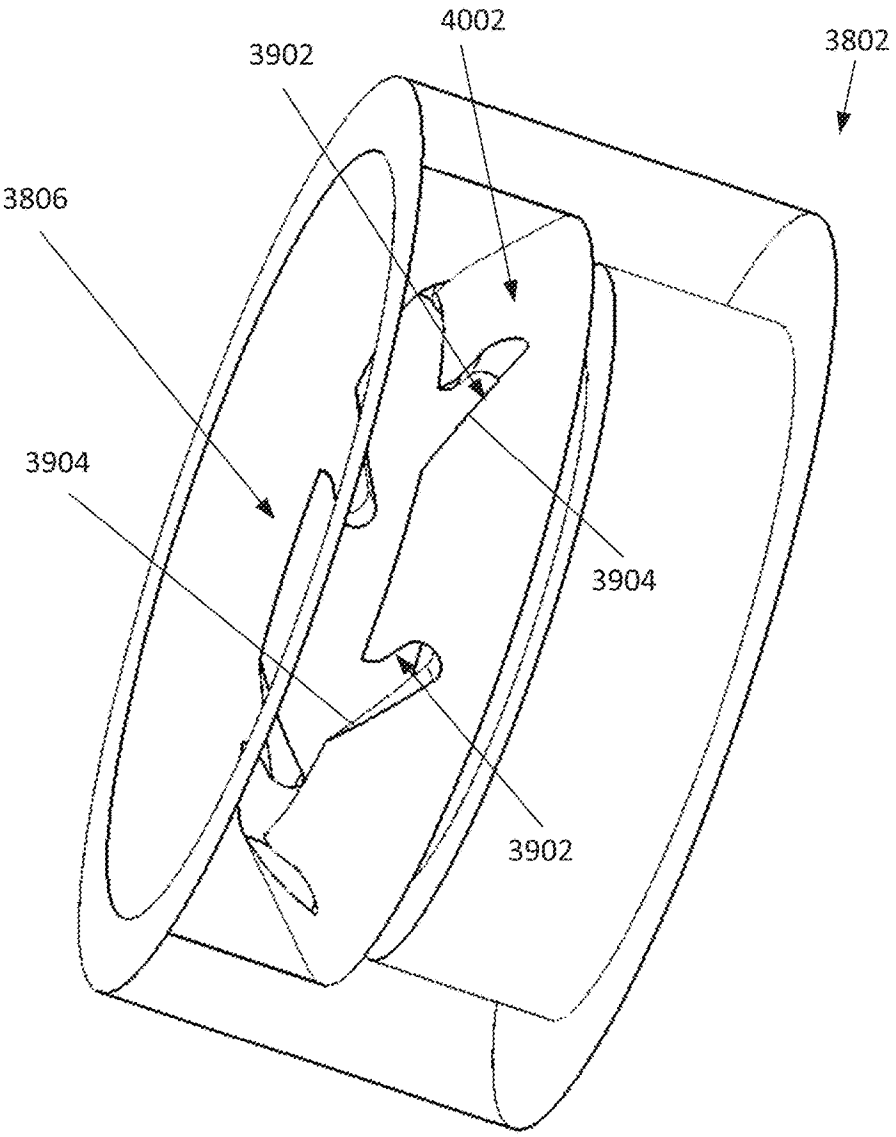
FIG. 40 shows a second perspective view of the stationary end cap assembly of FIG. 39.

With reference to FIGS. 38 and 39-40, the stationary end cap 3802 may define a cavity 3806 configured to receive at least a portion of the rotating end cap 3804. The cavity 3806 may also include a plurality of cutting surfaces 3902. The cutting surfaces 3902 may extend around a periphery 3812 of the cavity 3806, and may optionally include a plurality of slots 3904. The outer surface of the cavity 3806 may have a tapered and/or beveled surface 4002 configured to direct hair towards the rotating end cap 3804.

Figure 41:
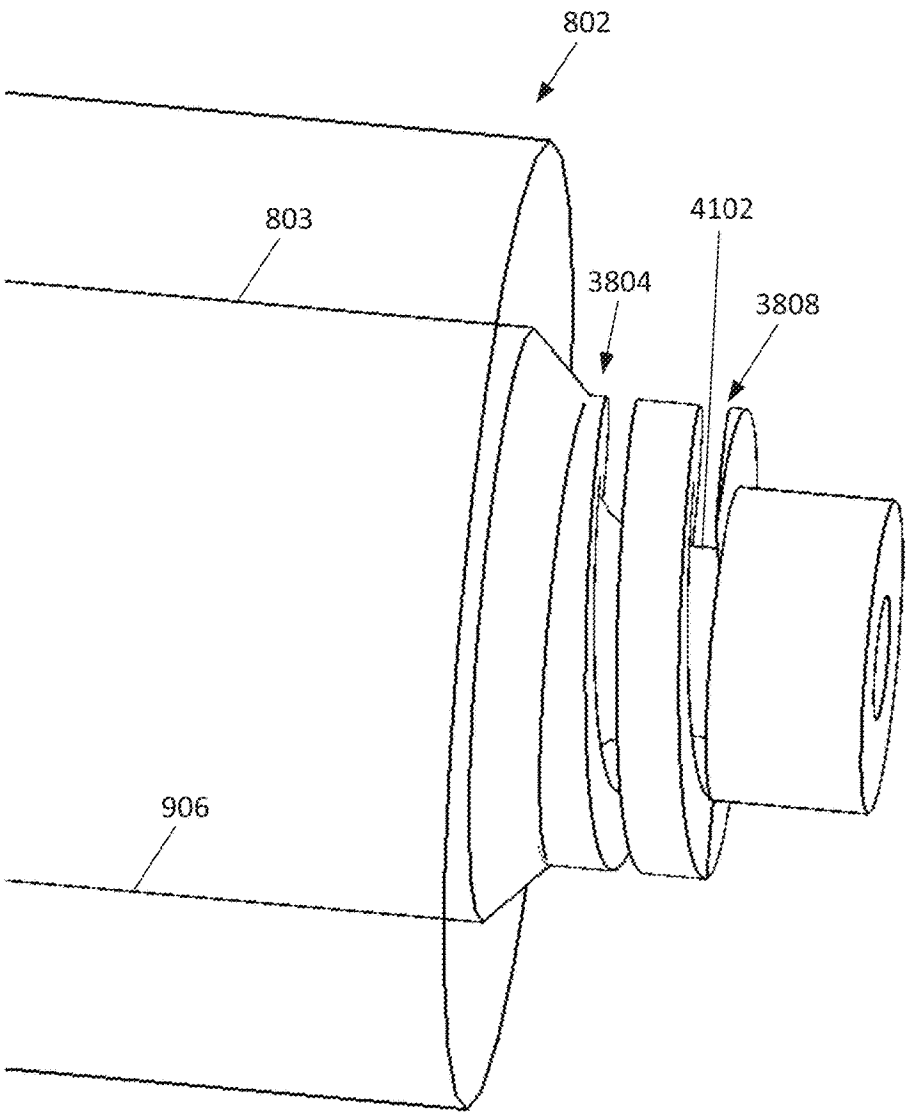
FIG. 41 shows a first perspective view of one example of a rotating end cap, consistent with FIG. 38.
Figure 42:
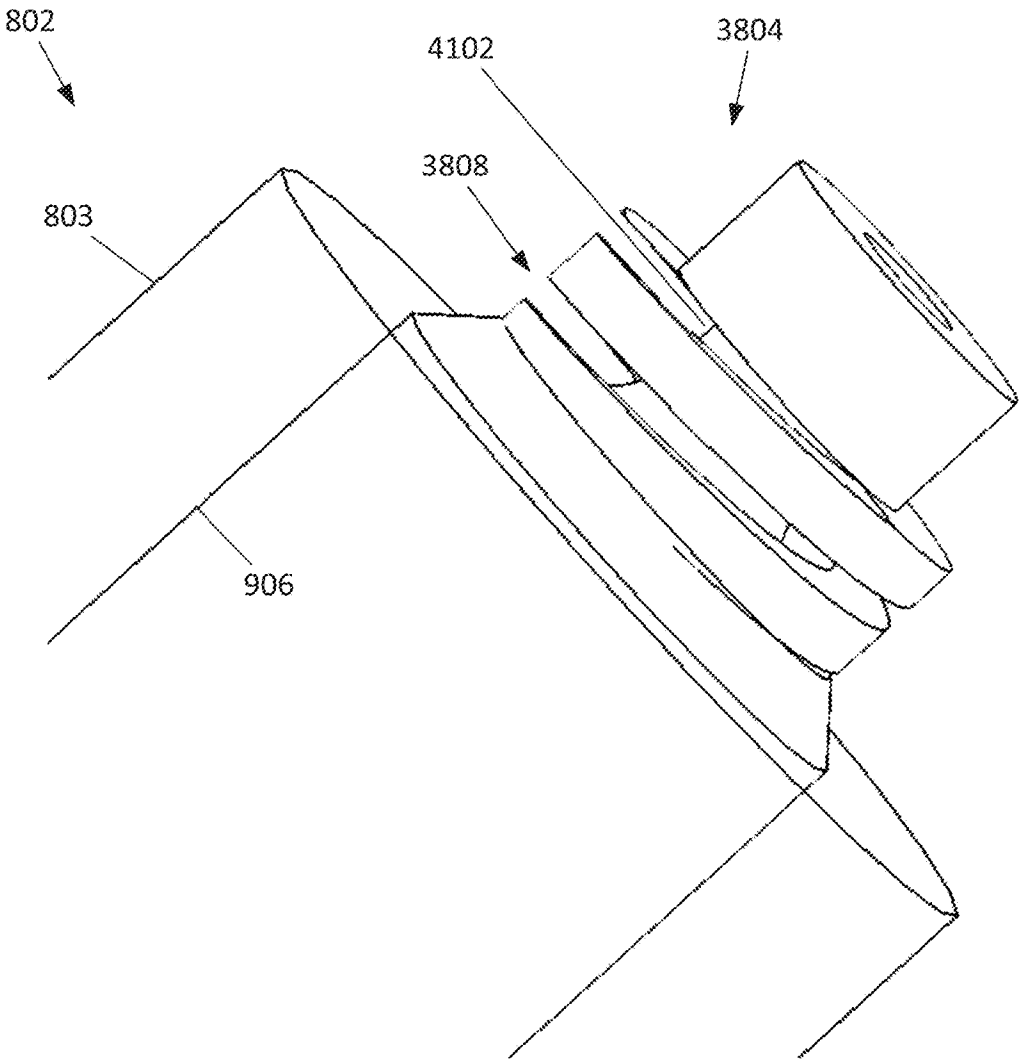
FIG. 42 shows a second perspective view of the rotating end cap assembly of FIG. 41.

With reference to FIGS. 38 and 41-42, the rotating end cap 3804 may include a helical groove 3808. The helical groove 3808 may include a square section spring configured to rotate with the agitator 802. The helical groove 3808 is configured to be at least partially received in the cavity 3806 of the stationary end cap 3802 to define the gap 1402. The helical groove 3808 includes an inner diameter 4102 which is smaller than the diameter of the agitator body 803 and/or the shaft 906. As a result, hair that migrates from the agitator body 803 and into the gap 1402 since the gap 1402 has a smaller diameter than the agitator body 803 and/or the shaft 906. In addition, the helical nature of the helical groove 3808 will also tend to draw hair into the groove as the agitator 802 rotates about the pivot axis PA. The hair then becomes trapped in the helical groove 3808 and begins to build up as the helical groove 3808 rotates. Once the hair builds up to the point where the hair begins to be exposed from the helical groove 3808, the hair will be pinched by the helical groove 3808 and the cutting surfaces 3902 of the stationary end cap 3802, thereby cutting the hair into smaller pieces.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An agitator assembly for a cleaning apparatus comprising:

an agitator including an elongated agitator body having first and second oppositely disposed end most faces and at least one cleaning feature extending therefrom;

a stationary end cap, said stationary end cap configured to be secured to a housing of said cleaning apparatus at least partially between said first end most face of said elongated agitator body and said housing such that said stationary end cap is stationary with respect to said housing;

a rotating end cap separate from said agitator, said rotating end cap is configured to be coupled to said first end most face of said elongated agitator body and configured to rotate relative to said housing such that rotation of said agitator results in rotation of said rotating end cap relative to said stationary end cap;

a gap between said first end most face of said elongated agitator body and said stationary end cap and between said stationary end cap and said rotating end cap and extending at least partially radially inward; and at least one fragmentor disposed at least partially within said gap radially inward of an outer periphery of said rotating end cap, said at least one fragmentor configured to break debris which enters into said gap into smaller pieces.

2. The agitator assembly of claim 1, wherein said at least one fragmentor is disposed on a surface of said stationary end cap facing towards said rotating end cap or on a surface of said rotating end cap facing towards said stationary end cap.

3. The agitator assembly of claim 1, wherein said at least one fragmentor comprises a first and a second fragmentor, wherein said first fragmentor is disposed on a surface of said stationary end cap facing towards said rotating end cap and said second fragmentor is disposed on a surface of said rotating end cap facing towards said stationary end cap.

4. The agitator assembly of claim 3, wherein said first fragmentor and said second fragmentor are configured to contact each other.

5. The agitator assembly of claim 1, wherein said at least one fragmentor comprises a cutting blade or an abrasive surface.

6. The agitator assembly of claim 1, wherein said stationary end cap and said rotating end cap include stationary alignment castellations and rotating alignment castellations, respectively, configured to align said rotating end cap relative to said stationary end cap as said rotating end cap rotates relative to said stationary end cap to define said gap.

7. The agitator assembly of claim 6, wherein:

said stationary alignment castellations comprise a plurality of alternating notches and protrusions extending radially outward from a central hub, said central hub extending along a pivot axis of said agitator; and said rotating alignment castellations comprise a plurality of alternating notches and protrusions extending radially inward from a central disc, said central disc extending radially outwardly relative to said pivot axis of said agitator.

8. The agitator assembly of claim 7, wherein said plurality of notches of said stationary alignment castellations are configured to receive said plurality of protrusions of said rotating alignment castellations and wherein said plurality of notches of said rotating alignment castellations are configured to receive said plurality of protrusions of said stationary alignment castellations.

9. The agitator assembly of claim 8, wherein said plurality of notches of said stationary alignment castellations have a shape substantially corresponding to an inverse of a shape of said plurality of protrusions of said rotating alignment castellations and said plurality of protrusions of said stationary alignment castellations have a shape substantially corresponding to an inverse of said shape of said plurality of notches of the rotating alignment castellations.

10. The agitator assembly of claim 9, wherein said plurality of protrusions of said stationary alignment castellations and said rotating alignment castellations comprise inverse beveled surfaces.

11. The agitator assembly of claim 10, wherein at least a portion of said gap is disposed between said beveled surfaces of said plurality of protrusions of said stationary alignment castellations and said rotating alignment castellations.

12. The agitator assembly of claim 11, wherein said at least one fragmentor is disposed on at least one of said beveled surfaces of said plurality of protrusions of said stationary alignment castellations or said rotating alignment castellations.

13. The agitator assembly of claim 8, wherein said stationary alignment castellations further define a first track configured to allow said plurality of protrusions of said rotating alignment castellations to rotate as said rotating end cap rotates about said pivot axis, and wherein said rotating alignment castellations further define a second track configured to allow said plurality of protrusions of said stationary alignment castellations to pass through as said rotating end cap rotates about said pivot axis.

14. The agitator assembly of claim 7, wherein said central hub extends outwardly from an upright section, said upright section extending radially in a plane that is transverse to said pivot axis and substantially parallel with an outer surface of said central disc that faces said stationary end cap.

15. The agitator assembly of claim 14, wherein at least a portion of said gap is disposed between said upright section of said central hub and said outer surface of said central disc.

16. The agitator assembly of claim 15, wherein said at least one fragmentor is disposed on at least one of said upright section of said central hub or said outer surface of said central disc.

17. The agitator assembly of claim 16, wherein said at least one fragmentor includes a plurality of radial cutting surfaces configured to cut hair along at least one of said upright section or said outer surface of said central disc.

18. The agitator assembly of claim 16, wherein said at least one fragmentor includes a plurality of radial cutting surfaces disposed along a plurality of radially disposed protrusions, said radially disposed plurality of protrusions substantially corresponding to a shape of plurality of protrusions of least one of said stationary alignment castellations or said rotating alignment castellations.

19. The agitator assembly of claim 1, further a suction conduit extending generally along a pivot axis of the agitator, said suction conduit including one or more inlets fluidly coupled to said gap and one or more outlets that exit said agitator in a brush roll chamber such that said broken debris in said gap can be removed from said gap through said inlet, travel through said suction conduit, and exit said agitator through said outlet and into said brush roll chamber.

20. An agitator assembly for a cleaning apparatus, said agitator assembly comprising:

an agitator including an elongated agitator body having first and second oppositely disposed end most faces and at least one cleaning feature extending therefrom;

an end cap assembly including:

a stationary end cap, said stationary end cap configured to be secured to a housing of said cleaning apparatus such that said stationary end cap is stationary with respect to said housing and including a stationary radial end surface generally facing said second end most face of said agitator body; and a rotating end cap, said rotating end cap is configured to be coupled to said first end most face of said agitator body and configured to rotate relative to said housing such that rotation of said agitator results in rotation of said rotating end cap relative to said stationary end cap, wherein said rotating end cap is coupled to said agitator such that at least a portion of a rotating radial end surface generally faces said stationary radial end surface;

a gap between said first end most face of said elongated agitator body and said stationary end cap and between at least a portion of said stationary radial end surface and said rotating end surface and extending at least partially radially inward therebetween; and at least one of:

a first fragmentor secured to said stationary radial end surface of said stationary end cap and disposed at least partially within said gap, said first fragmentor having a first cutting surface facing an end face of said rotating end cap configured to break debris which enters into said gap into smaller pieces; or a second fragmentor secured to said rotating end surface of said rotating end cap and disposed at least partially within said gap, said second fragmentor having a second cutting surface facing an end face of said stationary end cap configured to break debris which enters into said gap into smaller pieces.

21. An agitator assembly for a cleaning apparatus comprising:

an agitator including an elongated agitator body having first and second oppositely disposed end most faces and at least one cleaning feature extending therefrom;

a stationary end cap, said stationary end cap configured to be secured to a housing of said cleaning apparatus at least partially between said first end most face of said elongated agitator body and said housing such that said stationary end cap is stationary with respect to said housing; and a rotating end cap, said rotating end cap is configured to be coupled to said first end most face of said elongated agitator body and configured to rotate relative to said housing such that rotation of said agitator results in rotation of said rotating end cap relative to said stationary end cap;

a gap between said first end most face of said elongated agitator body and said stationary end cap and between said stationary end cap and said rotating end cap and extending at least partially radially inward therebetween; and a first and a second fragmentor disposed at least partially within said gap and secured to said stationary and said rotating end cap, respectively, said first fragmentor having a first cutting surface generally facing said second end most face of said elongated agitator body and said second fragmentor having a second cutting surface generally facing said first fragmentor and said first end most face of said elongated agitator body, said first and said second cutting surfaced being spaced apart from each other such that debris that enters therebetween is broken.

* * * * *